US012662883B2

(12) United States Patent
Xu et al.

(10) Patent No.: US 12,662,883 B2
(45) Date of Patent: Jun. 23, 2026

(54) SYSTEMS AND METHODS FOR DRILLING USING TOOL FACE VALUES PREDICTED WITH A MULTIPLE-INPUT-SINGLE OUTPUT (MISO) MODEL

(71) Applicant: HELMERICH & PAYNE TECHNOLOGIES, LLC, Tulsa, OK (US)

(72) Inventors: Jefferson Xu, Southlake, TX (US); William Edward Weideman, Waxahachie, TX (US); Kyle Stuart Huggins, Auburn, ME (US); John Jeremy Cantwell, Fredericksburg, TX (US)

(73) Assignee: HELMERICH & PAYNE TECHNOLOGIES, LLC, Tulsa, OK (US)

( * ) Notice: Subject to any disclaimer, the term of this patent is extended or adjusted under 35 U.S.C. 154(b) by 586 days.

(21) Appl. No.: 18/066,880

(22) Filed: Dec. 15, 2022

(65) Prior Publication Data

US 2023/0184039 A1 Jun. 15, 2023

Related U.S. Application Data

(60) Provisional application No. 63/265,485, filed on Dec. 15, 2021.

(51) Int. Cl.
*E21B 7/10* (2006.01)
*E21B 44/04* (2006.01)
*E21B 44/08* (2006.01)

(52) U.S. Cl.
CPC ..... *E21B 7/10* (2013.01); *E21B 44/04* (2013.01); *E21B 44/08* (2013.01); *E21B 2200/20* (2020.05)

(58) Field of Classification Search
CPC . E21B 4/003; E21B 4/02; E21B 7/062; E21B 7/067; E21B 7/068; E21B 2200/20;
(Continued)

(56) References Cited

U.S. PATENT DOCUMENTS 8,195,581 B2 * 6/2012 Backstrom ..... G06F 30/20 706/6
10,584,574 B2 3/2020 Benson et al.
(Continued)

FOREIGN PATENT DOCUMENTS

CN 108227495 B 11/2020

OTHER PUBLICATIONS

Khalifeh, Mahmoud, and et al. "Drilling fluids-lost circulation treatment." In SPE Norway Subsurface Conference, p. D011S002R004. SPE, 2019 (Year: 2019).*
(Continued)

*Primary Examiner* — Douglas Kay
(74) *Attorney, Agent, or Firm* — Kilpatrick Townsend & Stockton LLP

(57) ABSTRACT

Embodiments provide various systems and methods for using operating parameters of a drilling system for improving a drilling performance of the drilling system, including monitoring, determining, predicting, and/or controlling tool face orientation, tool face wagging, returning the spindle to a neutral position, and spindle reaction time. These systems and methods may be used together in combination with one or more of the others, or all together in one combination, or may be used separately, and may be combined with one or more other systems of a drilling rig, such as a bit guidance system, an autoslide system, and/or one or more autodrill systems.

16 Claims, 33 Drawing Sheets

(58) Field of Classification Search
CPC ..... E21B 44/00; E21B 44/04; E21B 44/08; E21B 47/024; E21B 7/10
See application file for complete search history.

(56) References Cited

U.S. PATENT DOCUMENTS

| | | | | |
|---|---|---|---|---|
| 11,702,923 | B2 | 7/2023 | Jamieson | |
| 11,773,711 | B2 | 10/2023 | Maus et al. | |
| 11,885,212 | B2 | 1/2024 | Jamieson et al. | |
| 2003/0028332 | A1* | 2/2003 | DiMaggio | G01M 13/02 702/35 |
| 2013/0032407 | A1 | 2/2013 | Edbury et al. | |
| 2018/0313723 | A1* | 11/2018 | Oblizajek | G01M 17/027 |
| 2021/0164336 | A1 | 6/2021 | Benson et al. | |
| 2021/0326721 | A1 | 10/2021 | Zhang et al. | |
| 2021/0381361 | A1* | 12/2021 | Maus | E21B 47/09 |
| 2022/0356797 | A1 | 11/2022 | Hopwood | |
| 2023/0151696 | A1 | 5/2023 | Weideman et al. | |
| 2023/0417135 | A1* | 12/2023 | Weideman | E21B 7/061 |

OTHER PUBLICATIONS

PCT/US2022/081705, "International Search Report and Written Opinion", Mar. 21, 2023, 10 pages.
PCT/US2022/081705, "International Preliminary Report on Patentability", Jun. 27, 2024, 9 pages.
EP22908719.2, "Partial Supplementary European Search Report", Nov. 13, 2025, 14 pages.
Sun, et al., "LSTM-Based Prediction Model for Tool Face State of Sliding Directional Drilling", China Automation Congress (CAS), Oct. 22, 2021, 6 pages.
EP22908719.2, "Extended European Search Report", Feb. 3, 2026, 12 pages.

* cited by examiner

SYSTEMS AND METHODS FOR DRILLING USING TOOL FACE VALUES PREDICTED WITH A MULTIPLE-INPUT-SINGLE OUTPUT (MISO) MODEL

CROSS-REFERENCES TO RELATED APPLICATIONS

This application claims the benefit of priority to U.S. Provisional Patent Application No. 63/265,485, filed Dec. 15, 2021, which is hereby incorporated by reference in its entirety and for all purposes.

This application incorporates by reference U.S. Non-Provisional patent application Ser. No. 16/774,528, entitled "Apparatus and Methods for Automated Slide Drilling, issued as U.S. Pat. No. 10,954,773 in its entirety and for all purposes.

BACKGROUND

Field of the Disclosure

The present disclosure relates generally to drilling of wells for oil and gas production and, more particularly, to systems and methods for tool face prediction using a MISO model, tool face wagging detection, return to neutral method, spindle reaction time estimation and differential pressure signal determination.

Description of the Related Art

Drilling a borehole for the extraction of minerals has become an increasingly complicated operation due to the increased depth and complexity of many boreholes, including the complexity added by directional drilling. Drilling is an expensive operation and errors in drilling add to the cost and, in some cases, drilling errors may permanently lower the output of a well for years into the future. Conventional technologies and methods may not adequately address the complicated nature of drilling and may not be capable of gathering and processing various information from downhole sensors and surface control systems in a timely manner, in order to improve drilling operations and minimize drilling errors.

The determination of the well trajectory from a downhole survey may involve various calculations that depend upon reference values and measured values. However, various internal and external factors may adversely affect the downhole survey and, in turn, the determination of the well trajectory.

SUMMARY OF THE INVENTION

In one aspect, a method of controlling spindle offset during drilling operations based on one or more predicted tool face values can include acquiring, by a control system, a plurality of spindle offset values and a plurality of differential pressure values over a period of time. The method can include generating, by the control system, one or more predicted tool face values over the period of time using a model therefor. The method can include adjusting, by the control system, a spindle offset between two consecutive tool face measured values based on the one or more predicted tool face values. The method can include extracting, by the control system, at least one differential pressure value when the at least one differential pressure value is above a threshold value. The method can include controlling the spindle offset by changing one or more control set points and/or the spindle offset values.

In various embodiments, the model uses a multiple-input-single-output transfer function.

In various embodiments, the method includes acquiring a plurality of weight-on-bit values over a period of time. The method includes acquiring a plurality of rate of penetration values over the period of time.

In various embodiments, inputs to the multiple-input-single-output transfer function comprises two or more of: the plurality of spindle offset values, the plurality of differential pressure values, the plurality of weight-on-bit values, and the plurality of rate of penetration values.

In various embodiments, the inputs to the multiple-input-single-output transfer function are measured from a previous slide.

In various embodiments, the inputs to the multiple-input-single-output transfer function are taken during a current slide.

In an aspect of the disclosure, a system for controlling spindle offset during drilling operations based on one or more predicted tool face values can include one or more processors configured to perform operations that include acquiring, by a control system, a plurality of spindle offset values and a plurality of differential pressure values over a period of time. The operations can include generating, by the control system, one or more predicted tool face values over the period of time using a model therefor. The operations can include adjusting, by the control system, a spindle offset between two consecutive tool face measured values based on the one or more predicted tool face values. The operations can include extracting, by the control system, at least one differential pressure value when the at least one differential pressure value is above a threshold value. The operations can include controlling the spindle offset by changing one or more control set points and/or the spindle offset values. The system can include a drill rig controller. The control system can send to the drill rig controller instructions to drill a wellbore using the one or more control set points and/or the spindle offset values.

In various embodiments, model uses a multiple-input-single-output transfer function.

In various embodiments, the operations further include acquiring a plurality of weight-on-bit values over a period of time. The operations can further include acquiring a plurality of rate of penetration values over the period of time.

In various embodiments, inputs to the multiple-input-single-output transfer function comprises two or more of the plurality of spindle offset values, the plurality of differential pressure values, the plurality of weight-on-bit values, and the plurality of rate of penetration values.

In various embodiments, the inputs to the multiple-input-single-output transfer function are measured from a previous slide.

In various embodiments, the inputs to the multiple-input-single-output transfer function are taken during a current slide.

In an aspect of the disclosure, a non-transitory computer-readable medium storing a set of instructions for controlling spindle offset during drilling operations based on one or more predicted tool face values, the set of instructions including one or more instructions that, when executed by one or more processors of a device, cause the device to perform operations that include acquiring, by a control system, a plurality of spindle offset values and a plurality of differential pressure values over a period of time. The operations can include generating, by the control system, one or more predicted tool face values over the period of time using a model therefor. The operations can include adjusting, by the control system, a spindle offset between two consecutive tool face measured values based on the one or more predicted tool face values. The operations can include extracting, by the control system, at least one differential pressure value when the at least one differential pressure value is above a threshold value. The operations can include controlling the spindle offset by changing one or more control set points and/or the spindle offset values.

In various embodiments, the model uses a multiple-input-single-output transfer function.

In various embodiments, the operations further include acquiring a plurality of weight-on-bit values over a period of time. The operations further include acquiring a plurality of rate of penetration values over the period of time.

In various embodiments, inputs to the multiple-input-single-output transfer function comprises two or more of the plurality of spindle offset values, the plurality of differential pressure values, the plurality of weight-on-bit values, and the plurality of rate of penetration values.

In various embodiments, the inputs to the multiple-input-single-output transfer function are measured from a previous slide.

In various embodiments, the inputs to the multiple-input-single-output transfer function are taken during a current slide.

In an aspect of the disclosure, a method for determining tool face wagging, can include acquiring spindle information associated with a spindle position. The method can include acquiring tool face information associated with a tool face orientation, wherein the spindle information is acquired withing a predetermined threshold time period. The method can include obtaining a first power spectrum of the spindle information and a second power spectrum of the tool face information in a frequency domain. The method can include correlating the first power spectrum and the second power spectrum. Responsive to the correlation, the method can include determining a variation in the tool face in time domain, wherein the variation in the tool face includes a number of times the tool face changes direction. The method can include detecting tool face wagging responsive to one or more direction changes of the tool face in the time domain that corresponds to a spike or dip of the first power spectrum or the second power spectrum in the frequency domain. Upon detection of tool face wagging, the method can include sending one or more control signals to reduce the tool face wagging.

In various embodiments, the method can include determining a control input to reduce the tool face wagging. In various embodiments, the method can include sending instructions to a controller to apply the control input.

In various embodiments, the control input comprises modifying one of: weight-on-bit, rate of penetration, rotation speed, spindle position, oscillation, torque, differential pressure, and/or modifying one or more drilling operations.

In various embodiments, the method further includes determining a frequency of tool face wagging based on the variation in the tool face in time domain due to a movement of a spindle excluding spindle offset adjustments.

In various embodiments, the method further includes comparing the determined frequency with a Nyquist frequency. When the determined frequency is less than the Nyquist frequency, the method can include identifying the determined frequency to be accurate.

In various embodiments, the method can include acquiring a number of oscillation wraps forward and reverse for a rig. The method can include acquiring an oscillation spindle speed. The method can include calculating a true frequency using an average period of spindle oscillations, the number of oscillation wraps forward and reverse, and the oscillation spindle speed.

In various embodiments, the operation of acquiring the spindle position information indicative of spindle position and the tool face signal indicative of the tool face orientation is performed concurrently with the obtaining the first power spectrum of the spindle position information.

In various embodiments, the correlating the power spectrum of the spindle position signal and the power spectrum of the tool face signal comprising using a short time Fourier transform function.

In an aspect of the disclosure, a system for determining tool face wagging can include one or more processors configured to perform operations including acquiring spindle information associated with a spindle position. The operations can include acquiring tool face information associated with a tool face orientation, wherein the spindle information is acquired withing a predetermined threshold time period. In various embodiments, the operations can include obtaining a first power spectrum of the spindle information and a second power spectrum of the tool face information in a frequency domain. In various embodiments, the operations can include correlating the first power spectrum and the second power spectrum. Responsive to the correlation, the operations can include determining a variation in the tool face in time domain, wherein the variation in the tool face includes a number of times the tool face changes direction. The operations can include detecting tool face wagging responsive to one or more direction changes of the tool face in the time domain that corresponds to a spike or dip of the first power spectrum or the second power spectrum in the frequency domain. Upon detection of tool face wagging, the operations can include sending one or more control signals to reduce the tool face wagging.

In various embodiments, the operations can include determining a control input to reduce the tool face wagging. The operations can include sending instructions to a controller to apply the control input.

In various embodiments, the control input comprises modifying one of weight-on-bit, rate of penetration, rotation speed, spindle position, oscillation, torque, differential pressure, and/or modifying one or more drilling operations.

In various embodiments, the operations can include determining a frequency of tool face wagging based on the variation in the tool face in time domain due to a movement of a spindle excluding spindle offset adjustments.

In various embodiments, the operations further include comparing the determined frequency with a Nyquist frequency. When the determined frequency is less than the Nyquist frequency, the operations can include identifying the determined frequency to be accurate.

In various embodiments, the operations can include acquiring a number of oscillation wraps forward and reverse for a rig. The operations can include acquiring an oscillation spindle speed. The operations can include calculating a true frequency using an average period of spindle oscillations, the number of oscillation wraps forward and reverse, and the oscillation spindle speed.

In various embodiments, the operation of acquiring the spindle position information indicative of spindle position and the tool face signal indicative of the tool face orientation is performed concurrently with the obtaining the first power spectrum of the spindle position information.

In various embodiments, the correlating the power spectrum of the spindle position signal and the power spectrum of the tool face signal comprising using a short time Fourier transform function.

In an aspect of the disclosure, a non-transitory computer-readable medium storing a set of instructions for determining tool face wagging, the set of instructions when executed by one or more processors of a device, cause the device to perform operations including acquiring spindle information associated with a spindle position. The operations include acquiring tool face information associated with a tool face orientation, wherein the spindle information is acquired withing a predetermined threshold time period. The operations can include obtaining a first power spectrum of the spindle information and a second power spectrum of the tool face information in a frequency domain. The operations can include correlating the first power spectrum and the second power spectrum. Responsive to the correlation, the operations can include determining a variation in the tool face in time domain, wherein the variation in the tool face includes a number of times the tool face changes direction. The operations can include detect tool face wagging responsive to one or more direction changes of the tool face in the time domain corresponds to a spike or dip of the first power spectrum or the second power spectrum in the frequency domain.

In various embodiments, the operations can include determining a control input to reduce the tool face wagging. The operations can include sending instructions to a controller to apply the control input.

In various embodiments, the control input comprises modifying one of weight-on-bit, rate of penetration, rotation speed, spindle position, oscillation, torque, differential pressure, and/or modifying one or more drilling operations.

In various embodiments, the operations further comprising determining a frequency of tool face wagging based on the variation in the tool face in time domain due to a movement of a spindle excluding spindle offset adjustments.

In various embodiments, the operations can further include comparing the determined frequency with a Nyquist frequency. When the determined frequency is less than the Nyquist frequency, the operations can include identifying the determined frequency to be accurate.

In various embodiments, the operations can include acquiring a number of oscillation wraps forward and reverse for a rig. The operations can include acquiring an oscillation spindle speed. The operations can include calculating a true frequency using an average period of spindle oscillations, the number of oscillation wraps forward and reverse, and the oscillation spindle speed.

In various embodiments, the operation of acquiring the spindle position information indicative of spindle position and the tool face signal indicative of the tool face orientation is performed concurrently with the obtaining the first power spectrum of the spindle position information.

In various embodiments, the correlating the power spectrum of the spindle position signal and the power spectrum of the tool face signal comprising using a short time Fourier transform function.

In an aspect of the disclosure, a method for drilling with a neutral position for a spindle of a drilling system can include detecting oscillation of a spindle of a drilling system. The method can include monitoring a movement of the spindle for a predetermined amount of time. Responsive to the monitoring, the method can include determining a first torque on a first side of an assumed neutral point of the spindle and a second torque on a second side of the assumed neutral point the spindle based on the monitoring. The method can include determining that a difference between the first torque on the first side of the assumed neutral point of the spindle and the second torque on the second side of the assumed neutral point of the spindle is outside a predetermined range therefor or exceeds a threshold therefor. The method can include determining that the spindle is at a non-neutral position based on the difference being outside the predetermined threshold range. The method can include computing a spindle offset value corresponding to the non-neutral position.

In various embodiments, the method can include recommending a spindle adjustment to align the spindle at a neutral position to reduce oscillation of a tool face.

In various embodiments, the method can include automatically implementing a spindle adjustment to align the spindle at a neutral position to reduce oscillation of a tool face.

In various embodiments, a full oscillation cycle is defined as an up or down first movement of the spindle while turning in one direction and a second movement in an opposite direction.

In various embodiments, a neutral position is an offset point.

In various embodiments, the first torque on the right side of the assumed neutral point of the spindle and the second torque on the second side of the assumed neutral point of the spindle are within a predetermined threshold of being equal.

In an aspect of the disclosure, a system for drilling with a neutral position for a spindle of a drilling system that can include one or more processors configured to perform operations including detecting oscillation of a spindle of a drilling system. The operations can include monitoring a movement of the spindle for a predetermined amount of time. Responsive to the monitor, the operations can include determining a first torque on a first side of an assumed neutral point of the spindle and a second torque on a second side of the assumed neutral point the spindle based on the monitoring. The operations can include determining that a difference between the first torque on the first side of the assumed neutral point of the spindle and the second torque on the second side of the assumed neutral point of the spindle is outside a predetermined range therefor or exceeds a threshold therefor. The operations can include determining that the spindle is at a non-neutral position based on the difference being outside the predetermined threshold range. The operations can include computing a spindle offset value corresponding to the non-neutral position.

In various embodiments, the operations further comprising recommending a spindle adjustment to align the spindle at a neutral position to reduce oscillation of a tool face.

In various embodiments, the operations further comprising automatically implementing a spindle adjustment to align the spindle at a neutral position to reduce oscillation of a tool face.

In various embodiments, a full oscillation cycle is defined as an up or down first movement of the spindle while turning in one direction and a second movement in an opposite direction.

In various embodiments, a neutral position is an offset point.

In various embodiments, the first torque on the right side of the assumed neutral point of the spindle and the second torque on the second side of the assumed neutral point of the spindle are within a predetermined threshold of being equal.

In an aspect of the disclosure, a non-transitory computer-readable medium storing a set of instructions for drilling with a neutral position for a spindle of a drilling system, the set of instructions comprising when executed by one or more processors of a device, cause the device to perform operations can include detecting oscillation of a spindle of a drilling system. The operations can include monitoring a movement of the spindle for a predetermined amount of time. Responsive to the monitor, the operations can include determining a first torque on a first side of an assumed neutral point of the spindle and a second torque on a second side of the assumed neutral point the spindle based on the monitoring. The operations can include determining that a difference between the first torque on the first side of the assumed neutral point of the spindle and the second torque on the second side of the assumed neutral point of the spindle is outside a predetermined range therefor or exceeds a threshold therefor. The operations can include determining that the spindle is at a non-neutral position based on the difference being outside the predetermined threshold range. The operations can include computing a spindle offset value corresponding to the non-neutral position.

In various embodiments, the operations further comprising recommending a spindle adjustment to align the spindle at a neutral position to reduce oscillation of a tool face.

In various embodiments, the operations further comprising automatically implementing a spindle adjustment to align the spindle at a neutral position to reduce oscillation of a tool face.

In various embodiments, a full oscillation cycle is defined as an up or down first movement of the spindle while turning in one direction and a second movement in an opposite direction.

In various embodiments, a neutral position is an offset point.

In various embodiments, the first torque on the right side of the assumed neutral point of the spindle and the second torque on the second side of the assumed neutral point of the spindle are within a predetermined threshold of being equal.

In an aspect of the disclosure, a method for estimating spindle reaction time to a tool face change can include acquiring a spindle offset signal indicative of a change in spindle offset and a tool face signal indicative of a change in tool face over a predetermined period of time.

The method can include correlating the spindle offset signal and the tool face signal. The method can include identifying a delay time in correlated signals as a spindle reaction time estimate.

In various embodiments, the method can include tuning a spindle controller based on the spindle reaction time estimate.

In various embodiments, the method can include varying a timing or a magnitude of a control input for a drilling rig based at least in part of the estimated spindle reaction time.

In various embodiments, the method can include correlating the spindle offset signal and the tool face signal is performed using a single-input single-output model and the spindle offset signal is an input of the single-input single-output model and a tool face value is an output of the single-input single-output model.

In various embodiments, the correlating the spindle offset signal and the tool face signal is performed using a multiple-input single-output model.

In various embodiments, a differential pressure is an input to the single-input single-output model.

In various embodiments, the method can include determining a period of time during the acquiring the spindle offset signal and the tool face signal that produces a highest cross-correlation between the spindle offset and the tool face signal. The method can include extracting spindle offset signal data and tool face signal data for the period of time.

In various embodiments, the spindle reaction time estimate is determined using a dynamic time warping model.

In an aspect of the disclosure, a system for estimating spindle reaction time to a tool face change can include one or more processors configured to perform operations including acquiring a spindle offset signal indicative of a change in spindle offset and a tool face signal indicative of a change in tool face over a predetermined period of time. The operations can include correlate the spindle offset signal and the tool face signal. The operations can include identifying a delay time in correlated signals as a spindle reaction time estimate.

In various embodiments, the operations further comprising tuning a spindle controller based on the spindle reaction time estimate.

In various embodiments, the operations further comprising varying a timing or a magnitude of a control input for a drilling rig based at least in part of the estimated spindle reaction time.

In various embodiments, the correlating the spindle offset signal and the tool face signal is performed using a single-input single-output model and the spindle offset signal is an input of the single-input single-output model and a tool face value is an output of the single-input single-output model.

In various embodiments, the correlating the spindle offset signal and the tool face signal is performed using a multiple-input single-output model.

In various embodiments, a differential pressure is an input to the single-input single-output model.

In various embodiments, the operations can include determining a period of time during the acquiring the spindle offset signal and the tool face signal that produces a highest cross-correlation between the spindle offset and the tool face signal. The operations can include extracting spindle offset signal data and tool face signal data for the period of time.

In various embodiments, the spindle reaction time estimate is determined using a dynamic time warping model.

In an aspect of the disclosure, a non-transitory computer-readable medium storing a set of instructions for estimating spindle reaction time to a tool face change, the set of instructions when executed by one or more processors of a device, cause a computing device to perform operations including acquiring a spindle offset signal indicative of a change in spindle offset and a tool face signal indicative of a change in tool face over a predetermined period of time. The operations can include correlating the spindle offset signal and the tool face signal. The operations can include identifying a delay time in correlated signals as a spindle reaction time estimate.

In various embodiments, the operations further comprising tuning a spindle controller based on the spindle reaction time estimate.

In various embodiments, the operations further comprising varying a timing or a magnitude of a control input for a drilling rig based at least in part of the estimated spindle reaction time.

In various embodiments, the correlating the spindle offset signal and the tool face signal is performed using a single-input single-output model and the spindle offset signal is an input of the single-input single-output model and a tool face value is an output of the single-input single-output model.

In various embodiments, the correlating the spindle offset signal and the tool face signal is performed using a multiple-input single-output model.

In various embodiments, a differential pressure is an input to the single-input single-output model.

In various embodiments, the operations can include determining a period of time during the acquiring the spindle offset signal and the tool face signal that produces a highest cross-correlation between the spindle offset and the tool face signal. The operations can include extracting spindle offset signal data and tool face signal data for the period of time.

In various embodiments, the spindle reaction time estimate is determined using a dynamic time warping model.

In an aspect of the disclosure, a method for differential pressure signal determination, can include acquiring a standpipe pressure signal. The method can include generating a filtered standpipe pressure signal by filtering the standpipe pressure signal using a bottom envelope filter. The method can include comparing the acquired standpipe pressure signal to the filtered standpipe pressure signal. The method can include measuring actual differential pressure when a difference between the acquired standpipe pressure signal and the filtered standpipe pressure signal is within a predetermined threshold. The method can include establishing a tare standpipe pressure value when the difference between the acquired standpipe pressure signal and the filtered standpipe pressure signal is within the predetermined threshold. The method can include generating a control input for drilling based on the tare standpipe pressure value.

The method can include determining a pressure measurement in a mud motor using a difference between the actual differential pressure value and a reference pressure value. The method can include determining a torque value applied to a bit using the pressure measurement in the mud motor.

In various embodiments, the method can include determining a time period to measure the differential pressure value when a mud pulse signal is eliminated from the differential pressure measurement.

In various embodiments, the determining the time period is performed using the standpipe pressure measurement and the bottom envelope filter.

In various embodiments, the time period occurs when data filtered standpipe pressure signal is within a predetermined threshold of an actual standpipe pressure indicating that there are minimal mud pulses in the standpipe pressure signal.

In various embodiments, the method can include filtering out mud pulses for communication and while receiving other differential pressure changes for control.

In various embodiments, the method can include zeroing the differential pressure value when sensor obtained mud pressure and the filtered standpipe pressure signal are withing a predetermined threshold of zero.

In an aspect of the disclosure, a system for differential pressure signal determination can include one or more processors configured to perform operations including acquiring a standpipe pressure signal. The operations can include generating a filtered standpipe pressure signal by filtering the standpipe pressure signal using a bottom envelope filter. The operations can include comparing the acquired standpipe pressure signal to the filtered standpipe pressure signal. The operations can include measuring actual differential pressure when a difference between the acquired standpipe pressure signal and the filtered standpipe pressure signal is within a predetermined threshold. The operations can include establishing a tare standpipe pressure value when the difference between the acquired standpipe pressure signal and the filtered standpipe pressure signal is within the predetermined threshold. The operations can include generating a control input for drilling based on the tare standpipe pressure value.

In various embodiments, the operations can include determining a pressure measurement in a mud motor using a difference between the actual differential pressure value and a reference pressure value. The operations can include determining a torque value applied to a bit using the pressure measurement in the mud motor.

In various embodiments, the operations can include determining a time period to measure the differential pressure value when a mud pulse signal is eliminated from the differential pressure measurement.

In various embodiments, the determining the time period is performed using the standpipe pressure measurement and the bottom envelope filter.

In various embodiments, the time period occurs when data filtered standpipe pressure signal is within a predetermined threshold of an actual standpipe pressure indicating that there are minimal mud pulses in the standpipe pressure signal.

In various embodiments, the operations can include filtering out mud pulses for communication and while receiving other differential pressure changes for control.

In various embodiments, the operations can include zeroing the differential pressure value when sensor obtained mud pressure and the filtered standpipe pressure signal are withing a predetermined threshold of zero.

In an aspect of the disclosure, a non-transitory computer-readable medium storing a set of instructions for differential pressure signal determination, the set of instructions when executed by one or more processors of a computing device to perform operations including acquiring a standpipe pressure signal. The operations can include generating a filtered standpipe pressure signal by filtering the standpipe pressure signal using a bottom envelope filter. The operations can include comparing the acquired standpipe pressure signal to the filtered standpipe pressure signal. The operations can include measuring actual differential pressure when a difference between the acquired standpipe pressure signal and the filtered standpipe pressure signal is within a predetermined threshold. The operations can include establishing a tare standpipe pressure value when the difference between the acquired standpipe pressure signal and the filtered standpipe pressure signal is within the predetermined threshold. The operations can include generating a control input for drilling based on the tare standpipe pressure value.

In various embodiments, the operations can include determining a pressure measurement in a mud motor using a difference between the actual differential pressure value and a reference pressure value. The operations can include determining a torque value applied to a bit using the pressure measurement in the mud motor.

In various embodiments, the operations can include determining a time period to measure the differential pressure value when a mud pulse signal is eliminated from the differential pressure measurement.

In various embodiments, the determining the time period is performed using the standpipe pressure measurement and the bottom envelope filter.

In various embodiments, the time period occurs when data filtered standpipe pressure signal is within a predetermined threshold of an actual standpipe pressure indicating that there are minimal mud pulses in the standpipe pressure signal, the operations can include filtering out mud pulses for communication and while receiving other differential pressure changes for control.

In various embodiments, the operations can include zeroing the differential pressure value when sensor obtained mud pressure and the filtered standpipe pressure signal are withing a predetermined threshold of zero.

BRIEF DESCRIPTION OF THE DRAWINGS

For a more complete understanding of the present invention and its features and advantages, reference is now made to the following description, taken in conjunction with the accompanying drawings, in which.

DESCRIPTION OF PARTICULAR EMBODIMENT(S)

Figure 1:
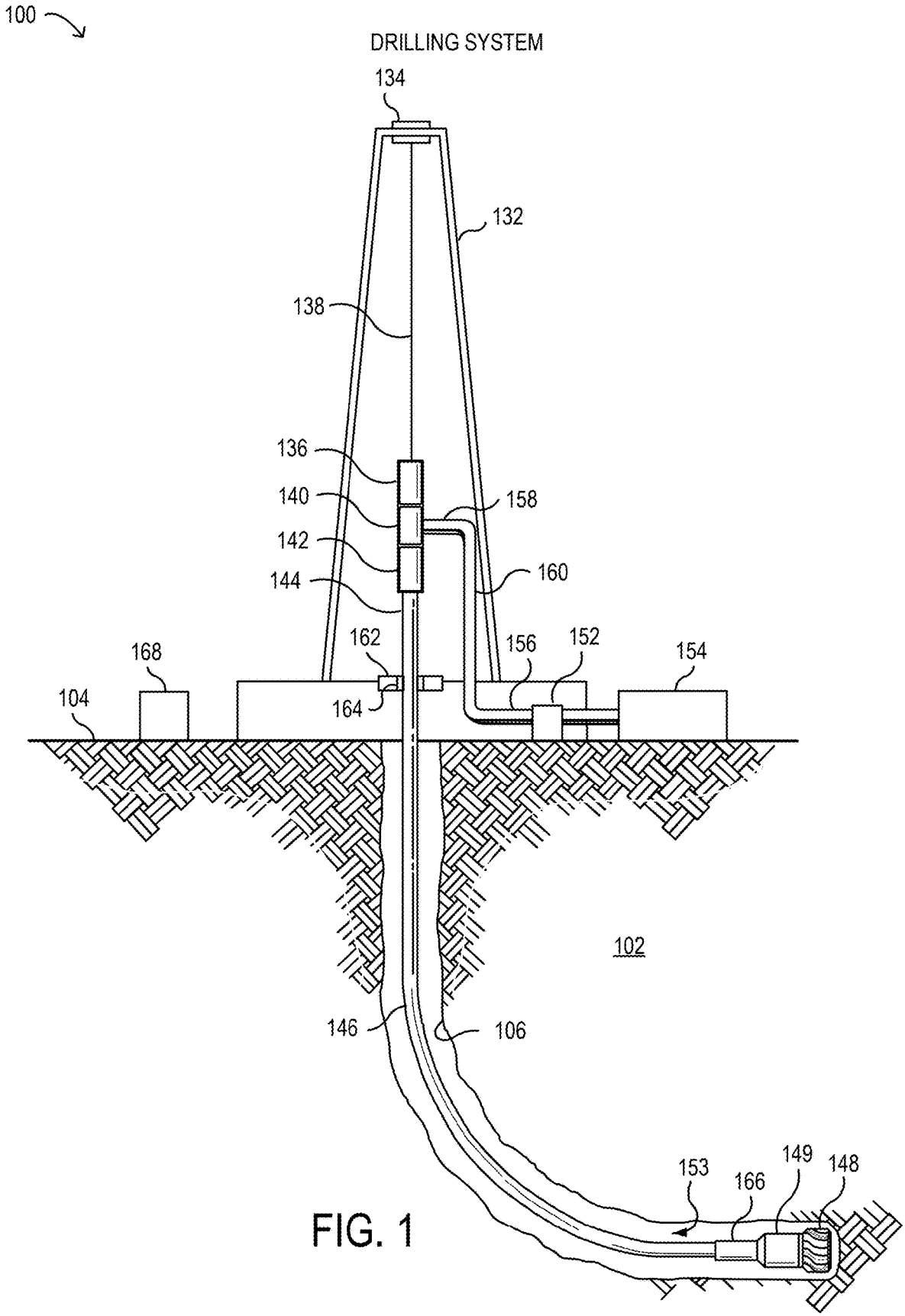
FIG. 1 is a depiction of a drilling system for drilling a borehole.

In the following description, details are set forth by way of example to facilitate discussion of the disclosed subject matter. It should be apparent to a person of ordinary skill in the field, however, that the disclosed embodiments are exemplary and not exhaustive of all possible embodiments.

Throughout this disclosure, a hyphenated form of a reference numeral refers to a specific instance of an element and the un-hyphenated form of the reference numeral refers to the element generically or collectively. Thus, as an example (not shown in the drawings), device "12-1" refers to an instance of a device class, which may be referred to collectively as devices "12" and any one of which may be referred to generically as a device "12". In the figures and the description, like numerals are intended to represent like elements.

Drilling a well typically involves a substantial amount of human decision-making during the drilling process. For example, geologists and drilling engineers use their knowledge, experience, and the available information to make decisions on how to plan the drilling operation, how to accomplish the drilling plan, and how to handle issues that arise during drilling. However, even the best geologists and drilling engineers perform some guesswork due to the unique nature of each borehole. Furthermore, a directional human driller performing the drilling may have drilled other boreholes in the same region and so may have some similar experience. However, during drilling operations, a multitude of input information and other factors may affect a drilling decision being made by a human operator or specialist, such that the amount of information may overwhelm the cognitive ability of the human to properly consider and factor into the drilling decision. Furthermore, the quality or the error involved with the drilling decision may improve with larger amounts of input data being considered, for example, such as formation data from a large number of offset wells. For these reasons, human specialists may be unable to achieve optimal drilling decisions, particularly when such drilling decisions are made under time constraints, such as during drilling operations when continuation of drilling is dependent on the drilling decision and, thus, the entire drilling rig waits idly for the next drilling decision. Furthermore, human decision-making for drilling decisions can result in expensive mistakes because drilling errors can add significant cost to drilling operations. In some cases, drilling errors may permanently lower the output of a well, resulting in substantial long term economic losses due to the lost output of the well.

Referring now to the drawings, Referring to FIG. 1, a drilling system 100 is illustrated in one embodiment as a top drive system. As shown, the drilling system 100 includes a derrick 132 on the surface 104 of the earth and is used to drill a borehole 106 into the earth. Typically, drilling system 100 is used at a location corresponding to a geographic formation 102 in the earth that is known.

In FIG. 1, derrick 132 includes a crown block 134 to which a traveling block 136 is coupled via a drilling line 138. In drilling system 100, a top drive 140 is coupled to traveling block 136 and may provide rotational force for drilling. A saver sub 142 may sit between the top drive 140 and a drill pipe 144 that is part of a drill string 146. Top drive 140 may rotate drill string 146 via the saver sub 142, which in turn may rotate a drill bit 148 of a bottom hole assembly (BHA) 149 in borehole 106 passing through formation 102. Also visible in drilling system 100 is a rotary table 162 that may be fitted with a master bushing 164 to hold drill string 146 when not rotating.

A mud pump 152 may direct a fluid mixture 153 (e.g., a mud mixture) from a mud pit 154 into drill string 146. Mud pit 154 is shown schematically as a container, but it is noted that various receptacles, tanks, pits, or other containers may be used. Mud 153 may flow from mud pump 152 into a discharge line 156 that is coupled to a rotary hose 158 by a standpipe 160. Rotary hose 158 may then be coupled to top drive 140, which includes a passage for mud 153 to flow into borehole 106 via drill string 146 from where mud 153 may emerge at drill bit 148. Mud 153 may lubricate drill bit 148 during drilling and, due to the pressure supplied by mud pump 152, mud 153 may return via borehole 106 to surface 104.

In drilling system 100, drilling equipment (see also FIG. 5) is used to perform the drilling of borehole 106, such as top drive 140 (or rotary drive equipment) that couples to drill string 146 and BHA 149 and is configured to rotate drill string 146 and apply pressure to drill bit 148. Drilling system 100 may include control systems such as a weight-on-bit (WOB)/differential pressure control system 522, a positional/rotary control system 524, a fluid circulation control system 526, and a sensor system 528, as further described below with respect to FIG. 5. The control systems may be used to monitor and change drilling rig settings, such as the WOB or differential pressure to alter the rate of penetration (ROP) or the radial orientation of the tool face, change the flow rate of drilling mud, and perform other operations. Sensor system 528 may be for obtaining sensor data about the drilling operation and drilling system 100, including the downhole equipment. For example, sensor system 528 may include measurement while drilling (MWD) or logging while drilling (LWD) tools for acquiring information, such as tool face and formation logging information, that may be saved for later retrieval, transmitted with or without a delay using any of various communication means (e.g., wireless, wireline, or mud pulse telemetry), or otherwise transferred to steering control system 168. As used herein, an MWD tool is enabled to communicate downhole measurements without substantial delay to the surface 104, such as using mud pulse telemetry, while a LWD tool is equipped with an internal memory that stores measurements when downhole and can be used to download a stored log of measurements when the LWD tool is at the surface 104. The internal memory in the LWD tool may be a removable memory, such as a universal serial bus (USB) memory device or another removable memory device. It is noted that certain downhole tools may have both MWD and LWD capabilities. Such information acquired by sensor system 528 may include information related to hole depth, bit depth, inclination angle, azimuth angle, true vertical depth, gamma count, standpipe pressure, mud flow rate, rotary rotations per minute (RPM), bit speed, ROP, WOB, among other information. It is noted that all or part of sensor system 528 may be incorporated into a control system, or in another component of the drilling equipment. As drilling system 100 can be configured in many different implementations, it is noted that different control systems and subsystems may be used.

Sensing, detection, measurement, evaluation, storage, alarm, and other functionality may be incorporated into a downhole tool 166 or BHA 149 or elsewhere along drill string 146 to provide downhole surveys of borehole 106. Accordingly, downhole tool 166 may be an MWD tool or a LWD tool or both, and may accordingly utilize connectivity to the surface 104, local storage, or both. In different implementations, gamma radiation sensors, magnetometers, accelerometers, and other types of sensors may be used for the downhole surveys. Although downhole tool 166 is shown in singular in drilling system 100, it is noted that multiple instances (not shown) of downhole tool 166 may be located at one or more locations along drill string 146.

In some embodiments, formation detection and evaluation functionality may be provided via a steering control system 168 on the surface 104. Steering control system 168 may be located in proximity to derrick 132 or may be included with drilling system 100. In other embodiments, steering control system 168 may be remote from the actual location of borehole 106 (see also FIG. 4). For example, steering control system 168 may be a stand-alone system or may be incorporated into other systems included with drilling system 100.

In operation, steering control system 168 may be accessible via a communication network (see also FIG. 10) and may accordingly receive formation information via the communication network. In some embodiments, steering control system 168 may use the evaluation functionality to provide corrective measures, such as a convergence plan to overcome an error in the well trajectory of borehole 106 with respect to a reference, or a planned well trajectory. The convergence plans or other corrective measures may depend on a determination of the well trajectory, and therefore, may be improved in accuracy using surface steering, as disclosed herein.

In particular embodiments, at least a portion of steering control system 168 may be located in downhole tool 166 (not shown). In some embodiments, steering control system 168 may communicate with a separate controller (not shown) located in downhole tool 166. In particular, steering control system 168 may receive and process measurements received from downhole surveys and may perform the calculations described herein for surface steering using the downhole surveys and other information referenced herein.

In drilling system 100, to aid in the drilling process, data is collected from borehole 106, such as from sensors in BHA 149, downhole tool 166, or both. The collected data may include the geological characteristics of formation 102 in which borehole 106 was formed, the attributes of drilling system 100, including BHA 149, and drilling information such as weight-on-bit (WOB), drilling speed, and other information pertinent to the formation of borehole 106. The drilling information may be associated with a particular depth or another identifiable marker to index collected data. For example, the collected data for borehole 106 may capture drilling information indicating that drilling of the well from 1,000 feet to 1,200 feet occurred at a first rate of penetration (ROP) through a first rock layer with a first WOB, while drilling from 1,200 feet to 1,500 feet occurred at a second ROP through a second rock layer with a second WOB (see also FIG. 2). In some applications, the collected data may be used to virtually recreate the drilling process that created borehole 106 in formation 102, such as by displaying a computer simulation of the drilling process. The accuracy with which the drilling process can be recreated depends on a level of detail and accuracy of the collected data, including collected data from a downhole survey of the well trajectory.

The collected data may be stored in a database that is accessible via a communication network for example. In some embodiments, the database storing the collected data for borehole 106 may be located locally at drilling system 100, at a drilling hub that supports a plurality of drilling systems 100 in a region, or at a database server accessible over the communication network that provides access to the database (see also FIG. 4). At drilling system 100, the collected data may be stored at the surface 104 or downhole in drill string 146, such as in a memory device included with BHA 149 (see also FIG. 10). Alternatively, at least a portion of the collected data may be stored on a removable storage medium, such as using steering control system 168 or BHA 149, that is later coupled to the database in order to transfer the collected data to the database, which may be manually performed at certain intervals, for example.

In FIG. 1, steering control system 168 is located at or near the surface 104 where borehole 106 is being drilled. Steering control system 168 may be coupled to equipment used in drilling system 100 and may also be coupled to the database, whether the database is physically located locally, regionally, or centrally (see also FIGS. 4 and 5). Accordingly, steering control system 168 may collect and record various inputs, such as measurement data from a magnetometer and an accelerometer that may also be included with BHA 149.

Steering control system 168 may further be used as a surface steerable system, along with the database, as described above. The surface steerable system may enable an operator to plan and control drilling operations while drilling is being performed. The surface steerable system may itself also be used to perform certain drilling operations, such as controlling certain control systems that, in turn, control the actual equipment in drilling system 100 (see also FIG. 5). The control of drilling equipment and drilling operations by steering control system 168 may be manual, manual-assisted, semi-automatic, or automatic, in different embodiments.

Manual control may involve direct control of the drilling rig equipment, albeit with certain safety limits to prevent unsafe or undesired actions or collisions of different equipment. To enable manual-assisted control, steering control system 168 may present various information, such as using a graphical user interface (GUI) displayed on a display device (see FIG. 8), to a human operator, and may provide controls that enable the human operator to perform a control operation. The information presented to the user may include live measurements and feedback from the drilling rig and steering control system 168, or the drilling rig itself, and may further include limits and safety-related elements to prevent unwanted actions or equipment states, in response to a manual control command entered by the user using the GUI.

To implement semi-automatic control, steering control system 168 may itself propose or indicate to the user, such as via the GUI, that a certain control operation, or a sequence of control operations, should be performed at a given time. Then, steering control system 168 may enable the user to imitate the indicated control operation or sequence of control operations, such that once manually started, the indicated control operation or sequence of control operations is automatically completed. The limits and safety features mentioned above for manual control would still apply for semi-automatic control. It is noted that steering control system 168 may execute semi-automatic control using a secondary processor, such as an embedded controller that executes under a real-time operating system (RTOS), that is under the control and command of steering control system 168. To implement automatic control, the step of manual starting the indicated control operation or sequence of operations is eliminated, and steering control system 168 may proceed with only a passive notification to the user of the actions taken.

In order to implement various control operations, steering control system 168 may perform (or may cause to be performed) various input operations, processing operations, and output operations. The input operations performed by steering control system 168 may result in measurements or other input information being made available for use in any subsequent operations, such as processing or output operations. The input operations may accordingly provide the input information, including feedback from the drilling process itself, to steering control system 168. The processing operations performed by steering control system 168 may be any processing operation associated with surface steering, as disclosed herein. The output operations performed by steering control system 168 may involve generating output information for use by external entities, or for output to a user, such as in the form of updated elements in the GUI, for example. The output information may include at least some of the input information, enabling steering control system 168 to distribute information among various entities and processors.

In particular, the operations performed by steering control system 168 may include operations such as receiving drilling data representing a drill path, receiving other drilling parameters, calculating a drilling solution for the drill path based on the received data and other available data (e.g., rig characteristics), implementing the drilling solution at the drilling rig, monitoring the drilling process to gauge whether the drilling process is within a defined margin of error of the drill path, and calculating corrections for the drilling process if the drilling process is outside of the margin of error.

Accordingly, steering control system 168 may receive input information either before drilling, during drilling, or after drilling of borehole 106. The input information may comprise measurements from one or more sensors, as well as survey information collected while drilling borehole 106. The input information may also include a well plan, a regional formation history, drilling engineer parameters, downhole tool face/inclination information, downhole tool gamma/resistivity information, economic parameters, reliability parameters, among various other parameters. Some of the input information, such as the regional formation history, may be available from a drilling hub 410, which may have respective access to a regional drilling database (DB) 412 (see FIG. 4). Other input information may be accessed or uploaded from other sources to steering control system 168. For example, a web interface may be used to interact directly with steering control system 168 to upload the well plan or drilling parameters.

As noted, the input information may be provided to steering control system 168. After processing by steering control system 168, steering control system 168 may generate control information that may be output to drilling rig 210 (e.g., to rig controls 520 that control drilling equipment 530, see also FIGS. 2 and 5). Drilling rig 210 may provide feedback information using rig controls 520 to steering control system 168. The feedback information may then serve as input information to steering control system 168, thereby enabling steering control system 168 to perform feedback loop control and validation. Accordingly, steering control system 168 may be configured to modify its output information to the drilling rig, in order to achieve the desired results, which are indicated in the feedback information. The output information generated by steering control system 168 may include indications to modify one or more drilling parameters, the direction of drilling, the drilling mode, among others. In certain operational modes, such as semi-automatic or automatic, steering control system 168 may generate output information indicative of instructions to rig controls 520 to enable automatic drilling using the latest location of BHA 149. Therefore, an improved accuracy in the determination of the location of BHA 149 may be provided using steering control system 168, along with the methods and operations for surface steering disclosed herein.

Figure 2:
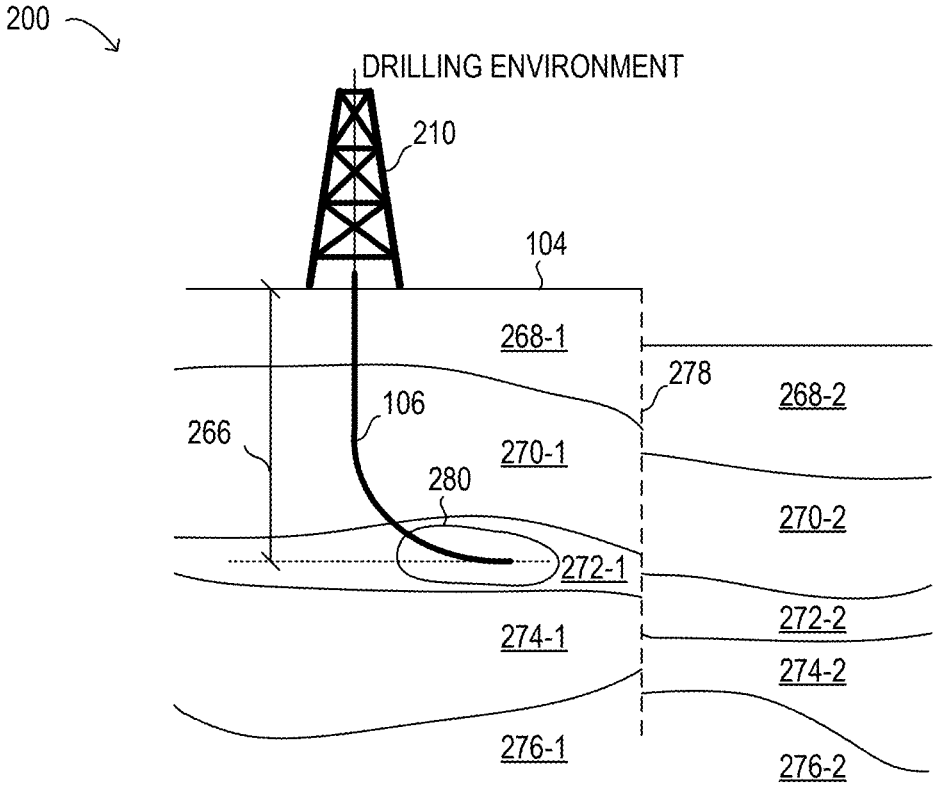
FIG. 2 is a depiction of a drilling environment including the drilling system for drilling a borehole.

Referring now to FIG. 2, a drilling environment 200 is depicted schematically and is not drawn to scale or perspective. In particular, drilling environment 200 may illustrate additional details with respect to formation 102 below the surface 104 in drilling system 100 shown in FIG. 1. In FIG. 2, drilling rig 210 may represent various equipment discussed above with respect to drilling system 100 in FIG. 1 that is located at the surface 104.

In drilling environment 200, it may be assumed that a drilling plan (also referred to as a well plan) has been formulated to drill borehole 106 extending into the ground to a true vertical depth (TVD) 266 and penetrating several subterranean strata layers. Borehole 106 is shown in FIG. 2 extending through strata layers 268-1 and 270-1, while terminating in strata layer 272-1. Accordingly, as shown, borehole 106 does not extend or reach underlying strata layers 274-1 and 276-1. A target area 280 specified in the drilling plan may be located in strata layer 272-1 as shown in FIG. 2. Target area 280 may represent a desired endpoint of borehole 106, such as a hydrocarbon producing area indicated by strata layer 272-1. It is noted that target area 280 may be of any shape and size and may be defined using various different methods and information in different embodiments. In some instances, target area 280 may be specified in the drilling plan using subsurface coordinates, or references to certain markers, which indicate where borehole 106 is to be terminated. In other instances, target area may be specified in the drilling plan using a depth range within which borehole 106 is to remain. For example, the depth range may correspond to strata layer 272-1. In other examples, target area 280 may extend as far as can be realistically drilled. For example, when borehole 106 is specified to have a horizontal section with a goal to extend into strata layer 172 as far as possible, target area 280 may be defined as strata layer 272-1 itself and drilling may continue until some other physical limit is reached, such as a property boundary or a physical limitation to the length of the drill string.

Also visible in FIG. 2 is a fault line 278 that has resulted in a subterranean discontinuity in the fault structure. Specifically, strata layers 268, 270, 272, 274, and 276 have portions on either side of fault line 278. On one side of fault line 278, where borehole 106 is located, strata layers 268-1, 270-1, 272-1, 274-1, and 276-1 are unshifted by fault line 278. On the other side of fault line 278, strata layers 268-2, 270-3, 272-3, 274-3, and 276-3 are shifted downwards by fault line 278.

Current drilling operations frequently include directional drilling to reach a target, such as target area 280. The use of directional drilling has been found to generally increase an overall amount of production volume per well, but also may lead to significantly higher production rates per well, which are both economically desirable. As shown in FIG. 2, directional drilling may be used to drill the horizontal portion of borehole 106, which increases an exposed length of borehole 106 within strata layer 272-1, and which may accordingly be beneficial for hydrocarbon extraction from strata layer 272-1. Directional drilling may also be used alter an angle of borehole 106 to accommodate subterranean faults, such as indicated by fault line 278 in FIG. 2. Other benefits that may be achieved using directional drilling include sidetracking off of an existing well to reach a different target area or a missed target area, drilling around abandoned drilling equipment, drilling into otherwise inaccessible or difficult to reach locations (e.g., under populated areas or bodies of water), providing a relief well for an existing well, and increasing the capacity of a well by branching off and having multiple boreholes extending in different directions or at different vertical positions for the same well. Directional drilling is often not limited to a straight horizontal borehole 106 but may involve staying within a strata layer that varies in depth and thickness as illustrated by strata layer 172. As such, directional drilling may involve multiple vertical adjustments that complicate the trajectory of borehole 106.

Figure 3:
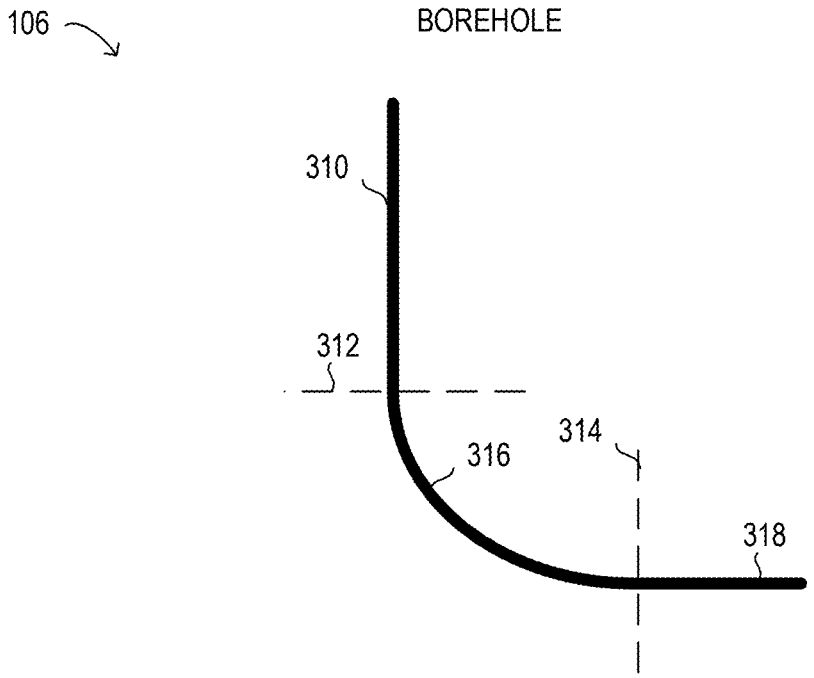
FIG. 3 is a depiction of a borehole generated in the drilling environment.

Referring now to FIG. 3, one embodiment of a portion of borehole 106 is shown in further detail. Using directional drilling for horizontal drilling may introduce certain challenges or difficulties that may not be observed during vertical drilling of borehole 106. For example, a horizontal portion 318 of borehole 106 may be started from a vertical portion 310. In order to make the transition from vertical to horizontal, a curve may be defined that specifies a so-called "build up" section 316. Build up section 316 may begin at a kickoff point 312 in vertical portion 310 and may end at a begin point 314 of horizontal portion 318. The change in inclination in buildup section 316 per measured length drilled is referred to herein as a "build rate" and may be defined in degrees per one hundred feet drilled. For example, the build rate may have a value of 6°/100 ft., indicating that there is a six degree change in inclination for every one hundred feet drilled. The build rate for a particular build up section may remain relatively constant or may vary.

The build rate used for any given build up section may depend on various factors, such as properties of the formation (i.e., strata layers) through which borehole 106 is to be drilled, the trajectory of borehole 106, the particular pipe and drill collars/BHA components used (e.g., length, diameter, flexibility, strength, mud motor bend setting, and drill bit), the mud type and flow rate, the specified horizontal displacement, stabilization, and inclination, among other factors. An overly aggressive built rate can cause problems such as severe doglegs (e.g., sharp changes in direction in the borehole) that may make it difficult or impossible to run casing or perform other operations in borehole 106. Depending on the severity of any mistakes made during directional drilling, borehole 106 may be enlarged or drill bit 146 may be backed out of a portion of borehole 106 and redrilled along a different path. Such mistakes may be undesirable due to the additional time and expense involved. However, if the built rate is too cautious, additional overall time may be added to the drilling process because directional drilling generally involves a lower ROP than straight drilling. Furthermore, directional drilling for a curve is more complicated than vertical drilling and the possibility of drilling errors increases with directional drilling (e.g., overshoot and undershoot that may occur while trying to keep drill bit 148 on the planned trajectory).

Two modes of drilling, referred to herein as "rotating" and "sliding", are commonly used to form borehole 106. Rotating, also called "rotary drilling," uses top drive 140 or rotary table 162 to rotate drill string 146. Rotating may be used when drilling occurs along a straight trajectory, such as for vertical portion 310 of borehole 106. Sliding, also called "steering" or "directional drilling" as noted above, typically uses a mud motor located downhole at BHA 149. The mud motor may have an adjustable bent housing and is not powered by rotation of the drill string. Instead, the mud motor uses hydraulic power derived from the pressurized drilling mud that circulates along borehole 106 to and from the surface 104 to directionally drill borehole 106 in buildup section 316.

Thus, sliding is used in order to control the direction of the well trajectory during directional drilling. A method to perform a slide may include the following operations. First, during vertical or straight drilling, the rotation of drill string 146 is stopped. Based on feedback from measuring equipment, such as from downhole tool 166, adjustments may be made to drill string 146, such as using top drive 140 to apply various combinations of torque, WOB, and vibration, among other adjustments. The adjustments may continue until a tool face is confirmed that indicates a direction of the bend of the mud motor is oriented to a direction of a desired deviation (i.e., build rate) of borehole 106. Once the desired orientation of the mud motor is attained, WOB to the drill bit is increased, which causes the drill bit to move in the desired direction of deviation. Once sufficient distance and angle have been built up in the curved trajectory, a transition back to rotating mode can be accomplished by rotating the drill string again. The rotation of the drill string after sliding may neutralize the directional deviation caused by the bend in the mud motor due to the continuous rotation around a centerline of borehole 106.

Figure 4:
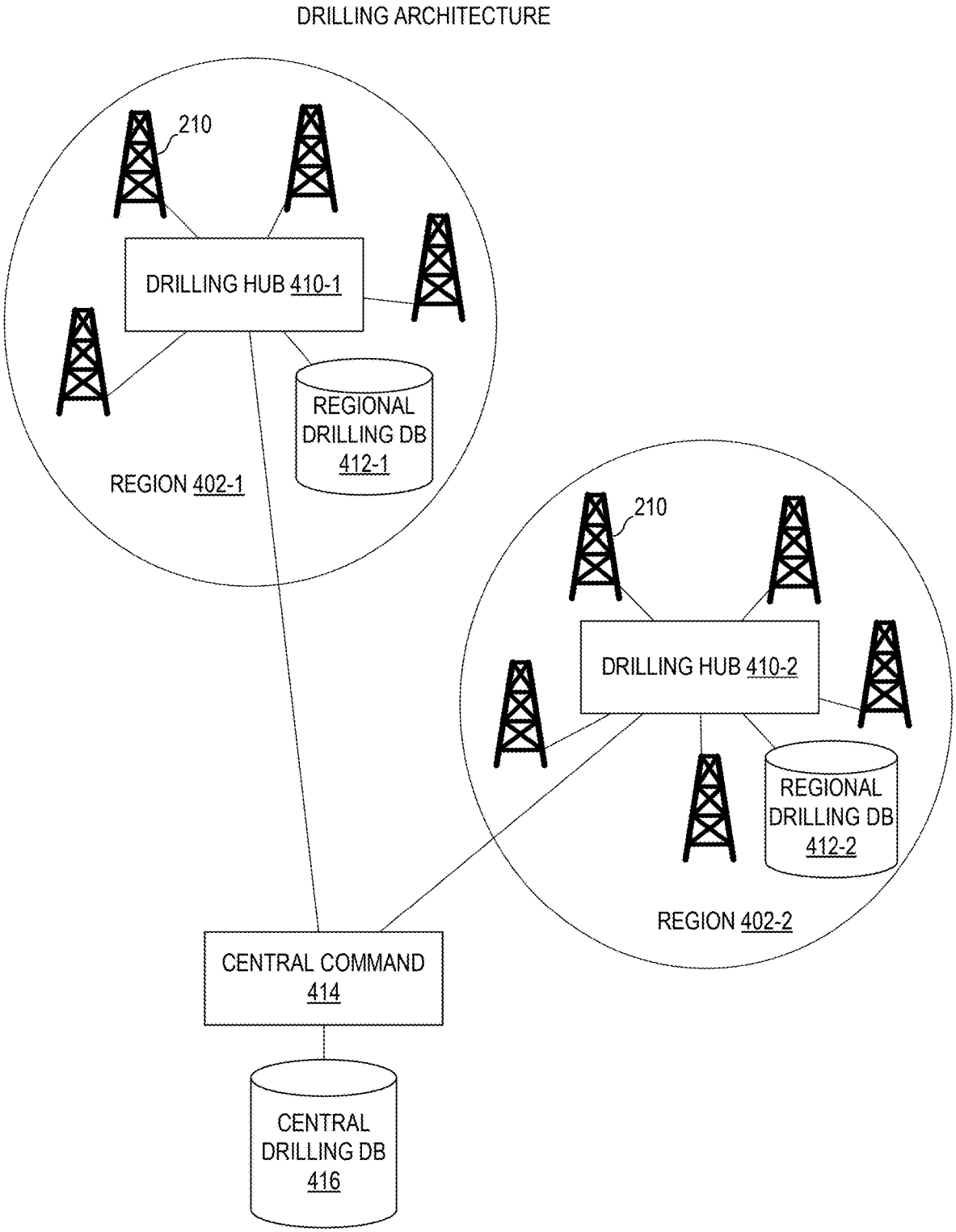
FIG. 4 is a depiction of a drilling architecture including the drilling environment.

Referring now to FIG. 4, a drilling architecture 400 is illustrated in diagram form. As shown, drilling architecture 400 depicts a hierarchical arrangement of drilling hubs 410 and a central command 414, to support the operation of a plurality of drilling rigs 210 in different regions 402. Specifically, as described above with respect to FIGS. 1 and 2, drilling rig 210 includes steering control system 168 that is enabled to perform various drilling control operations locally to drilling rig 210. When steering control system 168 is enabled with network connectivity, certain control operations or processing may be requested or queried by steering control system 168 from a remote processing resource. As shown in FIG. 4, drilling hubs 410 represent a remote processing resource for steering control system 168 located at respective regions 402, while central command 414 may represent a remote processing resource for both drilling hub 410 and steering control system 168.

Specifically, in a region 401-1, a drilling hub 410-1 may serve as a remote processing resource for drilling rigs 210 located in region 401-1, which may vary in number and are not limited to the exemplary schematic illustration of FIG. 4. Additionally, drilling hub 410-1 may have access to a regional drilling DB 412-1, which may be local to drilling hub 410-1. Additionally, in a region 401-2, a drilling hub 410-2 may serve as a remote processing resource for drilling rigs 210 located in region 401-2, which may vary in number and are not limited to the exemplary schematic illustration of FIG. 4. Additionally, drilling hub 410-2 may have access to a regional drilling DB 412-2, which may be local to drilling hub 410-2.

In FIG. 4, respective regions 402 may exhibit the same or similar geological formations. Thus, reference wells, or offset wells, may exist in a vicinity of a given drilling rig 210 in region 402, or where a new well is planned in region 402. Furthermore, multiple drilling rigs 210 may be actively drilling concurrently in region 402 and may be in different stages of drilling through the depths of formation strata layers at region 402. Thus, for any given well being drilled by drilling rig 210 in a region 402, survey data from the reference wells or offset wells may be used to create the well plan, and may be used for surface steering, as disclosed herein. In some implementations, survey data or reference data from a plurality of reference wells may be used to improve drilling performance, such as by reducing an error in estimating TVD or a position of BHA 149 relative to one or more strata layers, as will be described in further detail herein. Additionally, survey data from recently drilled wells, or wells still currently being drilled, including the same well, may be used for reducing an error in estimating TVD or a position of BHA 149 relative to one or more strata layers.

Also shown in FIG. 4 is central command 414, which has access to central drilling DB 416, and may be located at a centralized command center that is in communication with drilling hubs 410 and drilling rigs 210 in various regions 402. The centralized command center may have the ability to monitor drilling and equipment activity at any one or more drilling rigs 210. In some embodiments, central command 414 and drilling hubs 412 may be operated by a commercial operator of drilling rigs 210 as a service to customers who have hired the commercial operator to drill wells and provide other drilling-related services.

In FIG. 4, it is particularly noted that central drilling DB 416 may be a central repository that is accessible to drilling hubs 410 and drilling rigs 210. Accordingly, central drilling DB 416 may store information for various drilling rigs 210 in different regions 402. In some embodiments, central drilling DB 416 may serve as a backup for at least one regional drilling DB 412 or may otherwise redundantly store information that is also stored on at least one regional drilling DB 412. In turn, regional drilling DB 412 may serve as a backup or redundant storage for at least one drilling rig 210 in region 402. For example, regional drilling DB 412 may store information collected by steering control system 168 from drilling rig 210.

In some embodiments, the formulation of a drilling plan for drilling rig 210 may include processing and analyzing the collected data in regional drilling DB 412 to create a more effective drilling plan. Furthermore, once the drilling has begun, the collected data may be used in conjunction with current data from drilling rig 210 to improve drilling decisions. As noted, the functionality of steering control system 168 may be provided at drilling rig 210, or may be provided, at least in part, at a remote processing resource, such as drilling hub 410 or central command 414.

As noted, steering control system 168 may provide functionality as a surface steerable system for controlling drilling rig 210. Steering control system 168 may have access to regional drilling DB 412 and central drilling DB 416 to provide the surface steerable system functionality. As will be described in greater detail below, steering control system 168 may be used to plan and control drilling operations based on input information, including feedback from the drilling process itself. Steering control system 168 may be used to perform operations such as receiving drilling data representing a drill trajectory and other drilling parameters, calculating a drilling solution for the drill trajectory based on the received data and other available data (e.g., rig characteristics), implementing the drilling solution at drilling rig 210, monitoring the drilling process to gauge whether the drilling process is within a margin of error that is defined for the drill trajectory, or calculating corrections for the drilling process if the drilling process is outside of the margin of error.

Figure 5:
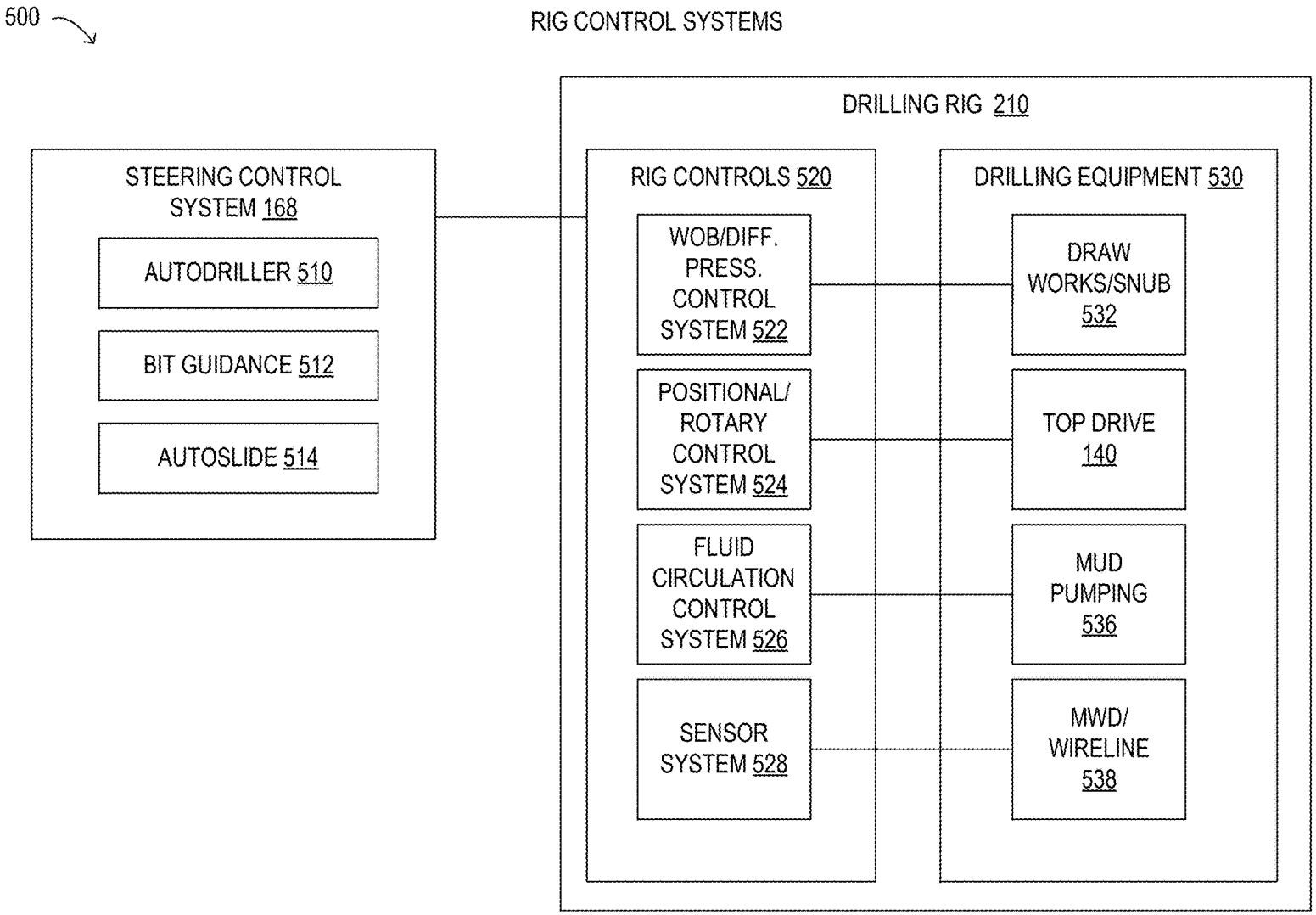
FIG. 5 is a depiction of rig control systems included in the drilling system.

Referring now to FIG. 5, an example of rig control systems 500 is illustrated in schematic form. It is noted that rig control systems 500 may include fewer or more elements than shown in FIG. 5 in different embodiments. As shown, rig control systems 500 includes steering control system 168 and drilling rig 210. Specifically, steering control system 168 is shown with logical functionality including an autodriller 510, a bit guidance 512, and an autoslide system 514. Drilling rig 210 is hierarchically shown including rig controls 520, which provide secure control logic and processing capability, along with drilling equipment 530, which represents the physical equipment used for drilling at drilling rig 210. As shown, rig controls 520 include WOB/differential pressure control system 522, positional/rotary control system 524, fluid circulation control system 526, and sensor system 528, while drilling equipment 530 includes a draw works/snub 532, top drive 140, a mud pumping 536, and an MWD/wireline 538.

Figure 10:
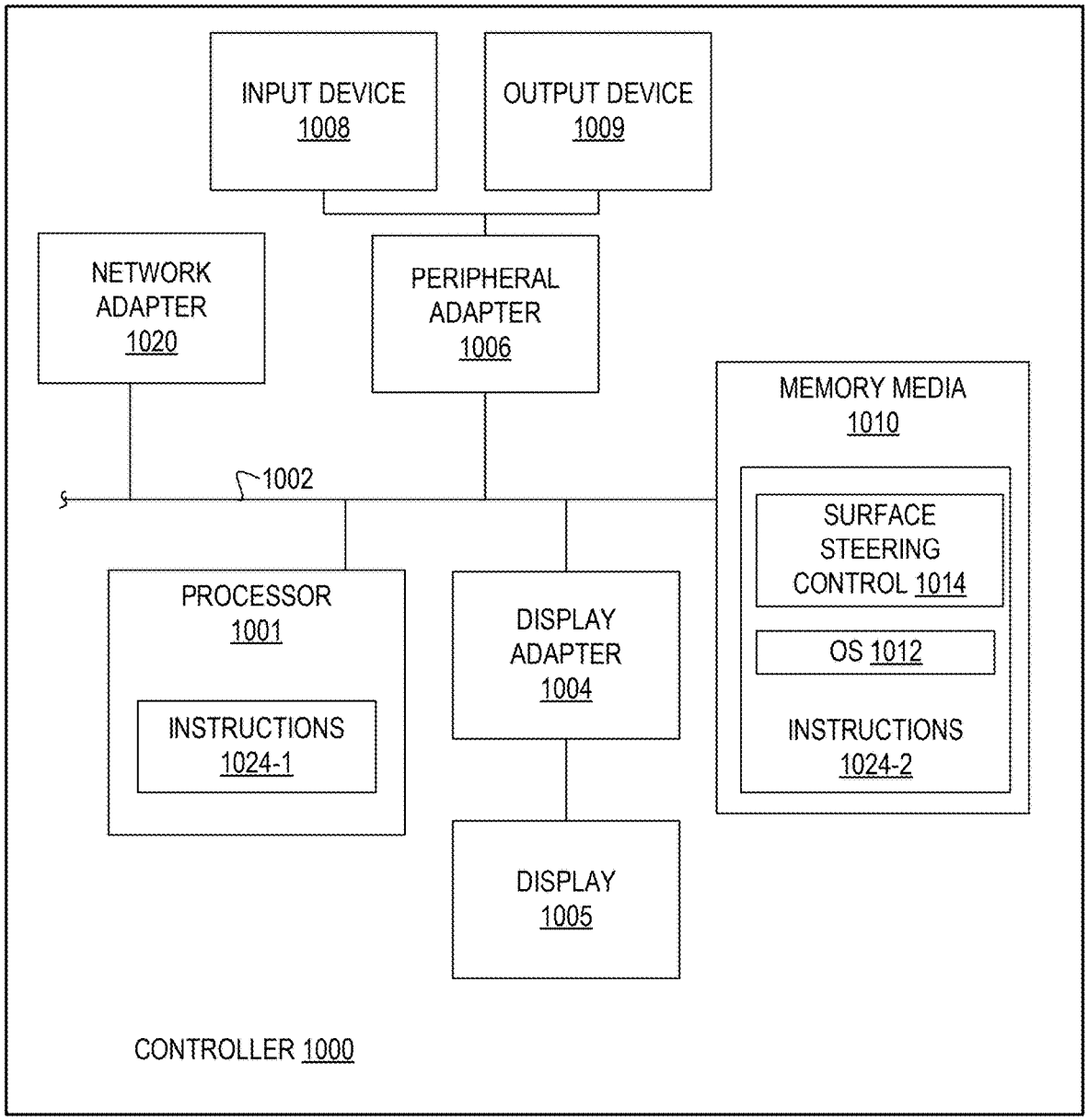
FIG. 10 is a depiction of a controller usable by the rig control systems.

Steering control system 168 represent an instance of a processor having an accessible memory storing instructions executable by the processor, such as an instance of controller 1000 shown in FIG. 10. Also, WOB/differential pressure control system 522, positional/rotary control system 524, and fluid circulation control system 526 may each represent an instance of a processor having an accessible memory storing instructions executable by the processor, such as an instance of controller 1000 shown in FIG. 10, but for example, in a configuration as a programmable logic controller (PLC) that may not include a user interface but may be used as an embedded controller. Accordingly, it is noted that each of the systems included in rig controls 520 may be a separate controller, such as a PLC, and may autonomously operate, at least to a degree. Steering control system 168 may represent hardware that executes instructions to implement a surface steerable system that provides feedback and automation capability to an operator, such as a driller. For example, steering control system 168 may cause autodriller 510, bit guidance 512 (also referred to as a bit guidance system (BGS)), and autoslide system 514 (among others, not shown) to be activated and executed at an appropriate time during drilling. In particular implementations, steering control system 168 may be enabled to provide a user interface during drilling, such as the user interface 850 depicted and described below with respect to FIG. 8. Accordingly, steering control system 168 may interface with rig controls 520 to facilitate manual, assisted manual, semi-automatic, and automatic operation of drilling equipment 530 included in drilling rig 210. It is noted that rig controls 520 may also accordingly be enabled for manual or user-controlled operation of drilling and may include certain levels of automation with respect to drilling equipment 530.

In rig control systems 500 of FIG. 5, WOB/differential pressure control system 522 may be interfaced with draw works/snubbing unit 532 to control WOB of drill string 146. Positional/rotary control system 524 may be interfaced with top drive 140 to control rotation of drill string 146. Fluid circulation control system 526 may be interfaced with mud pumping 536 to control mud flow and may also receive and decode mud telemetry signals. Sensor system 528 may be interfaced with MWD/wireline 538, which may represent various BHA sensors and instrumentation equipment, among other sensors that may be downhole or at the surface.

In rig control systems 500, autodriller 510 may represent an automated rotary drilling system and may be used for controlling rotary drilling. Accordingly, autodriller 510 may enable automate operation of rig controls 520 during rotary drilling, as indicated in the well plan. Bit guidance 512 may represent an automated control system to monitor and control performance and operation drilling bit 148.

In rig control systems 500, autoslide system 514 may represent an automated slide drilling system and may be used for controlling slide drilling. Accordingly, autoslide system 514 may enable automate operation of rig controls 520 during a slide and may return control to steering control system 168 for rotary drilling at an appropriate time, as indicated in the well plan. In particular implementations, autoslide system 514 may be enabled to provide a user interface during slide drilling to specifically monitor and control the slide. For example, autoslide system 514 may rely on bit guidance 512 for orienting a tool face and on autodriller 510 to set WOB or control rotation or vibration of drill string 146.

Figure 6:
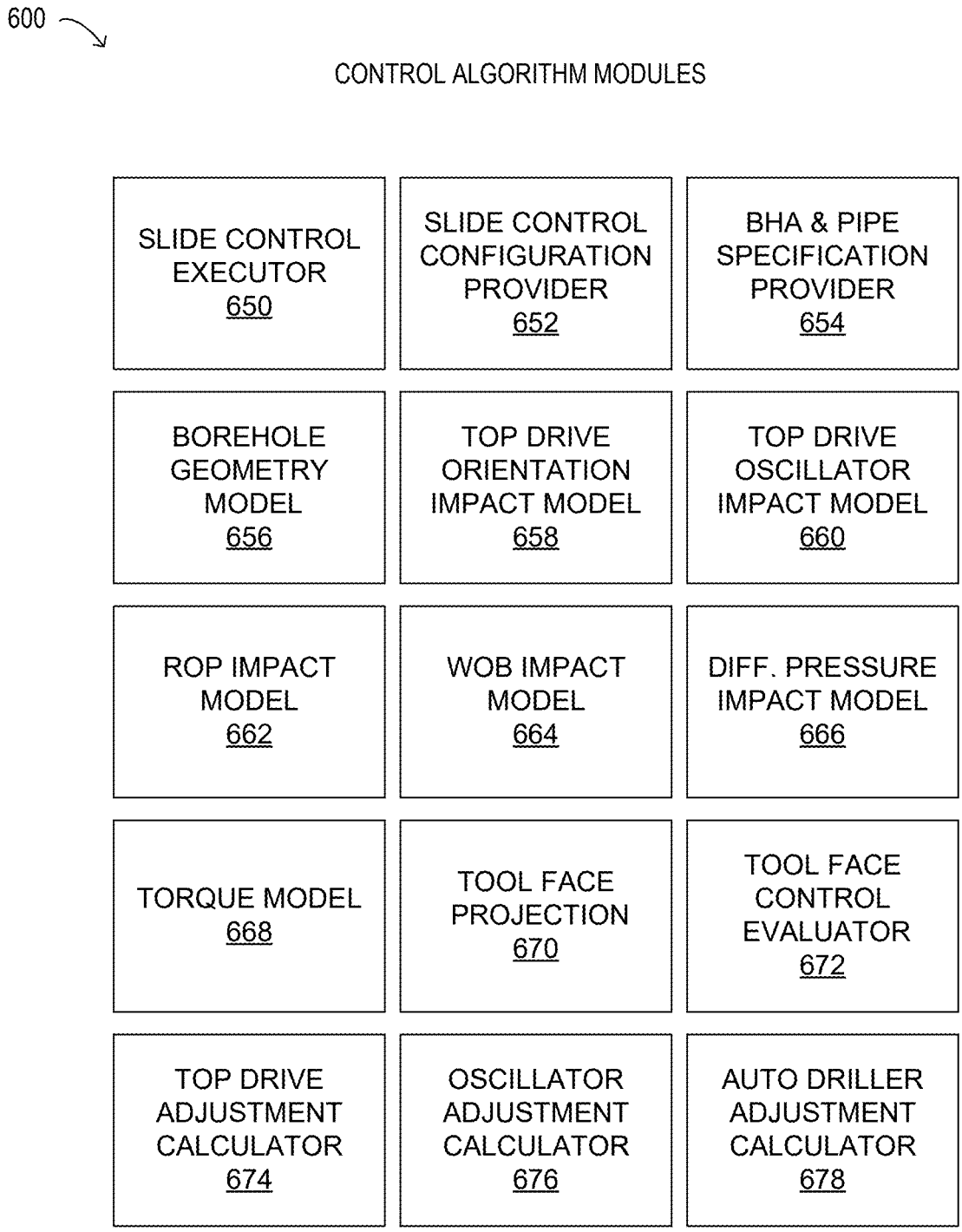
FIG. 6 is a depiction of algorithm modules used by the rig control systems.

FIG. 6 illustrates one embodiment of control algorithm modules 600 used with steering control system 168. The control algorithm modules 600 of FIG. 6 include: a slide control executor 650 that is responsible for managing the execution of the slide control algorithms; a slide control configuration provider 652 that is responsible for validating, maintaining, and providing configuration parameters for the other software modules; a BHA & pipe specification provider 654 that is responsible for managing and providing details of BHA 149 and drill string 146 characteristics; a borehole geometry model 656 that is responsible for keeping track of the borehole geometry and providing a representation to other software modules; a top drive orientation impact model 658 that is responsible for modeling the impact that changes to the angular orientation of top drive 140 have had on the tool face control; a top drive oscillator impact model 660 that is responsible for modeling the impact that oscillations of top drive 140 has had on the tool face control; an ROP impact model 662 that is responsible for modeling the effect on the tool face control of a change in ROP or a corresponding ROP set point; a WOB impact model 664 that is responsible for modeling the effect on the tool face control of a change in WOB or a corresponding WOB set point; a differential pressure impact model 666 that is responsible for modeling the effect on the tool face control of a change in differential pressure (DP) or a corresponding DP set point; a torque model 668 that is responsible for modeling the comprehensive representation of torque for surface, downhole, break over, and reactive torque, modeling impact of those torque values on tool face control, and determining torque operational thresholds; a tool face control evaluator 672 that is responsible for evaluating all factors impacting tool face control and whether adjustments need to be projected, determining whether re-alignment off-bottom is indicated, and determining off-bottom tool face operational threshold windows; a tool face projection 670 that is responsible for projecting tool face behavior for top drive 140, the top drive oscillator, and auto driller adjustments; a top drive adjustment calculator 674 that is responsible for calculating top drive adjustments resultant to tool face projections; an oscillator adjustment calculator 676 that is responsible for calculating oscillator adjustments resultant to tool face projections; and an autodriller adjustment calculator 678 that is responsible for calculating adjustments to autodriller 510 resultant to tool face projections.

Figure 7:
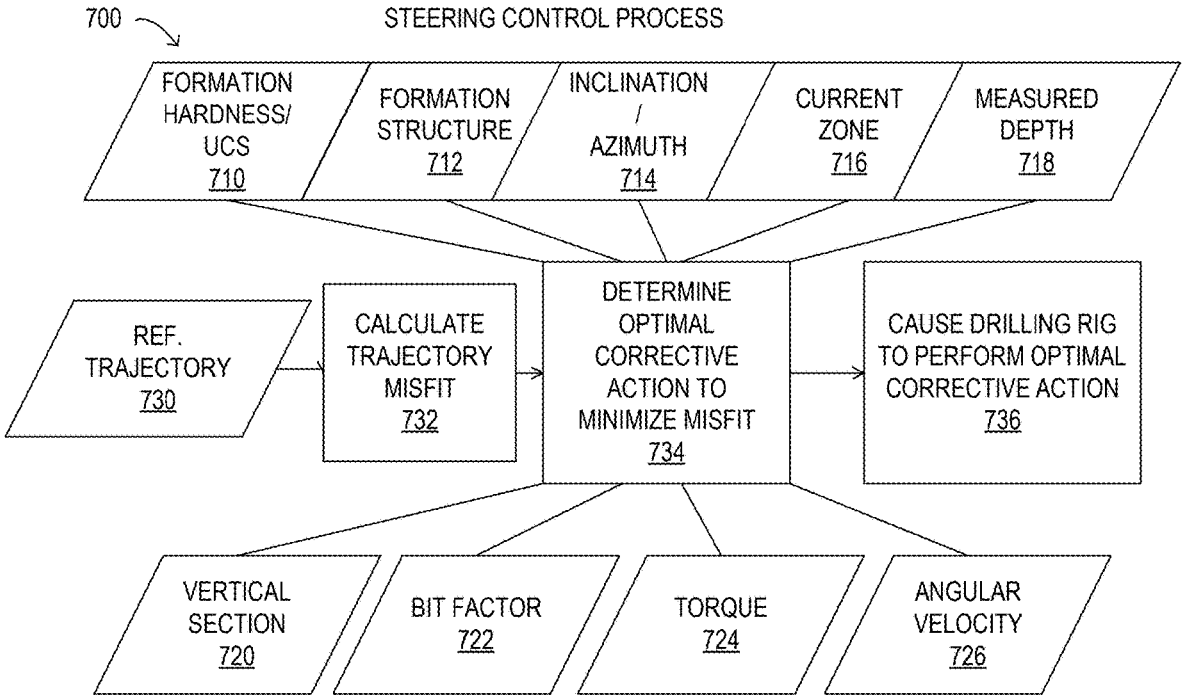
FIG. 7 is a depiction of a steering control process used by the rig control systems.

FIG. 7 illustrates one embodiment of a steering control process 700 for determining an optimal corrective action for drilling. Steering control process 700 may be used for rotary drilling or slide drilling in different embodiments.

Steering control process 700 in FIG. 7 illustrates a variety of inputs that can be used to determine an optimum corrective action. As shown in FIG. 7, the inputs include formation hardness/unconfined compressive strength (UCS) 710, formation structure 712, inclination/azimuth 714, current zone 716, measured depth 718, desired tool face 730, vertical section 720, bit factor 722, mud motor torque 724, reference trajectory 730, vertical section 720, bit factor 722, torque 724 and angular velocity 726. In FIG. 7, reference trajectory 730 of borehole 106 is determined to calculate a trajectory misfit in a step 732. Step 732 may output the trajectory misfit to determine an optimal corrective action to minimize the misfit at step 734, which may be performed using the other inputs described above. Then, at step 736, the drilling rig is caused to perform the optimal corrective action.

It is noted that in some implementations, at least certain portions of steering control process 700 may be automated or performed without user intervention, such as using rig control systems 700 (see FIG. 7). In other implementations, the optimal corrective action in step 736 may be provided or communicated (by display, SMS message, email, or otherwise) to one or more human operators, who may then take appropriate action. The human operators may be members of a rig crew, which may be located at or near drilling rig 210 or may be located remotely from drilling rig 210.

Figure 8:
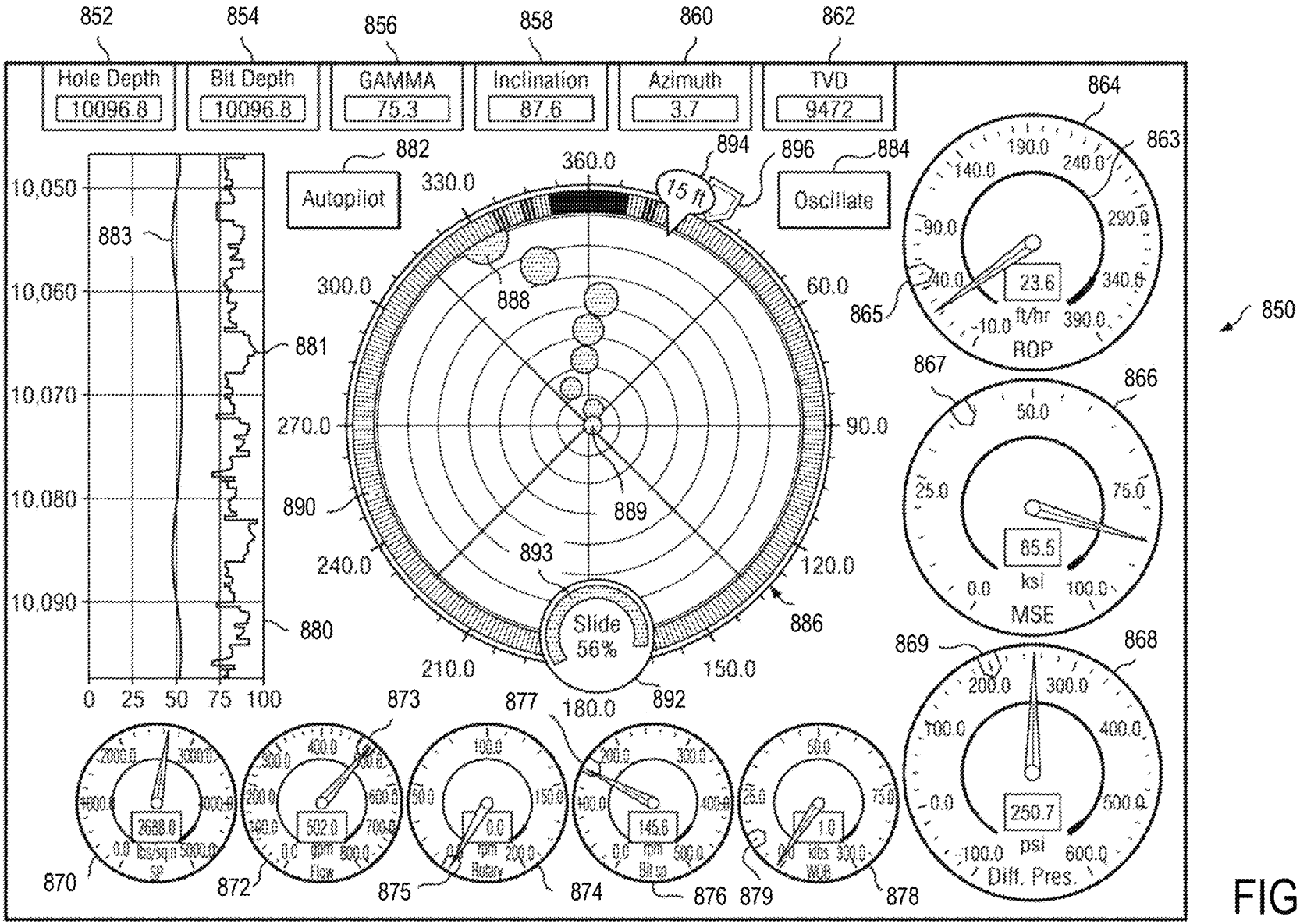
FIG. 8 is a depiction of a graphical user interface provided by the rig control systems.

Referring to FIG. 8, one embodiment of a user interface 850 that may be generated by steering control system 168 for monitoring and operation by a human operator is illustrated. User interface 850 may provide many different types of information in an easily accessible format. For example, user interface 850 may be shown on a computer monitor, a television, a viewing screen (e.g., a display device) associated with steering control system 168.

As shown in FIG. 8, user interface 850 provides visual indicators such as a hole depth indicator 852, a bit depth indicator 854, a GAMMA indicator 856, an inclination indicator 858, an azimuth indicator 860, and a TVD indicator 862. Other indicators may also be provided, including a ROP indicator 864, a mechanical specific energy (MSE) indicator 866, a differential pressure indicator 868, a standpipe pressure indicator 870, a flow rate indicator 872, a rotary RPM (angular velocity) indicator 874, a bit speed indicator 876, and a WOB indicator 878.

In FIG. 8, at least some of indicators 864, 866, 868, 870, 872, 874, 876, and 878 may include a marker representing a target value. For example, markers may be set as certain given values, but it is noted that any desired target value may be used. Although not shown, in some embodiments, multiple markers may be present on a single indicator. The markers may vary in color or size. For example, ROP indicator 864 may include a marker 865 indicating that the target value is 50 feet/hour (or 15 m/h). MSE indicator 866 may include a marker 867 indicating that the target value is 37 kilo-pounds per square inch (ksi) (or 255 Mega Pascals (MPa)). Differential pressure indicator 868 may include a marker 869 indicating that the target value is 200 psi (or 1.38 kPa). ROP indicator 864 may include a marker 865 indicating that the target value is 50 feet/hour (or 15 m/h). Standpipe pressure indicator 870 may have no marker in the present example. Flow rate indicator 872 may include a marker 873 indicating that the target value is 500 gallons per minute (gpm) (or 31.5 L/s). Rotary RPM indicator 874 may include a marker 875 indicating that the target value is 0 RPM (e.g., due to sliding). Bit speed indicator 876 may include a marker 877 indicating that the target value is 150 RPM. WOB indicator 878 may include a marker 879 indicating that the target value is 10 kilo-pounds (klbs) (or 4,500 kilograms ((kg)). Each indicator may also include a colored band, or another marking, to indicate, for example, whether the respective gauge value is within a safe range (e.g., indicated by a green color), within a caution range (e.g., indicated by a yellow color), or within a danger range (e.g., indicated by a red color).

In FIG. 8, a log chart 880 may visually indicate depth versus one or more measurements (e.g., may represent log inputs relative to a progressing depth chart). For example, log chart 880 may have a Y-axis representing depth and an X-axis representing a measurement such as GAMMA count 881 (as shown), ROP 883 (e.g., empirical ROP and normalized ROP), or resistivity. An autopilot button 882 and an oscillate button 884 may be used to control activity. For example, autopilot button 882 may be used to engage or disengage autodriller 510, while oscillate button 884 may be used to directly control oscillation of drill string 146 or to engage/disengage an external hardware device or controller.

In FIG. 8, a circular chart 886 may provide current and historical tool face orientation information (e.g., which way the bend is pointed). For purposes of illustration, circular chart 886 represents three hundred and sixty degrees. A series of circles within circular chart 886 may represent a timeline of tool face orientations, with the sizes of the circles indicating the temporal position of each circle. For example, larger circles may be more recent than smaller circles, so a largest circle 888 may be the newest reading and a smallest circle 889 may be the oldest reading. In other embodiments, circles 889, 888 may represent the energy or progress made via size, color, shape, a number within a circle, etc. For example, a size of a particular circle may represent an accumulation of orientation and progress for the period of time represented by the circle. In other embodiments, concentric circles representing time (e.g., with the outside of circular chart 886 being the most recent time and the center point being the oldest time) may be used to indicate the energy or progress (e.g., via color or patterning such as dashes or dots rather than a solid line).

In user interface 850, circular chart 886 may also be color coded, with the color coding existing in a band 890 around circular chart 886 or positioned or represented in other ways. The color coding may use colors to indicate activity in a certain direction. For example, the color red may indicate the highest level of activity, while the color blue may indicate the lowest level of activity. Furthermore, the arc range in degrees of a color may indicate the amount of deviation. Accordingly, a relatively narrow (e.g., thirty degrees) arc of red with a relatively broad (e.g., three hundred degrees) arc of blue may indicate that most activity is occurring in a particular tool face orientation with little deviation. As shown in user interface 850, the color blue may extend from approximately 22-337 degrees, the color green may extend from approximately 15-22 degrees and 337-345 degrees, the color yellow may extend a few degrees around the 13 and 345 degree marks, while the color red may extend from approximately 347-10 degrees. Transition colors or shades may be used with, for example, the color orange marking the transition between red and yellow or a light blue marking the transition between blue and green. This color coding may enable user interface 850 to provide an intuitive summary of how narrow the standard deviation is and how much of the energy intensity is being expended in the proper direction. Furthermore, the center of energy may be viewed relative to the target. For example, user interface 850 may clearly show that the target is at 90 degrees, but the center of energy is at 45 degrees.

In user interface 850, other indicators, such as a slide indicator 892, may indicate how much time remains until a slide occurs or how much time remains for a current slide. For example, slide indicator 892 may represent a time, a percentage (e.g., as shown, a current slide may be 56% complete), a distance completed, or a distance remaining. Slide indicator 892 may graphically display information using, for example, a colored bar 893 that increases or decreases with slide progress. In some embodiments, slide indicator 892 may be built into circular chart 886 (e.g., around the outer edge with an increasing/decreasing band), while in other embodiments slide indicator 892 may be a separate indicator such as a meter, a bar, a gauge, or another indicator type. In various implementations, slide indicator 892 may be refreshed by autoslide system 514.

In user interface 850, an error indicator 894 may indicate a magnitude and a direction of error. For example, error indicator 894 may indicate that an estimated drill bit position is a certain distance from the planned trajectory, with a location of error indicator 894 around the circular chart 886 representing the heading. For example, FIG. 8 illustrates an error magnitude of 15 feet and an error direction of 15 degrees. Error indicator 894 may be any color but may be red for purposes of example. It is noted that error indicator 894 may present a zero if there is no error. Error indicator may represent that drill bit 148 is on the planned trajectory using other means, such as being a green color. Transition colors, such as yellow, may be used to indicate varying amounts of error. In some embodiments, error indicator 894 may not appear unless there is an error in magnitude or direction. A marker 896 may indicate an ideal slide direction. Although not shown, other indicators may be present, such as a bit life indicator to indicate an estimated lifetime for the current bit based on a value such as time or distance.

It is noted that user interface 850 may be arranged in many different ways. For example, colors may be used to indicate normal operation, warnings, and problems. In such cases, the numerical indicators may display numbers in one color (e.g., green) for normal operation, may use another color (e.g., yellow) for warnings, and may use yet another color (e.g., red) when a serious problem occurs. The indicators may also flash or otherwise indicate an alert. The gauge indicators may include colors (e.g., green, yellow, and red) to indicate operational conditions and may also indicate the target value (e.g., an ROP of 100 feet/hour). For example, ROP indicator 868 may have a green bar to indicate a normal level of operation (e.g., from 10-300 feet/hour), a yellow bar to indicate a warning level of operation (e.g., from 300-360 feet/hour), and a red bar to indicate a dangerous or otherwise out of parameter level of operation (e.g., from 360-390 feet/hour). ROP indicator 868 may also display a marker at 100 feet/hour to indicate the desired target ROP.

Furthermore, the use of numeric indicators, gauges, and similar visual display indicators may be varied based on factors such as the information to be conveyed and the personal preference of the viewer. Accordingly, user interface 850 may provide a customizable view of various drilling processes and information for a particular individual involved in the drilling process. For example, steering control system 168 may enable a user to customize the user interface 850 as desired, although certain features (e.g., standpipe pressure) may be locked to prevent a user from intentionally or accidentally removing important drilling information from user interface 850. Other features and attributes of user interface 850 may be set by user preference. Accordingly, the level of customization and the information shown by the user interface 850 may be controlled based on who is viewing user interface 850 and their role in the drilling process.

Figure 9:
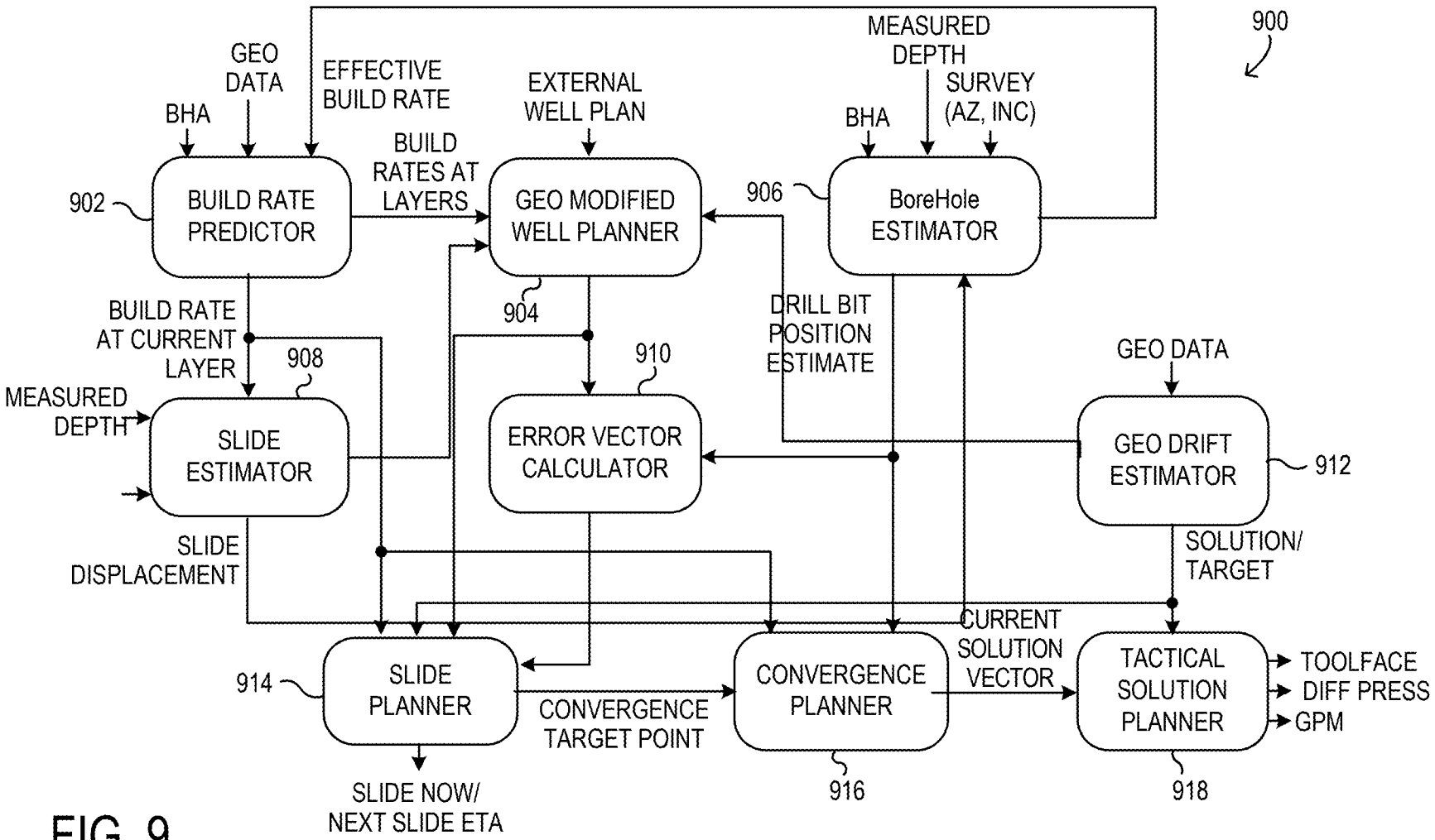
FIG. 9 is a depiction of a guidance control loop performed by the rig control systems.

Referring to FIG. 9, one embodiment of a guidance control loop (GCL) 900 is shown in further detail GCL 900 may represent one example of a control loop or control algorithm executed under the control of steering control system 168. GCL 900 may include various functional modules, including a build rate predictor 902, a geo modified well planner 904, a borehole estimator 906, a slide estimator 908, an error vector calculator 910, a geological drift estimator 912, a slide planner 914, a convergence planner 916, and a tactical solution planner 918. In the following description of GCL 900, the term "external input" refers to input received from outside GCL 900, while "internal input" refers to input exchanged between functional modules of GCL 900.

In FIG. 9, build rate predictor 902 receives external input representing BHA information and geological information, receives internal input from the borehole estimator 906, and provides output to geo modified well planner 904, slide estimator 908, slide planner 914, and convergence planner 916. Build rate predictor 902 is configured to use the BHA information and geological information to predict drilling build rates of current and future sections of borehole 106. For example, build rate predictor 902 may determine how aggressively a curve will be built for a given formation with BHA 149 and other equipment parameters.

In FIG. 9, build rate predictor 902 may use the orientation of BHA 149 to the formation to determine an angle of attack for formation transitions and build rates within a single layer of a formation. For example, if a strata layer of rock is below a strata layer of sand, a formation transition exists between the strata layer of sand and the strata layer of rock. Approaching the strata layer of rock at a 90 degree angle may provide a good tool face and a clean drill entry, while approaching the rock layer at a 45 degree angle may build a curve relatively quickly. An angle of approach that is near parallel may cause drill bit 148 to skip off the upper surface of the strata layer of rock. Accordingly, build rate predictor 902 may calculate BHA orientation to account for formation transitions. Within a single strata layer, build rate predictor 902 may use the BHA orientation to account for internal layer characteristics (e.g., grain) to determine build rates for different parts of a strata layer. The BHA information may include bit characteristics, mud motor bend setting, stabilization, and mud motor bit to bend distance. The geological information may include formation data such as compressive strength, thicknesses, and depths for formations encountered in the specific drilling location. Such information may enable a calculation-based prediction of the build rates and ROP that may be compared to both results obtained while drilling borehole 106 and regional historical results (e.g., from the regional drilling DB 412) to improve the accuracy of predictions as drilling progresses. Build rate predictor 902 may also be used to plan convergence adjustments and confirm in advance of drilling that targets can be achieved with current parameters.

In FIG. 9, geo modified well planner 904 receives external input representing a well plan, internal input from build rate predictor 902 and geo drift estimator 912 and provides output to slide planner 914 and error vector calculator 910. Geo modified well planner 904 uses the input to determine whether there is a more optimal trajectory than that provided by the well plan, while staying within specified error limits. More specifically, geo modified well planner 904 takes geological information (e.g., drift) and calculates whether another trajectory solution to the target may be more efficient in terms of cost or reliability. The outputs of geo modified well planner 904 to slide planner 914 and error vector calculator 910 may be used to calculate an error vector based on the current vector to the newly calculated trajectory and to modify slide predictions. In some embodiments, geo modified well planner 904 (or another module) may provide functionality needed to track a formation trend. For example, in horizontal wells, a geologist may provide steering control system 168 with a target inclination as a set point for steering control system 168 to control. For example, the geologist may enter a target to steering control system 168 of 90.5-91.0 degrees of inclination for a section of borehole 106. Geo modified well planner 904 may then treat the target as a vector target, while remaining within the error limits of the original well plan. In some embodiments, geo modified well planner 904 may be an optional module that is not used unless the well plan is to be modified. For example, if the well plan is marked in steering control system 168 as non-modifiable, geo modified well planner 904 may be bypassed altogether or geo modified well planner 904 may be configured to pass the well plan through without any changes.

In FIG. 9, borehole estimator 906 may receive external inputs representing BHA information, measured depth information, survey information (e.g., azimuth and inclination), and may provide outputs to build rate predictor 902, error vector calculator 910, and convergence planner 916. Borehole estimator 906 may be configured to provide an estimate of the actual borehole and drill bit position and trajectory angle without delay, based on either straight line projections or projections that incorporate sliding. Borehole estimator 906 may be used to compensate for a sensor being physically located some distance behind drill bit 148 (e.g., 50 feet) in drill string 146, which makes sensor readings lag the actual bit location by 50 feet. Borehole estimator 906 may also be used to compensate for sensor measurements that may not be continuous (e.g., a sensor measurement may occur every 100 feet). Borehole estimator 906 may provide the most accurate estimate from the surface to the last survey location based on the collection of survey measurements. Also, borehole estimator 906 may take the slide estimate from slide estimator 908 (described below) and extend the slide estimate from the last survey point to a current location of drill bit 148. Using the combination of these two estimates, borehole estimator 906 may provide steering control system 168 with an estimate of the drill bit's location and trajectory angle from which guidance and steering solutions can be derived. An additional metric that can be derived from the borehole estimate is the effective build rate that is achieved throughout the drilling process.

In FIG. 9, slide estimator 908 receives external inputs representing measured depth and differential pressure information, receives internal input from build rate predictor 902, and provides output to borehole estimator 906 and geo modified well planner 904. Slide estimator 908 may be configured to sample tool face orientation, differential pressure, measured depth (MD) incremental movement, MSE, and other sensor feedback to quantify/estimate a deviation vector and progress while sliding.

Traditionally, deviation from the slide would be predicted by a human operator based on experience. The operator would, for example, use a long slide cycle to assess what likely was accomplished during the last slide. However, the results are generally not confirmed until the downhole survey sensor point passes the slide portion of the borehole, often resulting in a response lag defined by a distance of the sensor point from the drill bit tip (e.g., approximately 50 feet). Such a response lag may introduce inefficiencies in the slide cycles due to over/under correction of the actual trajectory relative to the planned trajectory.

In GCL 900, using slide estimator 908, each tool face update may be algorithmically merged with the average differential pressure of the period between the previous and current tool face readings, as well as the MD change during this period to predict the direction, angular deviation, and MD progress during the period. As an example, the periodic rate may be between 10 and 60 seconds per cycle depending on the tool face update rate of downhole tool 166. With a more accurate estimation of the slide effectiveness, the sliding efficiency can be improved. The output of slide estimator 908 may accordingly be periodically provided to borehole estimator 906 for accumulation of well deviation information, as well to geo modified well planner 904. Some or all of the output of the slide estimator 908 may be output to an operator, such as shown in the user interface 850 of FIG. 8.

In FIG. 9, error vector calculator 910 may receive internal input from geo modified well planner 904 and borehole estimator 906. Error vector calculator 910 may be configured to compare the planned well trajectory to an actual borehole trajectory and drill bit position estimate. Error vector calculator 910 may provide the metrics used to determine the error (e.g., how far off) the current drill bit position and trajectory are from the well plan. For example, error vector calculator 910 may calculate the error between the current bit position and trajectory to the planned trajectory and the desired bit position. Error vector calculator 910 may also calculate a projected bit position/projected trajectory representing the future result of a current error.

In FIG. 9, geological drift estimator 912 receives external input representing geological information and provides outputs to geo modified well planner 904, slide planner 914, and tactical solution planner 918. During drilling, drift may occur as the particular characteristics of the formation affect the drilling direction. More specifically, there may be a trajectory bias that is contributed by the formation as a function of ROP and BHA 149. Geological drift estimator 912 is configured to provide a drift estimate as a vector that can then be used to calculate drift compensation parameters that can be used to offset the drift in a control solution.

In FIG. 9, slide planner 914 receives internal input from build rate predictor 902, geo modified well planner 904, error vector calculator 910, and geological drift estimator 912, and provides output to convergence planner 916 as well as an estimated time to the next slide. Slide planner 914 may be configured to evaluate a slide/drill ahead cost equation and plan for sliding activity, which may include factoring in BHA wear, expected build rates of current and expected formations, and the well plan trajectory. During drill ahead, slide planner 914 may attempt to forecast an estimated time of the next slide to aid with planning. For example, if additional lubricants (e.g., fluorinated beads) are indicated for the next slide, and pumping the lubricants into drill string 146 has a lead time of 30 minutes before the slide, the estimated time of the next slide may be calculated and then used to schedule when to start pumping the lubricants. Functionality for a loss circulation material (LCM) planner may be provided as part of slide planner 914 or elsewhere (e.g., as a stand-alone module or as part of another module described herein). The LCM planner functionality may be configured to determine whether additives should be pumped into the borehole based on indications such as flow-in versus flow-back measurements. For example, if drilling through a porous rock formation, fluid being pumped into the borehole may get lost in the rock formation. To address this issue, the LCM planner may control pumping LCM into the borehole to clog up the holes in the porous rock surrounding the borehole to establish a more closed-loop control system for the fluid.

In FIG. 9, slide planner 914 may also look at the current position relative to the next connection. A connection may happen every 90 to 100 feet (or some other distance or distance range based on the particulars of the drilling operation) and slide planner 914 may avoid planning a slide when close to a connection or when the slide would carry through the connection. For example, if the slide planner 914 is planning a 50 foot slide but only 20 feet remain until the next connection, slide planner 914 may calculate the slide starting after the next connection and make any changes to the slide parameters to accommodate waiting to slide until after the next connection. Such flexible implementation avoids inefficiencies that may be caused by starting the slide, stopping for the connection, and then having to reorient the tool face before finishing the slide. During slides, slide planner 914 may provide some feedback as to the progress of achieving the desired goal of the current slide. In some embodiments, slide planner 914 may account for reactive torque in the drill string. More specifically, when rotating is occurring, there is a reactional torque wind up in drill string 146. When the rotating is stopped, drill string 146 unwinds, which changes tool face orientation and other parameters. When rotating is started again, drill string 146 starts to wind back up. Slide planner 914 may account for the reactional torque so that tool face references are maintained, rather than stopping rotation and then trying to adjust to an optimal tool face orientation. While not all downhole tools may provide tool face orientation when rotating, using one that does supply such information for GCL 900 may significantly reduce the transition time from rotating to sliding.

In FIG. 9, convergence planner 916 receives internal inputs from build rate predictor 902, borehole estimator 906, and slide planner 914, and provides output to tactical solution planner 918. Convergence planner 916 is configured to provide a convergence plan when the current drill bit position is not within a defined margin of error of the planned well trajectory. The convergence plan represents a path from the current drill bit position to an achievable and optimal convergence target point along the planned trajectory. The convergence plan may take account the amount of sliding/drilling ahead that has been planned to take place by slide planner 914. Convergence planner 916 may also use BHA orientation information for angle of attack calculations when determining convergence plans as described above with respect to build rate predictor 902. The solution provided by convergence planner 916 defines a new trajectory solution for the current position of drill bit 148. The solution may be immediate without delay or planned for implementation at a future time that is specified in advance.

In FIG. 9, tactical solution planner 918 receives internal inputs from geological drift estimator 912 and convergence planner 916 and provides external outputs representing information such as tool face orientation, differential pressure, and mud flow rate. Tactical solution planner 918 is configured to take the trajectory solution provided by convergence planner 916 and translate the solution into control parameters that can be used to control drilling rig 210. For example, tactical solution planner 918 may convert the solution into settings for control systems 522, 524, and 526 to accomplish the actual drilling based on the solution. Tactical solution planner 918 may also perform performance optimization to optimizing the overall drilling operation as well as optimizing the drilling itself (e.g., how to drill faster).

Other functionality may be provided by GCL 900 in additional modules or added to an existing module. For example, there is a relationship between the rotational position of the drill pipe on the surface and the orientation of the downhole tool face. Accordingly, GCL 900 may receive information corresponding to the rotational position of the drill pipe on the surface. GCL 900 may use this surface positional information to calculate current and desired tool face orientations. These calculations may then be used to define control parameters for adjusting the top drive 140 to accomplish adjustments to the downhole tool face in order to steer the trajectory of borehole 106.

For purposes of example, an object-oriented software approach may be utilized to provide a class-based structure that may be used with GCL 900, or other functionality provided by steering control system 168. In GCL 900, a drilling model class may be defined to capture and define the drilling state throughout the drilling process. The drilling model class may include information obtained without delay. The drilling model class may be based on the following components and sub-models: a drill bit model, a borehole model, a rig surface gear model, a mud pump model, a WOB/differential pressure model, a positional/rotary model, an MSE model, an active well plan, and control limits. The drilling model class may produce a control output solution and may be executed via a main processing loop that rotates through the various modules of GCL 900. The drill bit model may represent the current position and state of drill bit 148. The drill bit model may include a three dimensional (3D) position, a drill bit trajectory, BHA information, bit speed, and tool face (e.g., orientation information). The 3D position may be specified in north-south (NS), east-west (EW), and true vertical depth (TVD). The drill bit trajectory may be specified as an inclination angle and an azimuth angle. The BHA information may be a set of dimensions defining the active BHA. The borehole model may represent the current path and size of the active borehole. The borehole model may include hole depth information, an array of survey points collected along the borehole path, a gamma log, and borehole diameters. The hole depth information is for current drilling of borehole 106. The borehole diameters may represent the diameters of borehole 106 as drilled over current drilling. The rig surface gear model may represent pipe length, block height, and other models, such as the mud pump model, WOB/differential pressure model, positional/rotary model, and MSE model. The mud pump model represents mud pump equipment and includes flow rate, standpipe pressure, and differential pressure. The WOB/differential pressure model represents draw works or other WOB/differential pressure controls and parameters, including WOB. The positional/rotary model represents top drive or other positional/rotary controls and parameters including rotary rotations per minute (RPM) and spindle position. The active well plan represents the target borehole path and may include an external well plan and a modified well plan. The control limits represent defined parameters that may be set as maximums and/or minimums. For example, control limits may be set for the rotary RPM in the top drive model to limit the maximum RPMs to the defined level. The control output solution may represent the control parameters for drilling rig 210.

Each functional module of GCL 900 may have behavior encapsulated within a respective class definition. During a processing window, the individual functional modules may have an exclusive portion in time to execute and update the drilling model. For purposes of example, the processing order for the functional modules may be in the sequence of geo modified well planner 904, build rate predictor 902, slide estimator 908, borehole estimator 906, error vector calculator 910, slide planner 914, convergence planner 916, geological drift estimator 912, and tactical solution planner 918. It is noted that other sequences may be used in different implementations.

In FIG. 9, GCL 900 may rely on a programmable timer module that provides a timing mechanism to provide timer event signals to drive the main processing loop. While steering control system 168 may rely on timer and date calls driven by the programming environment, timing may be obtained from other sources than system time. In situations where it may be advantageous to manipulate the clock (e.g., for evaluation and testing), a programmable timer module may be used to alter the system time. For example, the programmable timer module may enable a default time set to the system time and a time scale of 1.0, may enable the system time of steering control system 168 to be manually set, may enable the time scale relative to the system time to be modified, or may enable periodic event time requests scaled to a requested time scale.

Referring now to FIG. 10, a block diagram illustrating selected elements of an embodiment of a controller 1000 for performing surface steering according to the present disclosure. In various embodiments, controller 1000 may represent an implementation of steering control system 168. In other embodiments, at least certain portions of controller 1000 may be used for control systems 510, 512, 514, 522, 524, and 526 (see FIG. 5).

In the embodiment depicted in FIG. 10, controller 1000 includes processor 1001 coupled via shared bus 1002 to storage media collectively identified as memory media 1010.

Controller 1000, as depicted in FIG. 10, further includes network adapter 1020 that interfaces controller 1000 to a network (not shown in FIG. 10). In embodiments suitable for use with user interfaces, controller 1000, as depicted in FIG. 10, may include peripheral adapter 1006, which provides connectivity for the use of input device 1008 and output device 1009. Input device 1008 may represent a device for user input, such as a keyboard or a mouse, or even a video camera. Output device 1009 may represent a device for providing signals or indications to a user, such as loudspeakers for generating audio signals.

Controller 1000 is shown in FIG. 10 including display adapter 1004 and further includes a display device 1005. Display adapter 1004 may interface shared bus 1002, or another bus, with an output port for one or more display devices, such as display device 1005. Display device 1005 may be implemented as a liquid crystal display screen, a computer monitor, a television or the like. Display device 1005 may comply with a display standard for the corresponding type of display. Standards for computer monitors include analog standards such as video graphics array (VGA), extended graphics array (XGA), etc., or digital standards such as digital visual interface (DVI), definition multimedia interface (HDMI), among others. A television display may comply with standards such as NTSC (National Television System Committee), PAL (Phase Alternating Line), or another suitable standard. Display device 1005 may include an output device 1009, such as one or more integrated speakers to play audio content, or may include an input device 1008, such as a microphone or video camera.

In FIG. 10, memory media 1010 encompasses persistent and volatile media, fixed and removable media, and magnetic and semiconductor media. Memory media 1010 is operable to store instructions, data, or both. Memory media 1010 as shown includes sets or sequences of instructions 1024-2, namely, an operating system 1012 and surface steering control 1014. Operating system 1012 may be a UNIX or UNIX-like operating system, a Windows® family operating system, or another suitable operating system. Instructions 1024 may also reside, completely or at least partially, within processor 1001 during execution thereof. It is further noted that processor 1001 may be configured to receive instructions 1024-1 from instructions 1024-2 via shared bus 1002. In some embodiments, memory media 1010 is configured to store and provide executable instructions for executing GCL 900, as mentioned previously, among other methods and operations disclosed herein.

Tool Face Prediction

Various embodiments may predict tool face using a data driven model (e.g., a multiple-input-single-output (MISO) transfer function). According to various embodiments, the inputs to the transfer function can include two or more of the spindle offsets, the differential pressure, the WOB, and the ROP. In some embodiments, the inputs to the transfer function can include the spindle offset and the differential pressure. The output of the transfer function can be the tool face prediction. The inputs and the outputs may be provided as a function of time, which is the input may be a history of spindle offset and a history of the differential pressure over a predetermined period of time. In that case, the output can be a history of the tool face prediction over that predetermined period of time. The transfer function itself may be a function of time (e.g., TF(t)).

Driven by the surface ROP, the axial force can be translated into rotational reactive torque, which is reflected by the changes in WOB and differential pressure. At the same time, the tool face can be driven by spindle offset proportionally in a clockwise direction after certain propagation delay. The tool face can be driven by (1) spindle offset in clockwise direction (which provides positive gain for the tool face change in the model), and (2) reactive torque (created by an axial force which is related to differential pressure/WOB/ROP) in counterclockwise direction (which provides negative gain for the tool face change in the model). Therefore, the transfer function model represents the relationship between tool face and multiple inputs, such as differential pressure, WOB and spindle offset, based on historical rig data and measurements. Since historical data can be used, older inputs (spindle offset or the differential pressure) can affect the change of the transfer function more than the recently obtained data.

An exemplary model represented by a format of a transfer function is provided below:

$$y[i] = \sum_{k=1}^{m_1} b_k^1 u^1[i-k-d^1] + \sum_{k=1}^{m_2} b_k^2 u^2[i-k-d^2] + \sum_{k=1}^{n} a_k y[i-k] + e[k]$$

where $u^1[i]$ is the spindle input at the $i^{th}$ time instance, $u^2[i]$ is the differential pressure input, and y[i] is the output (i.e., the tool face prediction) of the transfer function, i.e., the tool face response caused by spindle offset, plus the response caused by the differential pressure. The values for $u^1$, $u^2$, and y are the measurements obtained from the rig systems. The discrete linear system coefficients $b^1_k$, $b^2_k$ and $a_k$ can be estimated. These are model state variables which might experience changes during sliding operations, with $m_1$ and $m_2$ being the numbers of taps. The parameters $d^1$ and $d^2$ denote the propagation delay from spindle and differential pressure inputs to the tool face output, in terms of number of discrete samples The tool face prediction may be made at times when there is no actual measurement, such as between actual measurements, when a measurement is delayed or not received at the surface, or when a measurement is received but there is low confidence in its accuracy. The predicted tool face may be used to make a steering decision to change the offset in-between the measured tool faces. For example, if there is a minute between two consecutive tool face measurements, a predicted tool face may be determined at every 20 seconds between the two consecutive tool face measurements.

Figure 11:
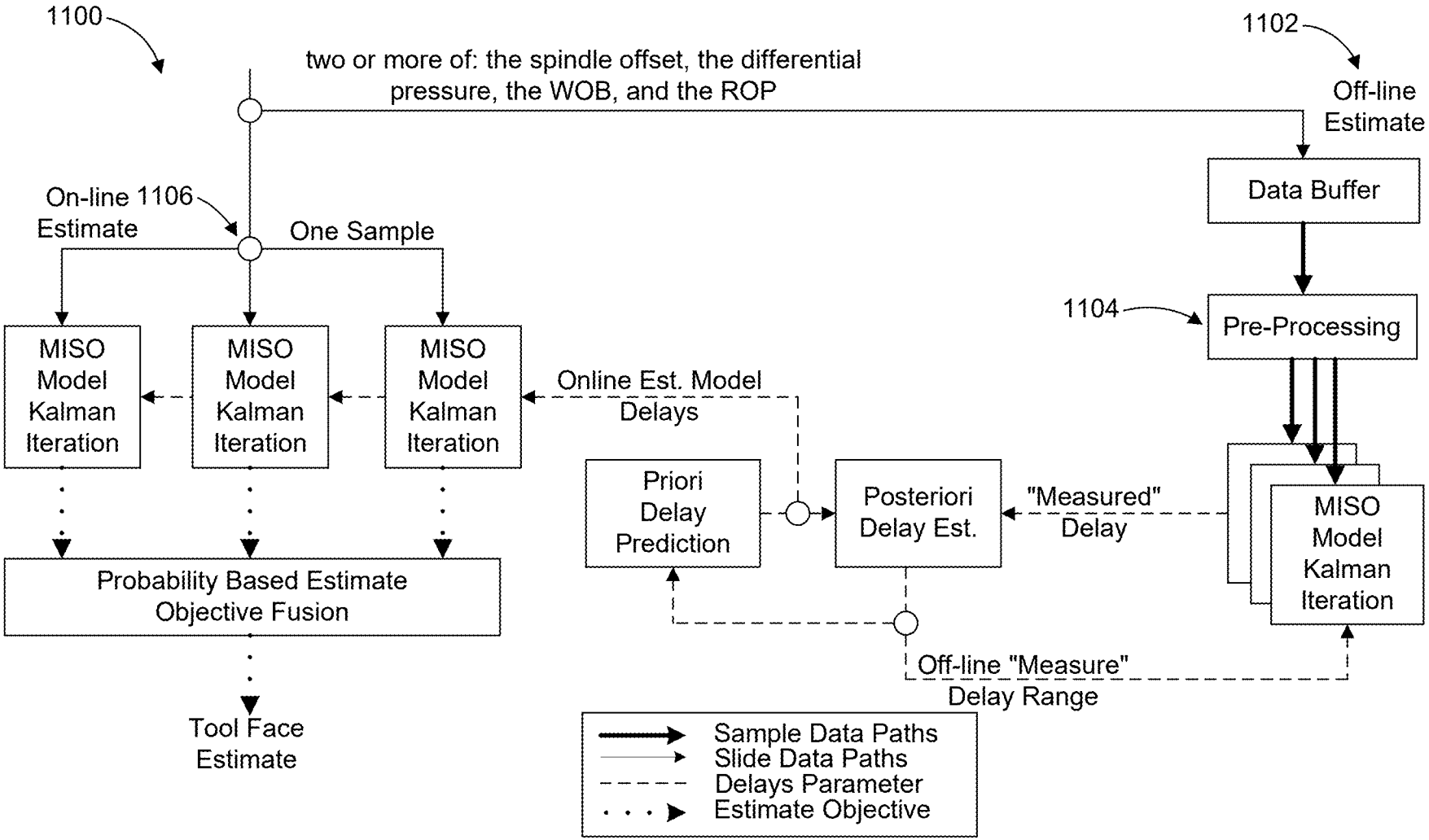
FIG. 11 illustrates an exemplary data-driven model for predicting tool face according to various embodiments.

FIG. 11 illustrates an exemplary data-driven model for predicting tool face according to various embodiments. As illustrated in FIG. 11, the real-time tool face prediction is accomplished by an online model estimation working together with an offline model estimation algorithm. The offline model estimation is made based on all measurements taken from the preceding slide. Multiple models with different delay coefficients (e.g., $d_1$ and $d_2$), participate in the offline model estimation. The estimated delay coefficients can be selected from the model producing the highest overall fitness across the whole slide. The fitness can be computed by comparing measured tool face values and the tool face values produced by the model. The propagation delay from spindle offset and differential pressure to tool face change of a current slide can be assumed to mimic the preceding slide, so the delay coefficients estimated from the preceding slide are used for the current slide. According to various embodiments, a same BHA configuration may be used in the preceding and current slides. As shown in FIG. 11, the offline estimate can include a pre-processing step 1104 (e.g., offset remove, use of a low-pass filter, normalization, resampling), whereas the pre-processing step is not needed for the input data 1106 in the online model (although it may be used if desired).

In an online model, the delay coefficients estimated from the previous slide used in the model can be estimated online for the current slide, along with the data acquired during the current slide. With the actual measured downhole tool face value received, other model state variables can be updated in an adaptive manner, such as with Kalman filtering. For example, during the current slide, the drill may hit a stringer which may cause the course of the current slide to change. Similar to the offline estimate, multiple MISO models with different numbers of taps can be executed in parallel to predict the tool face orientation. The online predicted tool face at each time instance can be obtained in one of several ways. For example, it can be the result from one MISO model with the highest conditional probability, or it can be the conditional probability weighted average from all MISO models. The conditional probability can be calculated by Bayesian methods.

According to various embodiments, under the condition of slides that are in a same or similar shale formation, and the borehole distance between slides may not be very long, an offline estimated model may be used for several following slides, when the data quality of one of the following completed slides cannot provide a valid delay estimate for the next slide. On the other hand, an online transfer function may be more suitable if it is known or expected that the shale formation will change between slide drilling operations.

The online transfer function may also be more suitable for long slides. In some embodiments, information from the preceding slide may be weighted based on the proportional distance between two slides (e.g., one slide five feet apart from the next slide is likely to be more relevant than one slide 500 feet apart from the next slide). Yet other embodiments may use a model based on a combination of the online transfer function and the offline transfer function.

Figure 12:
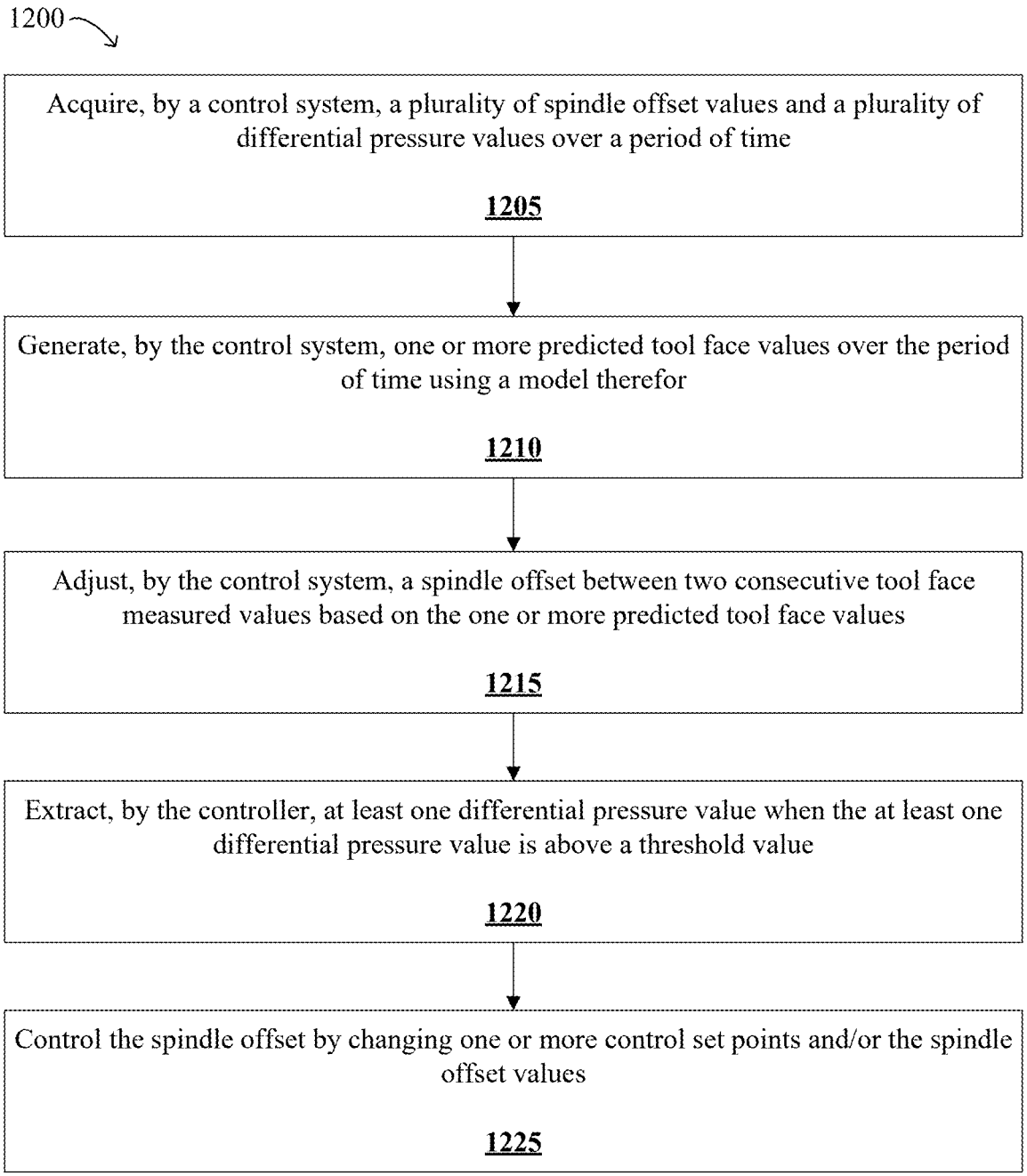
FIG. 12 illustrates a flow chart for predicting tool face according to various embodiments.

FIG. 12 is a flow chart of a process 1200, according to an example of the present disclosure controlling spindle offset during drilling operations based on one or more predicted tool face values. According to an example, one or more process blocks of FIG. 12 may be performed by a computing system that can be communicatively connected to a controller 1000 of a drilling system.

At block 1205, process 1200 may include acquiring, by a control system, a plurality of spindle offset values and a plurality of differential pressure values over a period of time. For example, the control system, may capture a plurality of spindle offset values and a plurality of differential pressure values over a period of time, as described above.

At block 1210, process 1200 may include generating, by the control system, one or more predicted tool face values over the period of time using a model therefor. For example, controller 1000 may generate, by the control system, one or more predicted tool face values over the period of time using a model therefor, as described above.

At block 1215, process 1200 may include adjusting, by the control system, a spindle offset between two consecutive tool face measured values based on the one or more predicted tool face values. For example, controller 1000 may adjust, by the control system, a spindle offset between two consecutive tool face measured values based on the one or more predicted tool face values, as described above.

At block 1220, process 1200 may include extracting, by the control system, at least one differential pressure value when the at least one differential pressure value is above a threshold value. For example, controller 1000 may extract, by the control system, at least one differential pressure value when the at least one differential pressure value is above a threshold value, as described above.

At block 1225, process 1200 may include controlling the spindle offset by changing one or more control set points and/or the spindle offset values. For example, controller 1000 may control the spindle offset by changing one or more control set points and/or the spindle offset values, as described above. A system may include a drill rig controller. The control system sends to the drill rig controller instructions to drill a wellbore using the one or more control set points and/or the spindle offset values.

Process 1200 may include additional implementations, such as any single implementation or any combination of implementations described below and/or in connection with one or more other processes described elsewhere herein.

In various embodiments, the model uses a multiple-input-single-output transfer function.

In various embodiments, process 1200 may include acquiring a plurality of weight-on-bit values over a period of time and acquiring a plurality of rate of penetration values over the period of time.

In various embodiments, inputs to the multiple-input-single-output transfer function may include two or more of: the plurality of spindle offset values, the plurality of differential pressure values, the plurality of weight-on-bit values, and the plurality of rate of penetration values.

In various embodiments, the inputs to the multiple-input-single-output transfer function are measured from a previous slide. In various embodiments, the inputs to the multiple-input-single-output transfer function are measured from a current slide.

It should be noted that while FIG. 12 shows example blocks of process 1200, in some implementations, process 1200 may include additional blocks, fewer blocks, different blocks, or differently arranged blocks than those depicted in FIG. 12. Additionally, or alternatively, two or more of the blocks of process 1200 may be performed in parallel.

In various embodiments, a computing device can include one or more memories; and one or more processors in communication with the one or more memories and configured to execute instructions stored in the one or more memories to performing operations of process 1200 as described above.

In various embodiments, a computer-readable medium storing a plurality of instructions that, when executed by one or more processors of a computing device, cause the one or more processors to perform operations of any of the methods of process 1200 as described above.

Figure 13A:
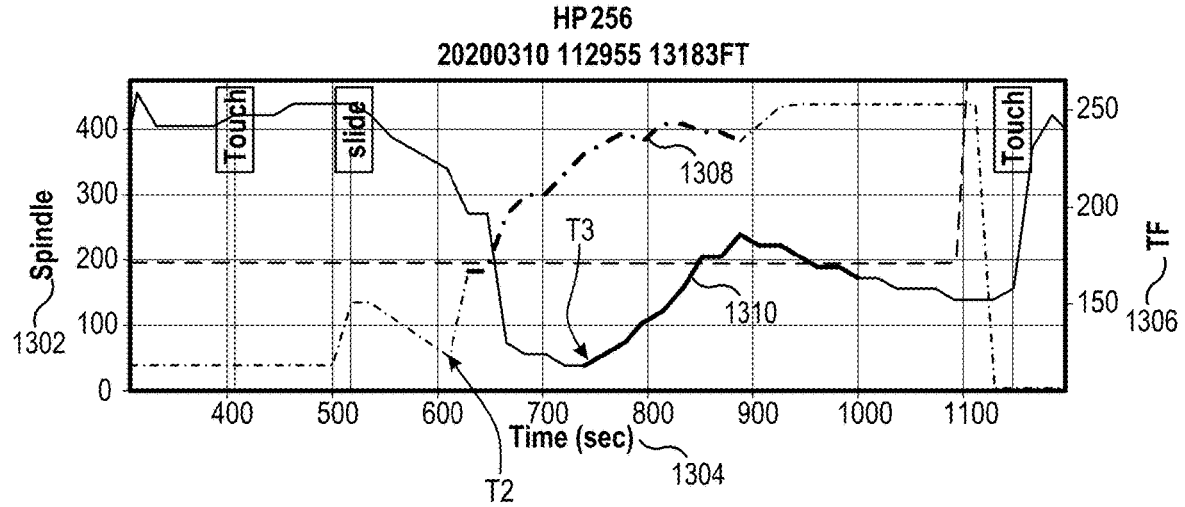
FIG. 13A illustrates a first exemplary plot of spindle and tool face over time.
Figure 13B:
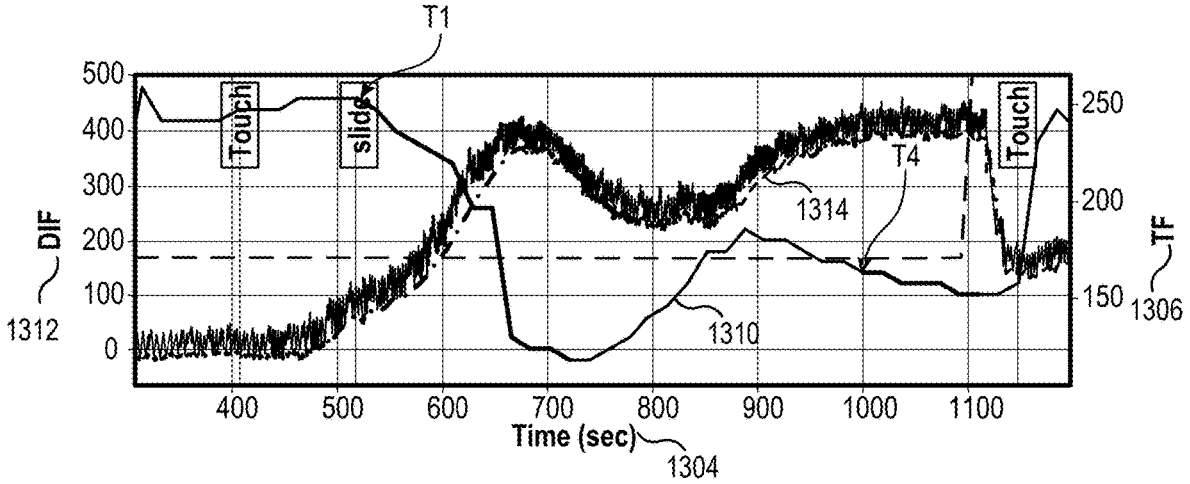
FIG. 13B illustrates a first exemplary plot of differential pressure and tool face over time.
Figure 13C:
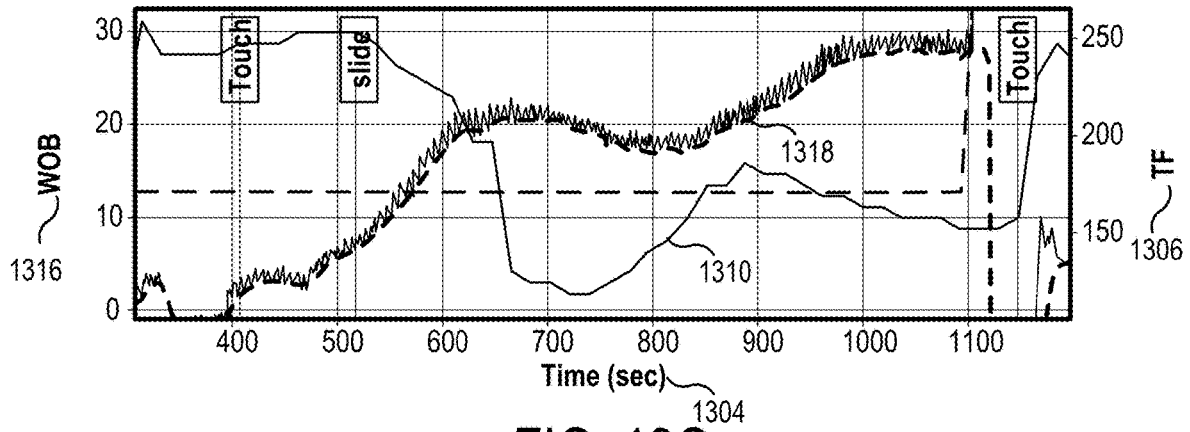
FIG. 13C illustrates a first exemplary plot of weight-on-bit and tool face over time.

FIGS. 13A-13C provide additional details for tool face prediction using a particular rig (e.g., HP256) at a particular depth (e.g., 13183 feet). FIG. 13A plots spindle offset 1302 and tool face 1306 over time 1304. The spindle offset plot 1308 and the tool face plot 1310 are illustrated. FIG. 13B plots differential pressure 1312 and tool face 1306 over time 1304. The differential pressure plot 1314 and tool face plot 1310 are illustrated. FIG. 13C plots weight-on-bit 1316 and the tool face 1306 over time 1306. The weight-on-bit plot 1318 and the tool face plot 1310 are illustrated.

As illustrated in FIGS. 13A-C, during time $T_1$ (e.g., starting at the beginning of the slide), the differential pressure increases, and the reactive torque forces the tool face to turn counterclockwise. At time $T_2$, the spindle begins to control. At time $T_3$, the spindle control takes effect. At time $T_4$, the spindle control is stationary, and the increasing reactive torque forces the tool face to turn slightly counterclockwise.

Figure 14A:
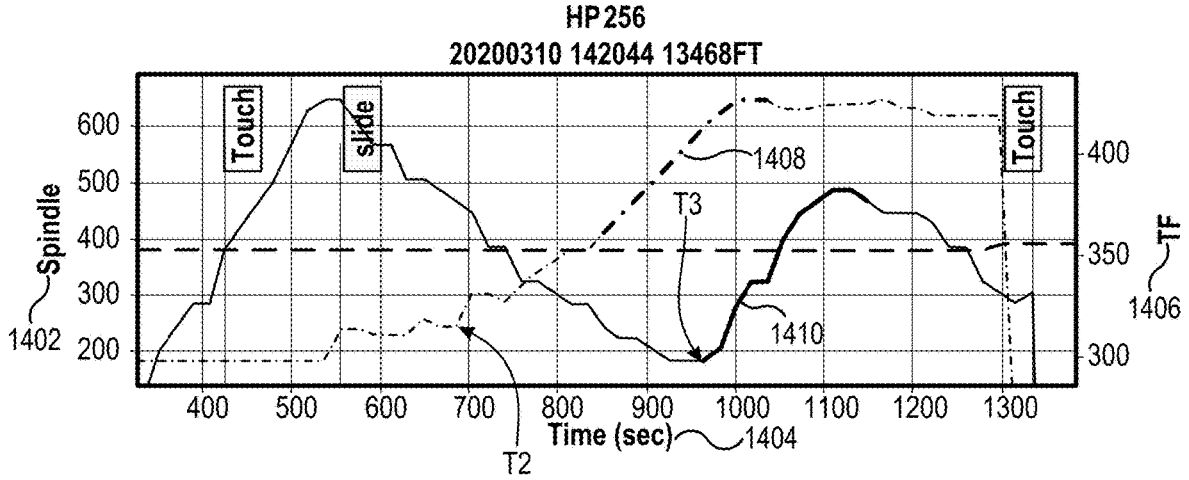
FIG. 14A illustrates a second exemplary plot of spindle and tool face over time.
Figure 14B:
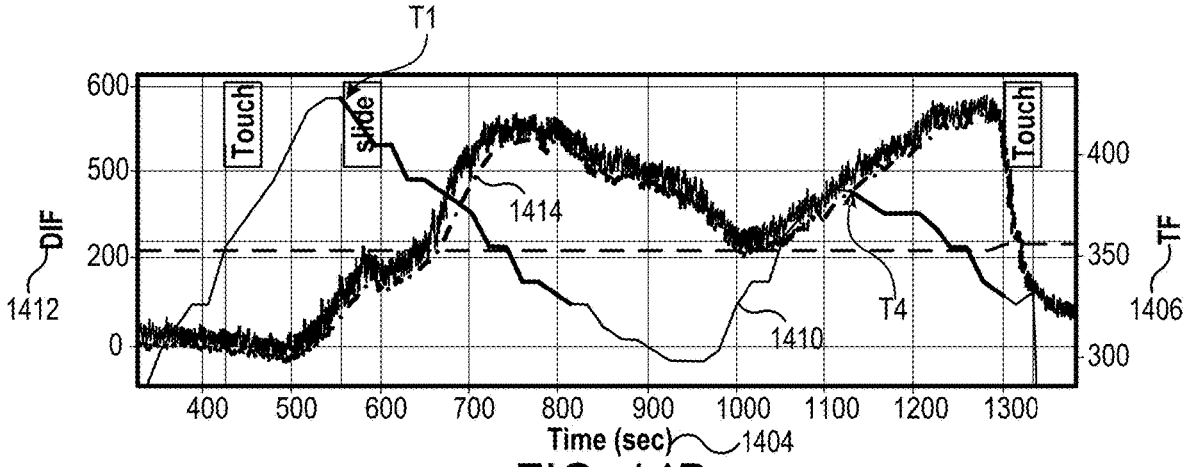
FIG. 14B illustrates a second exemplary plot of differential pressure and tool face over time.
Figure 14C:
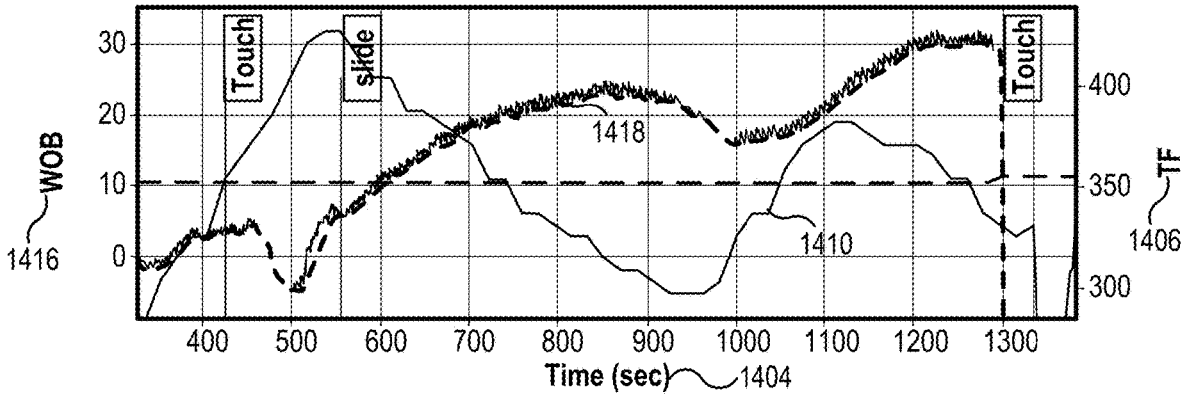
FIG. 14C illustrates a second exemplary plot of weight-on-bit and tool face over time.

FIGS. 14A-14C provide additional details for tool face prediction using a particular rig (e.g., HP256) at a particular depth (e.g., 13468 feet). FIG. 14A plots spindle offset 1402 and tool face 1406 over time 1404. The spindle offset plot 1408 and the tool face plot 1410 are illustrated. FIG. 14B plots differential pressure 1412 and tool face 1406 over time 1404. The differential pressure plot 1414 and tool face plot are illustrated. FIG. 14C plots weight-on-bit 1416 and the tool face 1406 over time 1406. The weight-on-bit plot 1418 and the tool face plot 1410 are illustrated.

In FIGS. 14A-14C, at $T_1$ differential pressure increases and reactive torque forces tool face turning in a counterclockwise direction. At $T_2$ the spindle begins to control. At $T_3$ spindle control arrives and takes effect. At $T_4$ spindle control is stationary, and the increasing reactive torque forces Tool Face in an anti-clockwise direction.

Figure 15A:
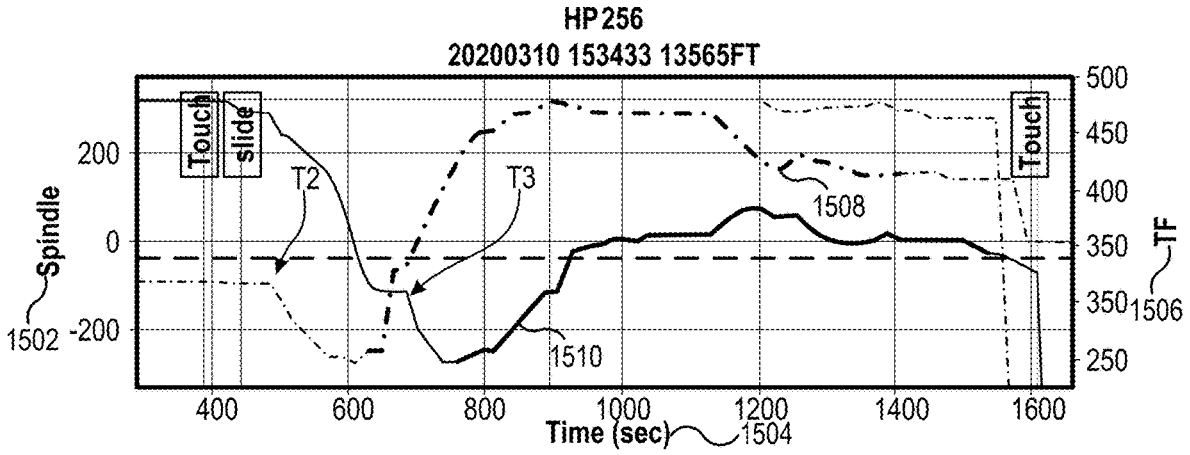
FIG. 15A illustrates a third exemplary plot of spindle and tool face over time.
Figure 15B:
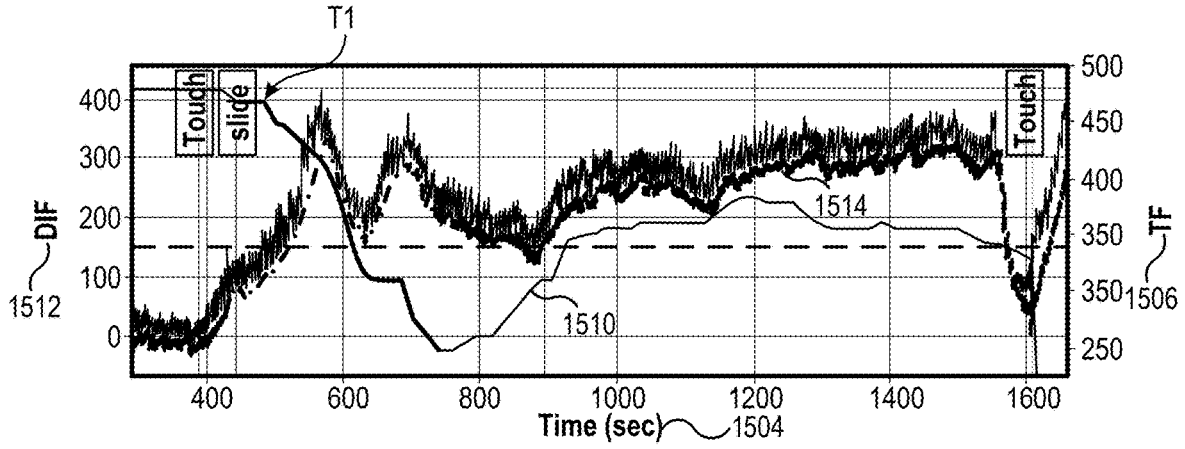
FIG. 15B illustrates a third exemplary plot of differential pressure and tool face over time.
Figure 15C:
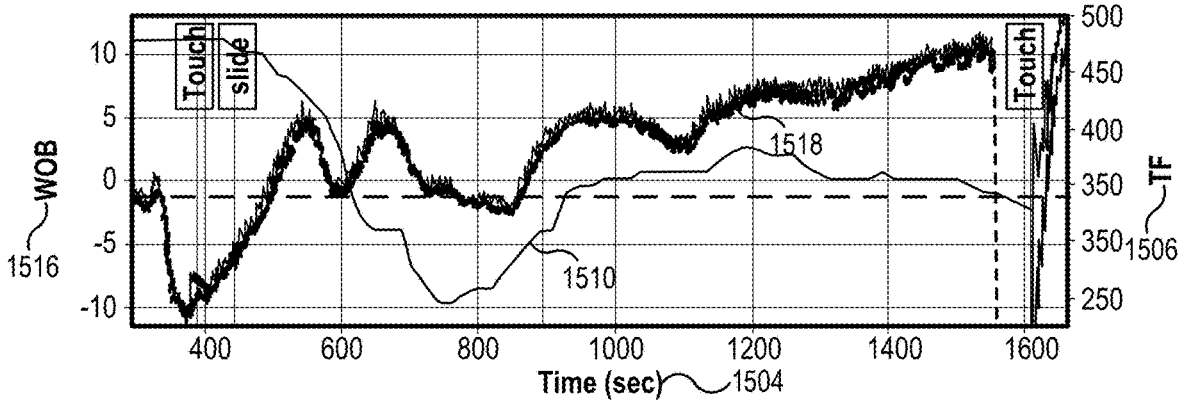
FIG. 15C illustrates a third exemplary plot of weight-on-bit and tool face over time.

FIGS. 15A-15C provide additional details for tool face prediction using a particular rig (e.g., HP256) at a particular depth (e.g., 13565 feet). FIG. 15A plots spindle offset 1502 and tool face 1506 over time 1504. The spindle offset plot 1508 and the tool face plot 1510 are illustrated. FIG. 15B plots differential pressure 1512 and tool face 1506 over time 1504. The differential pressure plot 1515 and tool face plot are illustrated. FIG. 15C plots weight-on-bit 1516 and the tool face 1506 over time 1504. The weight-on-bit plot 1518 and the tool face plot 1510 are illustrated.

As shown in FIGS. 15A-15C, during time $T_1$ (e.g., starting at the beginning of the slide), the differential pressure increases, and the reactive torque forces the tool face to turn counterclockwise. At time $T_2$, the spindle begins to control. At time $T_3$, the spindle control takes effect until the end of the slide.

Figure 16A:
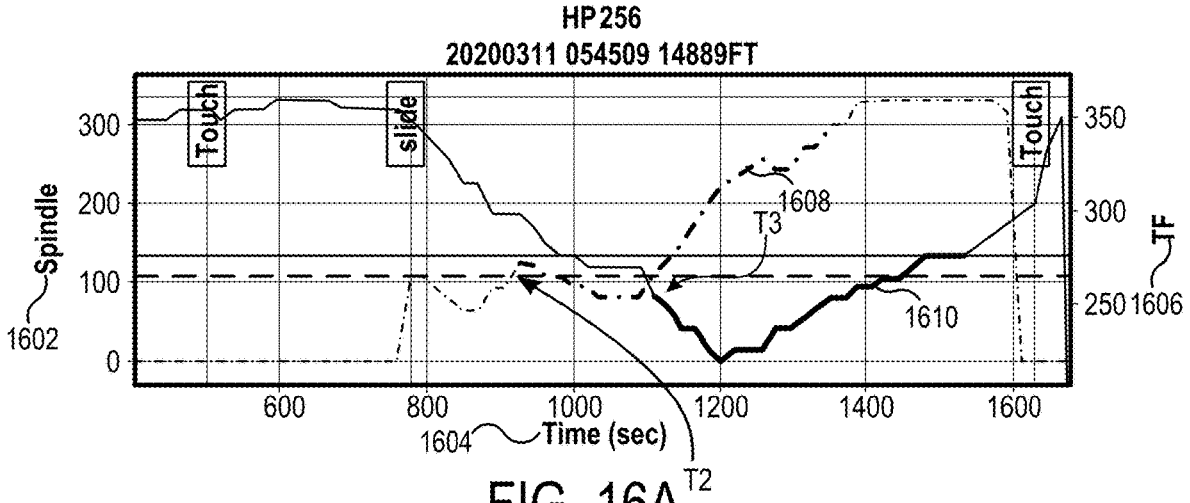
FIG. 16A illustrates a fourth exemplary plot of spindle and tool face over time.
Figure 16B:
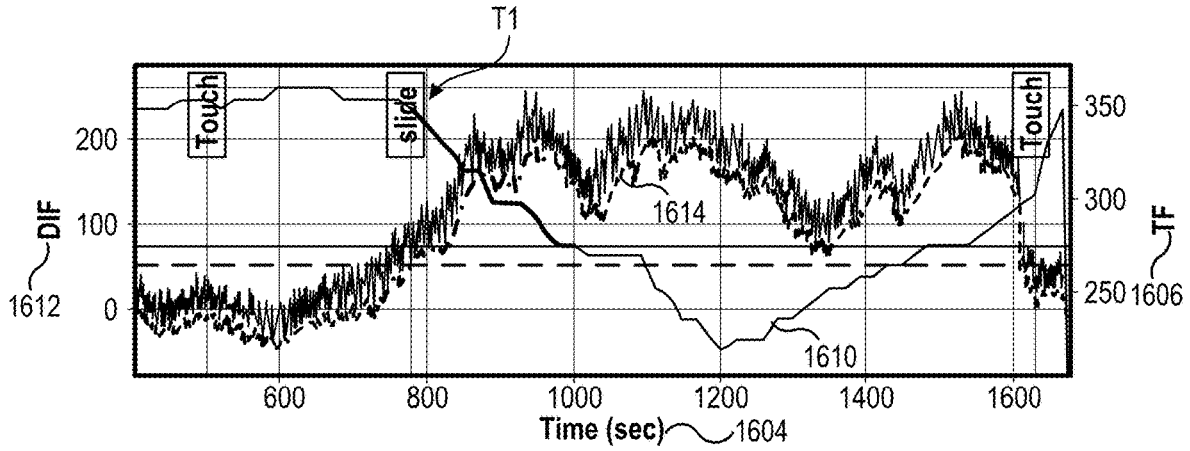
FIG. 16B illustrates a fourth exemplary plot of differential pressure and tool face over time.
Figure 16C:
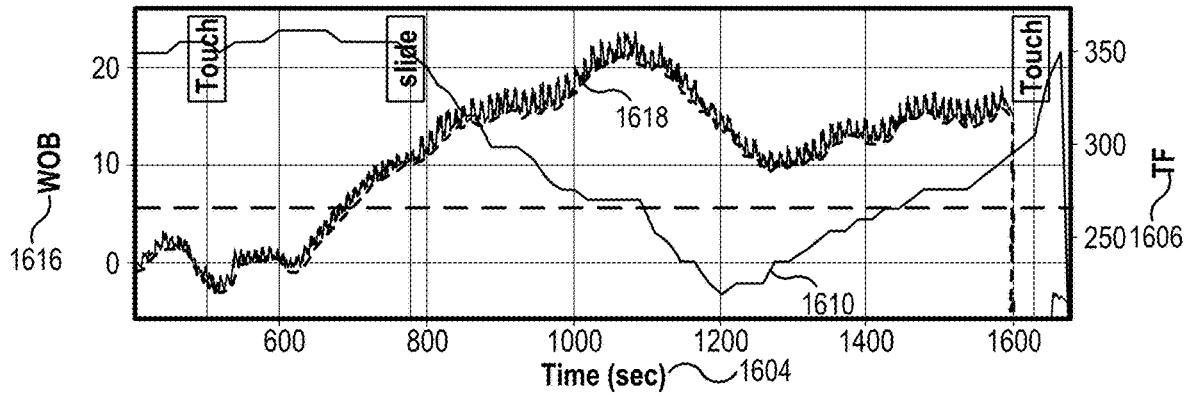
FIG. 16C illustrates a fourth exemplary plot of weight-on-bit and tool face over time.

FIGS. 16A-16C provide additional details for tool face prediction using a particular rig (e.g., HP256) at a particular depth (e.g., 14889 feet). FIG. 16A plots spindle offset 1602 and tool face 1606 over time 1604. The spindle offset plot 1608 and the tool face plot 1610 are illustrated. FIG. 16B plots differential pressure 1612 and tool face 1606 over time 1604. The differential pressure plot 1616 and tool face plot are illustrated. FIG. 16C plots weight-on-bit 1616 and the tool face 1606 over time 1604. The weight-on-bit plot 1618 and the tool face plot 1610 are illustrated.

As shown in FIGS. 16A-16C, during time $T_1$ (e.g., starting at the beginning of the slide), the differential pressure increases, and the reactive torque forces the tool face to turn counterclockwise. At time $T_2$, the spindle begins to control. At time $T_3$, the spindle control takes effect until the end of the slide.

Figure 17A:
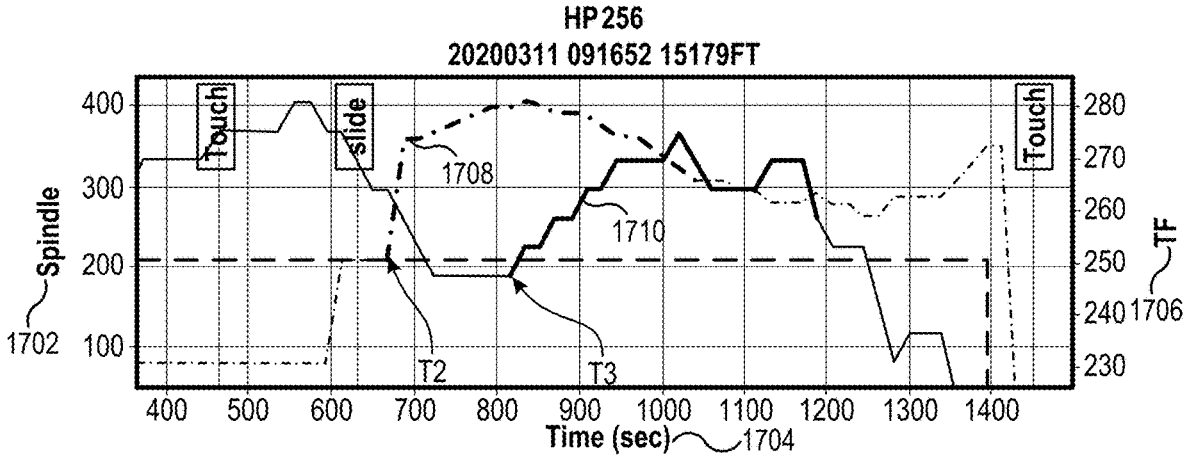
FIG. 17A illustrates a fifth exemplary plot of spindle and tool face over time.
Figure 17B:
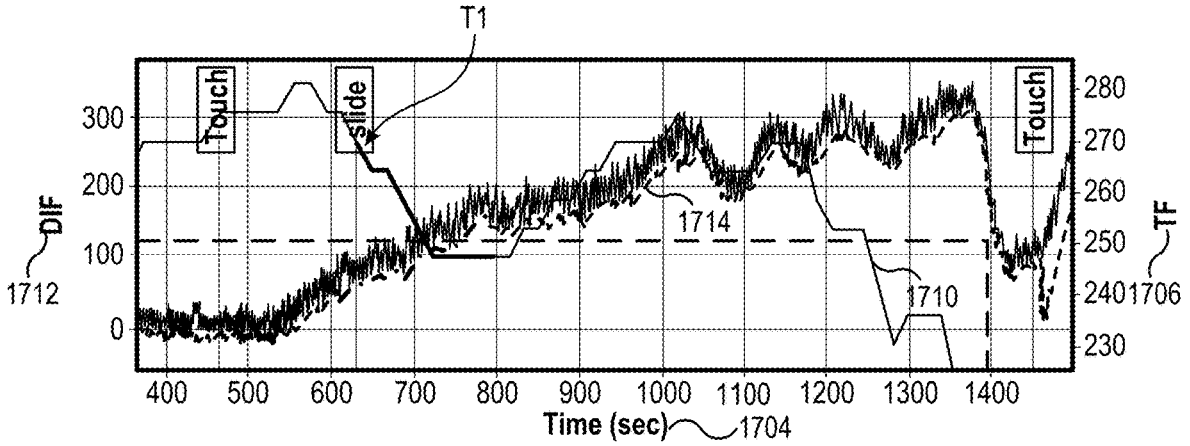
FIG. 17B illustrates a fifth exemplary plot of differential pressure and tool face over time.
Figure 17C:
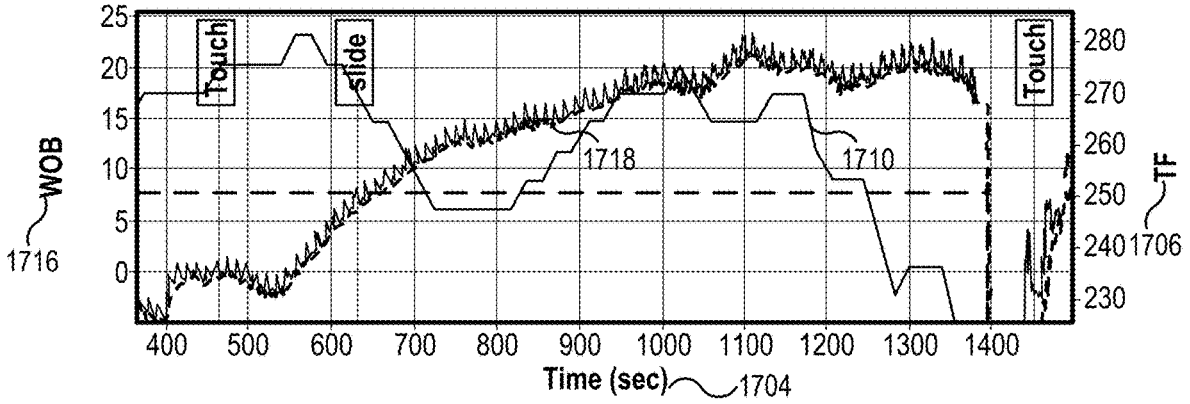
FIG. 17C illustrates a fifth exemplary plot of weight-on-bit and tool face over time.

FIGS. 17A-17C provide additional details for tool face prediction using a particular rig (e.g., HP256) at a particular depth (e.g., 15179 feet). FIG. 17A plots spindle offset 1702 and tool face 1706 over time 1704. The spindle offset plot 1708 and the tool face plot 1710 are illustrated. FIG. 17B plots differential pressure 1712 and tool face 1706 over time 1704. The differential pressure plot 1716 and tool face plot are illustrated. FIG. 17C plots weight-on-bit 1717 and the tool face 1706 over time 1704. The weight-on-bit plot 1618 and the tool face plot 1610 are illustrated.

As shown in FIGS. 17A-17C, during time $T_1$ (e.g., starting at the beginning of the slide), the differential pressure increases, and the reactive torque forces the tool face to turn counterclockwise. At time $T_2$, the spindle begins to control. At time $T_3$, the spindle control takes effect until the end of the slide.

Figure 18A:
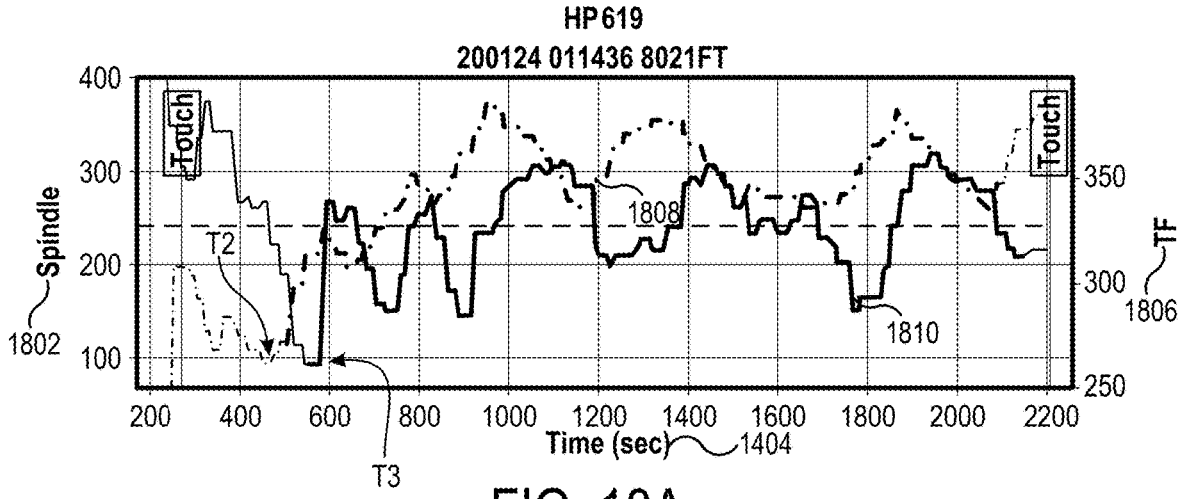
FIG. 18A illustrates a sixth exemplary plot of spindle and tool face over time.
Figure 18B:
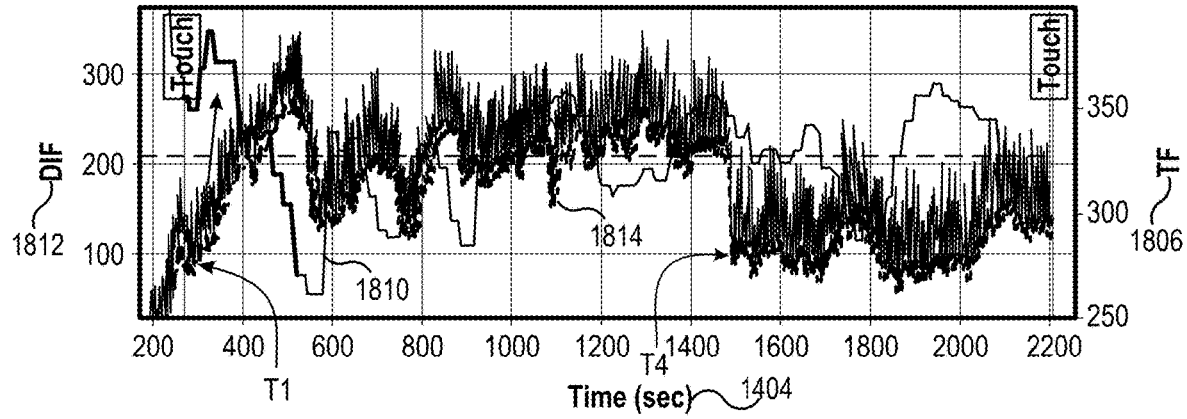
FIG. 18B illustrates a sixth exemplary plot of differential pressure and tool face over time.
Figure 18C:
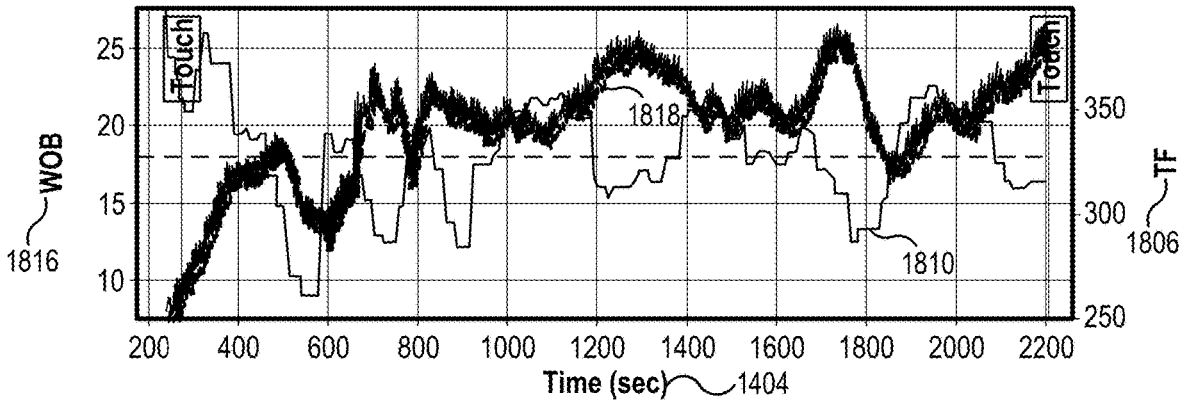
FIG. 18C illustrates a sixth exemplary plot of weight-on-bit and tool face over time.

FIGS. 18A-18C provide additional details for tool face prediction using a particular rig (e.g., HP619) at a particular depth (e.g., 8021 feet). FIG. 18A plots spindle offset 1802 and tool face 1806 over time 1804. The spindle offset plot 1808 and the tool face plot 1810 are illustrated. FIG. 18B plots differential pressure 1812 and tool face 1806 over time 1804. The differential pressure plot 1816 and tool face plot are illustrated. FIG. 18C plots weight-on-bit 1818 and the tool face 1806 over time 1804. The weight-on-bit plot 1618 and the tool face plot 1610 are illustrated.

As shown in FIGS. 18A-18C, during time $T_1$ (e.g., starting at the beginning of the slide), the differential pressure increases, and the reactive torque forces the tool face to turn counterclockwise. At time $T_2$, the spindle begins to control. At time $T_3$, the spindle control takes effect until the end of the slide. At time $T_4$, the differential pressure drops.

Figure 19A:
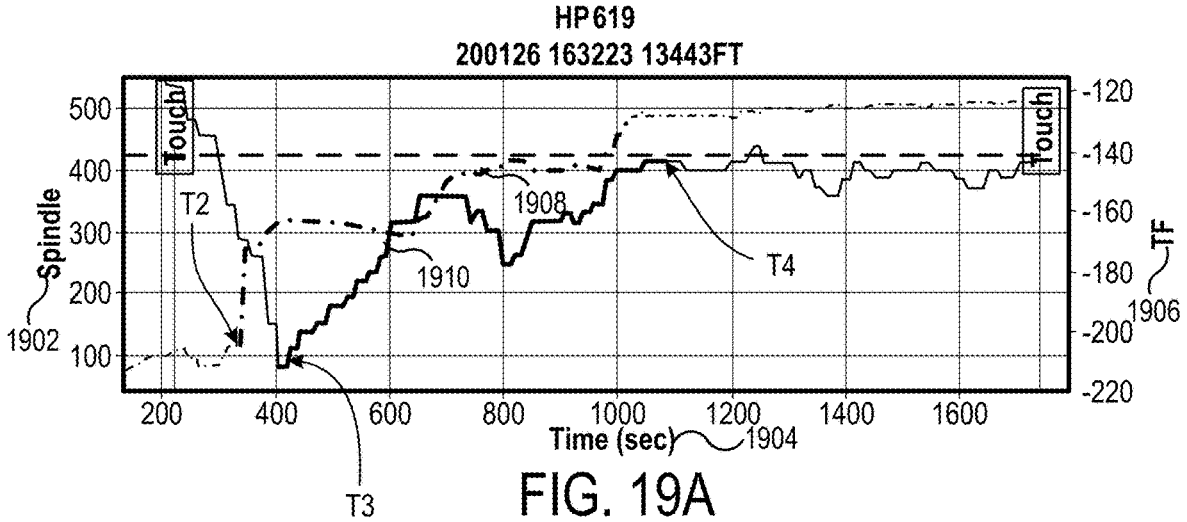
FIG. 19A illustrates a seventh exemplary plot of spindle and tool face over time.
Figure 19B:
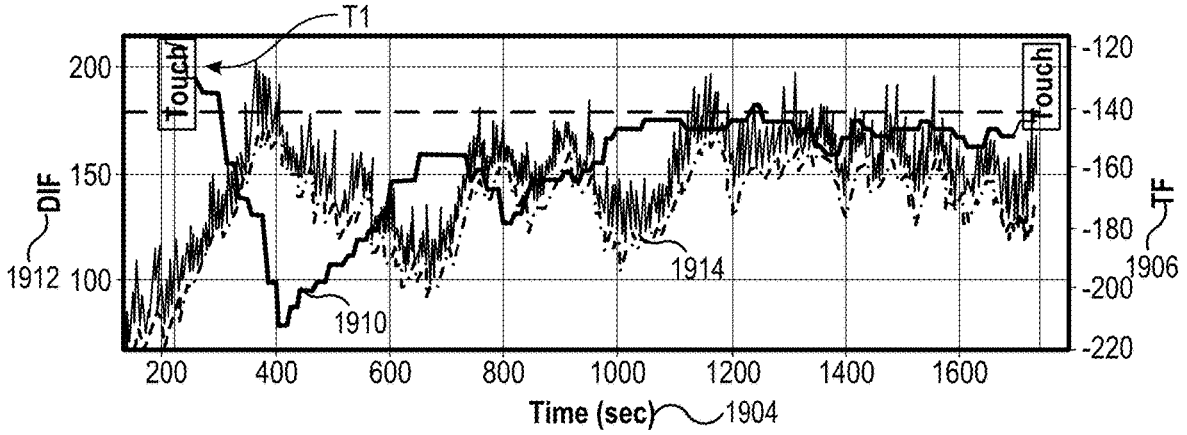
FIG. 19B illustrates a seventh exemplary plot of differential pressure and tool face over time.
Figure 19C:
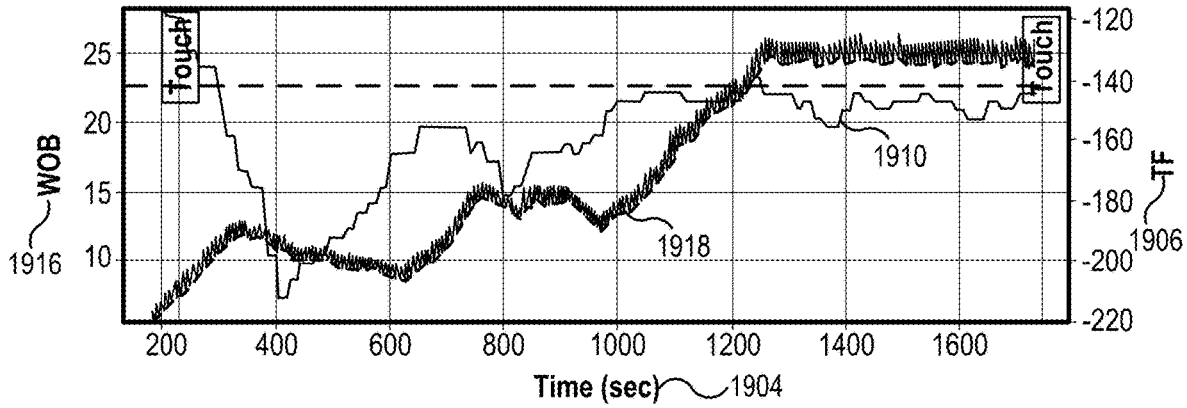
FIG. 19C illustrates a seventh exemplary plot of weight-on-bit and tool face over time.

FIGS. 19A-19C provide additional details for tool face prediction using a particular rig (e.g., HP619) at a particular depth (e.g., 8021 feet). FIG. 19A plots spindle offset 1902 and tool face 1906 over time 1904. The spindle offset plot 1908 and the tool face plot 1910 are illustrated. FIG. 19B plots differential pressure 1912 and tool face 1906 over time 1904. The differential pressure plot 1916 and tool face plot are illustrated. FIG. 19C plots weight-on-bit 1918 and the tool face 1906 over time 1904. The weight-on-bit plot 1918 and the tool face plot 1910 are illustrated.

As shown in FIGS. 19A-19C, during time $T_1$ (e.g., starting at the beginning of the slide), the differential pressure increases, and the reactive torque forces the tool face to turn counterclockwise. At time $T_2$, the spindle begins to control. At time $T_3$, after a short delay, the spindle control takes effect $T_4$.

The ability to predict a tool face in response to a change in differential pressure, and in response to a change in spindle offset, allows for reacting to that differential pressure and the spindle offset (and the inferred tool face) earlier compared to waiting to acquire the actual tool face measurement after the predetermined amount of time between measurements (e.g., 1 minute). This in turns allows for an improved control of the tool face.

For example, a method for predicting the tool face over a period of time may include acquiring spindle offset values and differential pressure values over the period of time, and using a MISO model (e.g., transfer function model) to determine the tool face prediction over the period of time.

According to various embodiments, the transfer function may also be used to create a (linear or non-linear) model predictive controller that, based on the tool face prediction, changes the control set points as well as the spindle offset. For example, a method for changing the control set points and/or spindle offset may include acquiring the tool face prediction over a period of time (for example using the method described above), adjusting the spindle offset between the tool face measurements based on the acquired tool face prediction, determining that at least one differential pressure value is above a threshold value (e.g., sufficiently large differential pressure changes have occurred), extracting the at least one differential pressure value to make spindle offset changes; and controlling the spindle offset (for example by changing the control set points and/or spindle offset) using the model predictive controller.

Tool Face Wagging Detection

Embodiments may detect tool face wagging with under-sampled tool face data. If/when the tool face wagging is detected, the drill string oscillation can be reduced for improved drilling results. When the drill pipe 144 starts oscillating, the drill sting 146 also oscillates. The rocking would then get all the way down to the drill bit 148 and may then start oscillating the drill bit 148 (referred herein as "wagging"). Ideally, the drill pipe 144 stops moving to find the least amount of friction so that the drill string 146 is advanced as fast as possible, while keeping the tool face and the drill bit 148 stationary. The problem with this effect is that the cycle time of the drill string rocking back and forth is much faster than the time periods between which tool face measurements are acquired. Accordingly, the tool face becomes under-sampled. Embodiments analyze the oscillation values for the drill string and the tool face and identify a correlation between the two.

In an exemplary scenario, during the course of sliding, the drill string 146 may get hung somewhere in the borehole 106. In order to continue the slide, the weight being hung in the borehole 106 must be released to work down to the drill bit 148. According to a first exemplary state (referred to as WOB stacking), the WOB increases while the differential pressure decreases or holds steady. In this state, the Autoslide system 514 (illustrated in FIG. 5) may need to increase the drill string rocking parameters to 'shake' the weight down to the drill bit 148. According to a second exemplary state (referred as tool face wagging), after a weight stacking event and the following 'shaking' the weight down to the bit, the drill string rocking parameters may need readjusting. If the tool face is wagging in concert with the pipe rocking, the new rocking parameters may be determined to be excessive and need to be reduced.

The difference between the spindle position and the spindle offset is the amount of change due to the oscillation. If this difference is sampled at the same time a tool face measurement is acquired, the oscillation would be down sampled. To address this issue, embodiments use a combination of frequency domain methods and time domain methods.

In the frequency domain analysis, the power spectrum of the spindle position signal and the tool face signal are determined. If the power spectrums correlate, there may be a tool face wagging event occurring. When the power spectrums are correlated, there is no need to account for the delay time between the spindle movement and the tool face movement. In the time domain analysis, the variation in the tool face is determined, including the number of times the tool face changes direction. The time domain data is used to confirm the findings on the frequency domain such that the direction change in the time domain would correspond to a spike or dip in the frequency domain.

The determination of the tool face wagging event or condition has the benefit of allowing for eliminating the oscillation upon determination that the oscillation is not desirable.

According to various embodiments, the tool face wagging may be addressed first to provide protection against bad rocking set points. It may be controlled with 2 configuration parameters: (1) tool face wag tolerance, which may be defined as the plus or minus tolerance in degrees that the tool face may move and not be considered 'wagging' (e.g., default may be set to 30 degrees), and (2) lower oscillation percent, defined as the percentage of the current number of forward and reverse wraps of oscillation that is subtracted from the current values (e.g., default may be set to 10.0 percent).

As provided above, the tool face wagging may be defined as the movement of the tool face due to the movement of the spindle excluding spindle offset adjustments. According to Shannon's Sampling Theorem, when more than two tool face measurements are received during a period of spindle oscillation (rocking), then one has enough information to determine the amount of tool face movement. If the frequency of the tool face movement matches that of the pipe rocking, then the cause of the tool face movement can be attributed to the pipe rocking. In many, if not most, cases, there are fewer than three tool face measurements per period of spindle oscillation which may be considered undersampling. In these cases, conventional signal processing methodology falls short.

Figure 20:
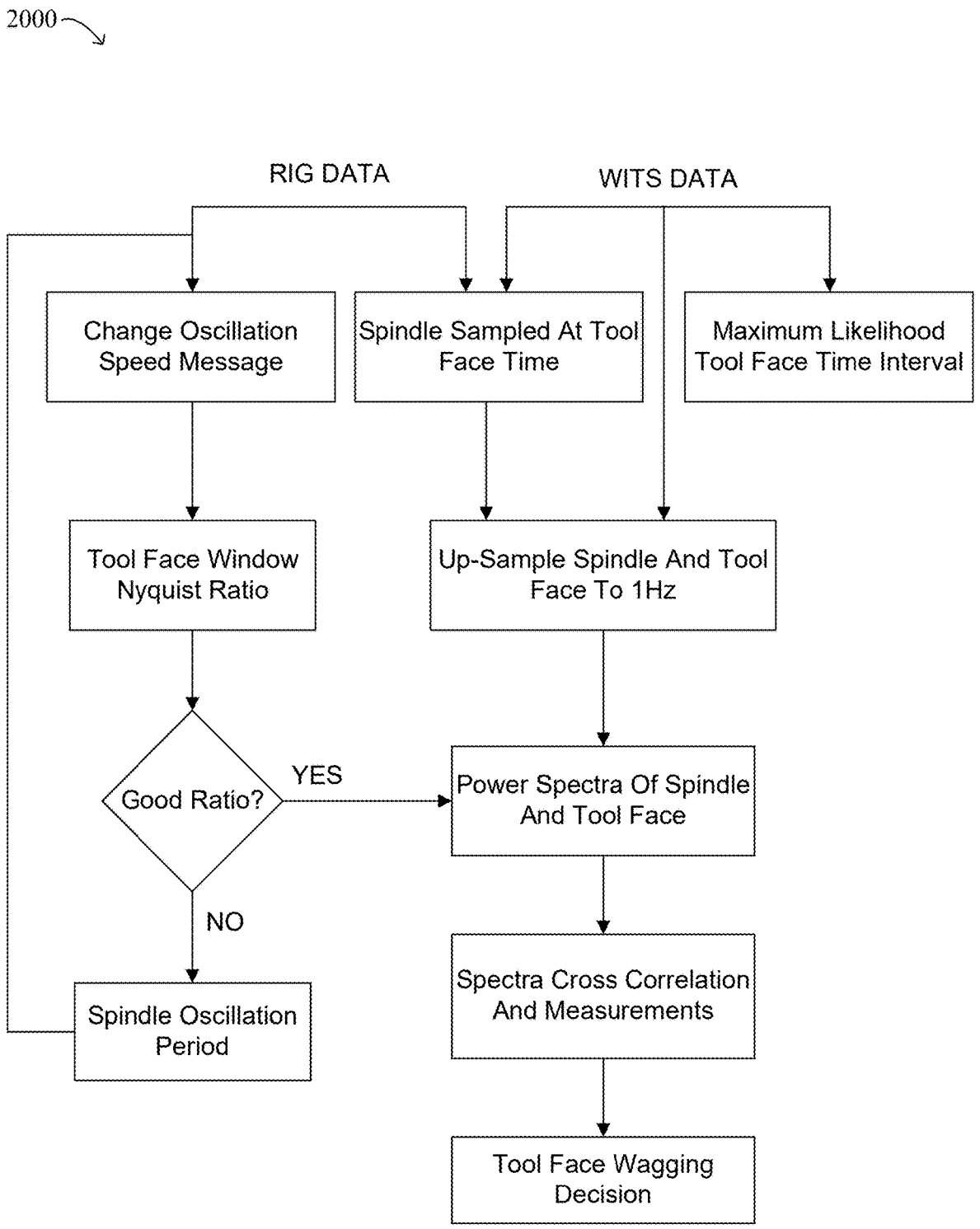
FIG. 20 illustrates a first exemplary flowchart for determining tool face wagging according to various embodiments.

FIG. 20 illustrates an exemplary flowchart 2000 for determining tool face wagging according to various embodiments. When sampling a tonal signal that sweeps from low to high frequencies, the sampled signal will be accurate as long as the frequency is less than the Nyquist frequency (e.g., ½ the sample frequency). As the tonal signal moves above the Nyquist frequency, the frequency of the sampled signal is folded over at the Nyquist frequency and moves downward to DC. Once the sampled signal reaches DC, the sampled signal is folded over again and increases back towards the Nyquist frequency. As the tonal signal continues its sweeps to even higher frequencies, this folding over process repeats. Thus, the true frequency of the tonal signal and the sampled frequency can become very different. The sampled frequency may be referred as "the perceived frequency." It is commonly known as the 'Wagon Wheel Effect.' The name comes from the old 'B' western movies where a wagon, buggy, or stagecoach would be traveling in one direction, but the wheels appeared to be rotating in the opposite direction. Mathematically, the perceived frequency (aliasedFreq) can be calculated by:

$$aliasedFreq = Math.\mathrm{abs}(centerFreq - tfSamplingFrequency * \mathrm{Math.round}(\mathrm{centerFreq}/\mathrm{tfSamplingFrequency})),$$

where centerFreq is the true frequency and tfSamplingFrequency is the sampling frequency of the tool face. Math.abs is a function that returns the absolute value and Math.round is a function that returns a value rounded to the nearest integer.

On production rigs, the time interval between tool face measurements is not constant and may vary as much as 4 to 1. Thus, the sampling time interval may be chosen to be the maximum likelihood time interval between tool face measurements and used to calculate the perceived frequency. The average period of spindle oscillation is then used to determine the true frequency. While it is possible to use the number of oscillating wraps forward and reverse along with the oscillation spindle speed to calculate the true frequency, there is enough variation in the spindle movement to make this calculation unreliable. The perceived frequency may be used to determine the time window that is large enough to contain 3 periods of perceived oscillation. This provides a time window that is long enough to sample and determine the frequency with at least a reasonable amount of accuracy and yet short enough to adapt to changes on the production rig.

Because the spindle position does not move in an ideal sine wave, the spindle position may be sampled at the same time that the tool face arrives. The tool face wagging detector tests the hypothesis that the movement in the spindle position is related to the movement in the tool face. By comparing the power spectrum of the spindle (sampled simultaneously or nearly simultaneously with the tool face), one can determine if the cause of the tool face movement is due to the spindle oscillation. In order to accommodate the varying time intervals, the spindle position and tool face signals may be up sampled to one second intervals with a zero order hold.

The Short Time Fourier Transform (STFT) is calculated over the time window from the perceived frequency calculation above. The magnitude of the Fourier transform is known as the power spectrum. The power spectrums of spindle position and the tool face are cross correlated. If Pearson's correlation coefficient >0.5, then the hypothesis that the movement in spindle position is related to the movement in tool face can be taken as true. By using the power spectrum, the delay between the spindle position and tool face movements becomes irrelevant and unnecessary. In order to reduce the number of tool faces needed to make a tool face wagging decision, the STFT has a 75% time overlap with the preceding decision.

One issue that can confuse the frequency analysis is large tool face jumps. This large energy infusion is spread across the spectrum. To overcome this, a more detailed frequency analysis may be used. The peak frequency is found in the spindle position power spectrum. Then, the spectrum is searched up from this frequency to locate the lowest frequency where the power spectrum drops by at least 3 decibels (dB). This process is repeated to find the highest 3 dB down frequency below the peak. The lowest of the 3 dB frequencies is paired with the peak frequency. Then, the power spectrum of the tool face is examined at the selected 2 frequencies and the percentage difference relative to the 3 dB frequency is computed and called the FreqPercent. If the shoulder in the tool face spectrum is strong enough along with a good correlation coefficient, then the frequency analysis can be taken to confirm the foregoing hypothesis.

A time domain approach can be used to further confirm the foregoing hypothesis and to estimate the amount of tool face wagging. The tool face measurements over the time interval are averaged and the minimum and maximum are computed for each period of oscillation about the tool face average. These minimums and maximums are averaged and used to compute the amplitude of tool face wagging. The count of minimums and maximums indicate the number of major direction changes in the tool face. Ideally, the number of major direction changes should be (2*time window*perceived frequency)/tool face sampling frequency. On production rigs, there are other forces that may cause the number of major tool face changes to vary up or down.

Figure 21:
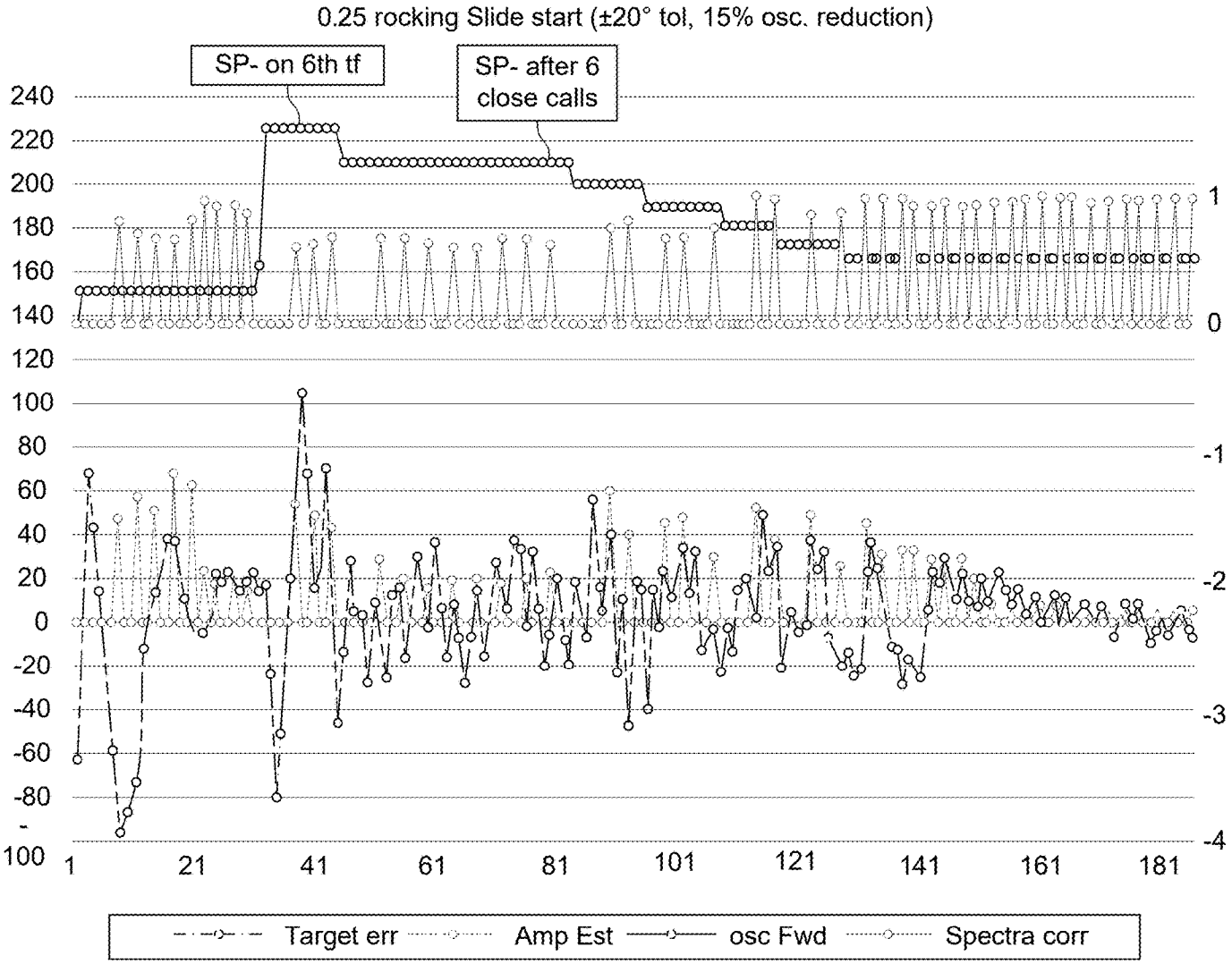
FIG. 21 is a first exemplary plot of the results of spindle oscillation reduction using the methods described herein.
Figure 22:
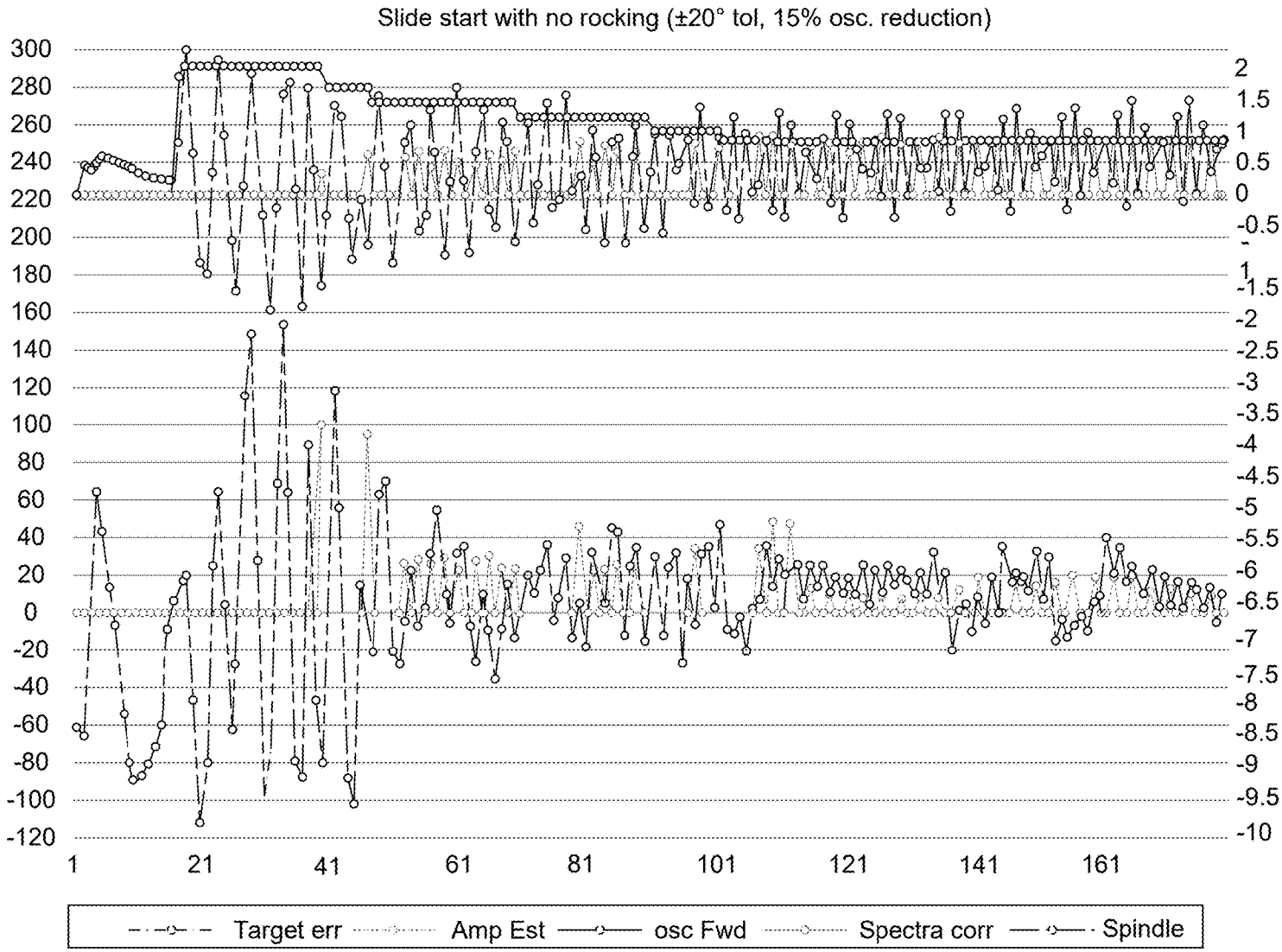
FIG. 22 is a second exemplary plot of the results of spindle oscillation reduction using the methods described herein.

FIG. 21 and FIG. 22 illustrate the results of spindle oscillation reduction using the methods described herein. FIG. 21 illustrates a 0.25 rocking slide start (with #20° tolerance and 15% oscillation reduction.) FIG. 22 illustrates a slide start with no rockling (with ±20° tolerance and 15% oscillation reduction.)

When tool face wagging is detected and the amplitude estimation exceeds tool face wag tolerance, then the forward and reverse oscillation wraps may be reduced by the percentage set by lower oscillation percent.

The Autoslide system 514 may include a WOB stacking detector. When WOB stacking has been detected, the drill string oscillation is increased to 'shake' the weight down to the drill bit 148. Accordingly, when unwanted tool face wagging is detected, the autoslide system 514 may take corrective action.

Figure 23:
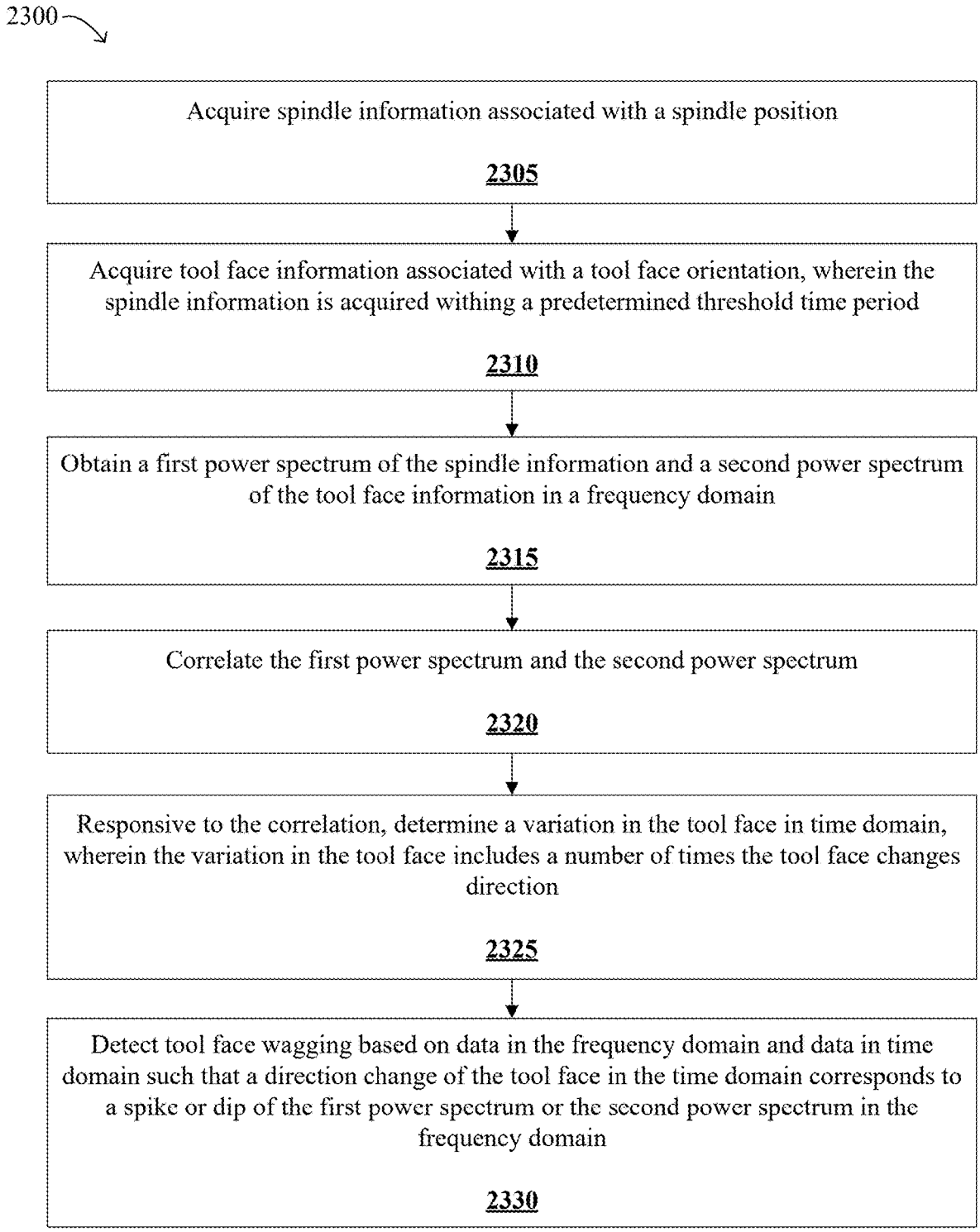
FIG. 23 illustrates a first exemplary flowchart for determining tool face wagging according to various embodiments.

FIG. 23 is a flow chart of a process 2300 for determining tool face wagging, according to an example of the present disclosure. According to an example, one or more process blocks of FIG. 23 may be performed by computing device.

At block 2305, process 2300 may include acquiring spindle information associated with a spindle position. For example, computing device may acquire spindle information associated with a spindle position, as described above.

At block 2310, process 2300 may include acquiring tool face information associated with a tool face orientation, where the spindle information is acquired withing a predetermined threshold time period. For example, computing device may acquire tool face information associated with a tool face orientation, where the spindle information is acquired withing a predetermined threshold time period, as described above.

At block 2315, process 2300 may include obtaining a first power spectrum of the spindle information and a second power spectrum of the tool face information in a frequency domain. For example, computing device may obtain a first power spectrum of the spindle information and a second power spectrum of the tool face information in a frequency domain, as described above.

At block 2320, process 2300 may include correlating the first power spectrum and the second power spectrum. For example, computing device may correlate the first power spectrum and the second power spectrum, as described above.

At block 2325, process 2300 may include responsive to the correlation, determining a variation in the tool face in time domain, where the variation in the tool face includes a number of times the tool face changes direction. For example, responsive to the correlation, the computing device may determine a variation in the tool face in time domain, where the variation in the tool face includes a number of times the tool face changes direction, as described above.

At block 2330, process 2300 may include detecting tool face wagging based on data in the frequency domain and data in time domain such that a direction change of the tool face in the time domain corresponds to a spike or dip of the first power spectrum or the second power spectrum in the frequency domain. For example, computing device may detect tool face wagging responsive to one or more direction changes of the tool face in the time domain corresponds to a spike or dip of the first power spectrum or the second power spectrum in the frequency domain, as described above.

Process 2300 may include additional implementations, such as any single implementation or any combination of implementations described below and/or in connection with one or more other processes described elsewhere herein.

In various embodiments, process 2300 further includes determining a control input to reduce the tool face wagging; and sending instructions to a controller to apply the control input.

In various embodiments, the control input may include modifying one of: weight-on-bit, rate of penetration, rotation speed, spindle position, oscillation, torque, differential pressure, and/or modifying one or more drilling operations.

In various embodiments, process 2300 may include determining a frequency of tool face wagging based on the variation in the tool face in time domain due to a movement of a spindle excluding spindle offset adjustments.

In various embodiments, process 2300 further includes comparing the determined frequency with a Nyquist frequency; and when the determined frequency is less than the Nyquist frequency, identifying the determined frequency to be accurate.

In various embodiments, process 2300 further includes acquiring a number of oscillations wraps forward and reverse for a rig; acquiring an oscillation spindle speed; and calculating a true frequency using an average period of spindle oscillations, the number of oscillation wraps forward and reverse, and the oscillation spindle speed.

In various embodiments, a computing device can include one or more memories; and one or more processors in communication with the one or more memories and configured to execute instructions stored in the one or more memories to performing operations of process 2300 as described above.

In various embodiments, a computer-readable medium storing a plurality of instructions that, when executed by one or more processors of a computing device, cause the one or more processors to perform operations of any of the methods of process 2300 as described above.

It should be noted that while FIG. 23 shows example blocks of process 2300, in some implementations, process 2300 may include additional blocks, fewer blocks, different blocks, or differently arranged blocks than those depicted in FIG. 23. Additionally, or alternatively, two or more of the blocks of process 2300 may be performed in parallel.

Return to Neutral Procedure

When the drill string oscillates, it may be necessary to adjust the spindle offset to keep the tool face from undesired oscillating. Embodiments provide a return to neutral procedure, when the drill bit is off the bottom, based on the maximum torques measured in each direction during a full oscillation cycle. According to various embodiments, a full oscillation cycle may be defined as the up-down movement of the spindle while turning in one direction (e.g., clockwise) and the down-up movement of the spindle while turning in the opposite direction (e.g., counterclockwise). The torques are monitored and compared after a full oscillation cycle is completed. An imbalance of the torques indicates a non-neutral position for the spindle (which can be considered a part of "the drill string 146" illustrated in FIG. 1). The neutral position is defined to be a position when the spindle left and right torques are substantially equal (e.g., within a predetermined tolerance range). According to various embodiments, the neutral position may be the offset point. When an imbalance of the torques is determined, the spindle offset can be adjusted to balance the torques so that they are substantially equal, and to thereby prevent the tool face from oscillating.

During a detection phase of the return to neutral procedure, the torque and the spindle position are monitored to track a full oscillation cycle. During an action phase of the return to neutral procedure, the neutral position may be corrected based on the received data.

Figure 24:
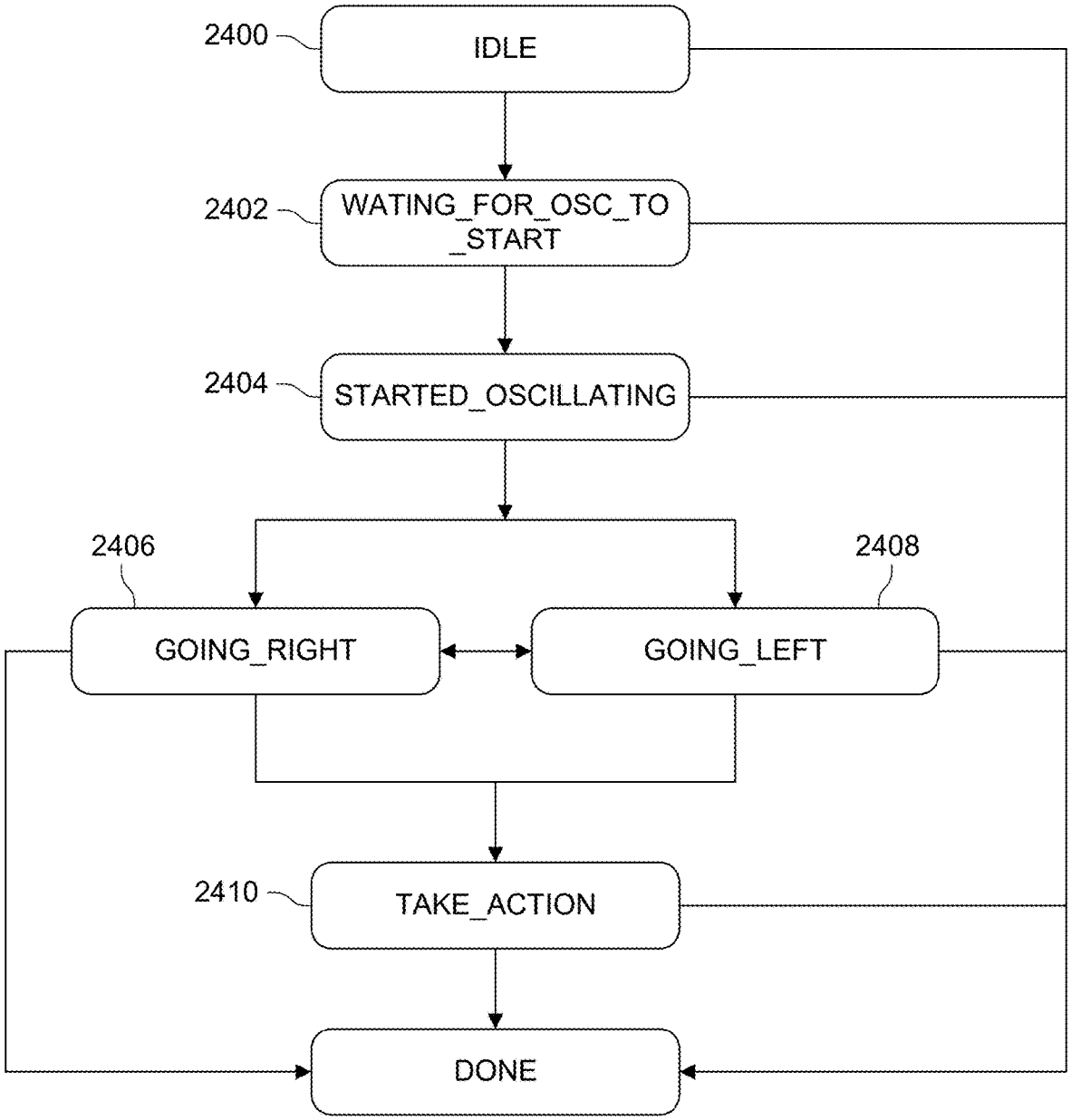
FIG. 24 illustrates a state diagram for an exemplary return to neutral procedure, according to various embodiments.

FIG. 24 illustrates a state diagram for an exemplary return to neutral procedure, according to various embodiments. The drilling system is in the idle position at step 2400. When the system is put in control, then the system starts waiting for oscillation to start at step 2402. When the oscillation is detected at step 2404, the drilling system determines if the movement is to the left (step 2406) or to the right (step 2408). According to various embodiments, the movement in each direction (e.g., "going left" and "right") is monitored for a predetermined number of switches between directions until it is determined that a full period has been observed. Once the predetermined number of switches from left to right have been made, and a full period of data is collected, the return to neutral procedure is placed in an action mode, at step 2410. At step 2410, the spindle offset due to a misaligned neutral is computed and a spindle adjustment is recommended (or automatically implemented). According to various embodiments, the full period of data (e.g., torque and spindle data) may be analyzed to determine the offset from neutral. In some embodiments, the recommended spindle adjustment may be automatically implemented. When the process is done, the rest of the system proceeds with its normal functioning.

Figure 25:
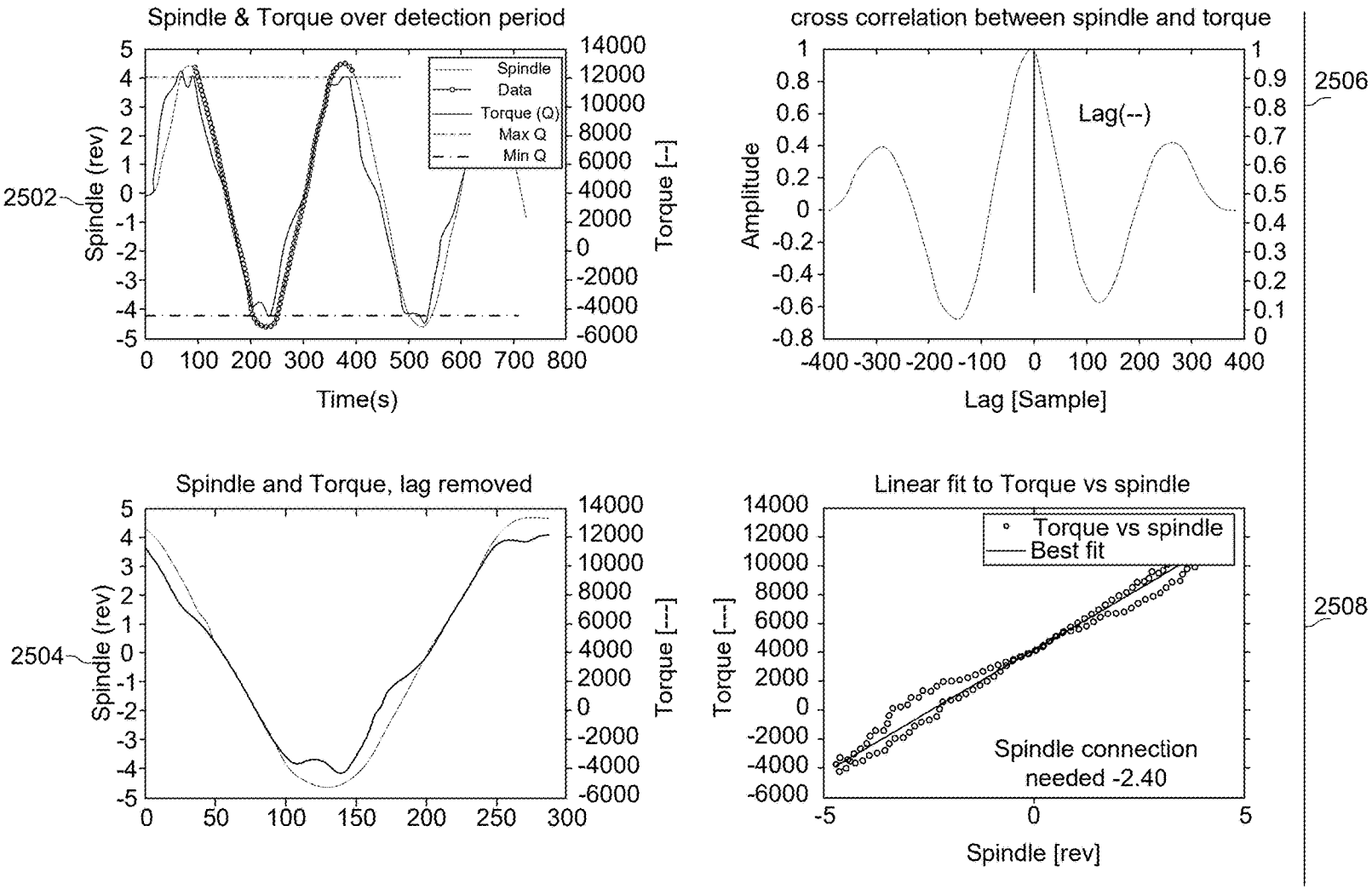
FIG. 25 illustrates a set of graphs illustrating identifying the spindle offset from a neutral position, according to various embodiments.

FIG. 25 illustrates a set of graphs illustrating identifying the spindle offset from a neutral position, according to various embodiments. According to an exemplary embodiment, the full period of data (e.g., torque and spindle data as illustrated in graph 2502 of FIG. 25) may be analyzed to determine the offset from neutral via a least-squares fit (or other curve fitting techniques). The process includes removing the mean from torque data and spindle data signals; computing the time lag by examining the peak from cross-correlation between torque data and spindle data (as shown in graph 2506); aligning spindle and torque data by removing the time lag (as shown in graph 2504); modeling the relationship between lag corrected spindle offset and torque with a first order linear regression model having a slope constant k and offset b as model coefficients; deriving slope constant, k, and offset, b, and their associated statistics by computing least squares regression (as shown in graph 2508); and performing validity checks by enforcing thresholds (minimum correlation coefficient, minimum correction, maximum correction, and correction relative to error estimate is large).

The graph 2508 illustrates the linear relationship, F(x) =k*x+b, where F is lag corrected torque, and x is lag corrected spindle. Coefficients k and b may be estimated from a full period and the total spindle offset may be determined by solving for F(x)=0:

$$F(x) = k * x + b = 0$$

$$k * x = -b$$

$$x = -b/k$$

This identifies the point on the line where the spindle offset sets the torque in balance. So, if the oscillator offset is shifted to that position, the oscillation offset should align with the neutral point for torque oscillation. Since the initial oscillator offset always starts at 0 (it gets tared every time the oscillator is turned on), b/k may be subtracted from the offset to ensure that the offset term b is removed.

Once identified, the spindle offset is adjusted to balance the torques, and to prevent the tool face from oscillating.

Figure 26:
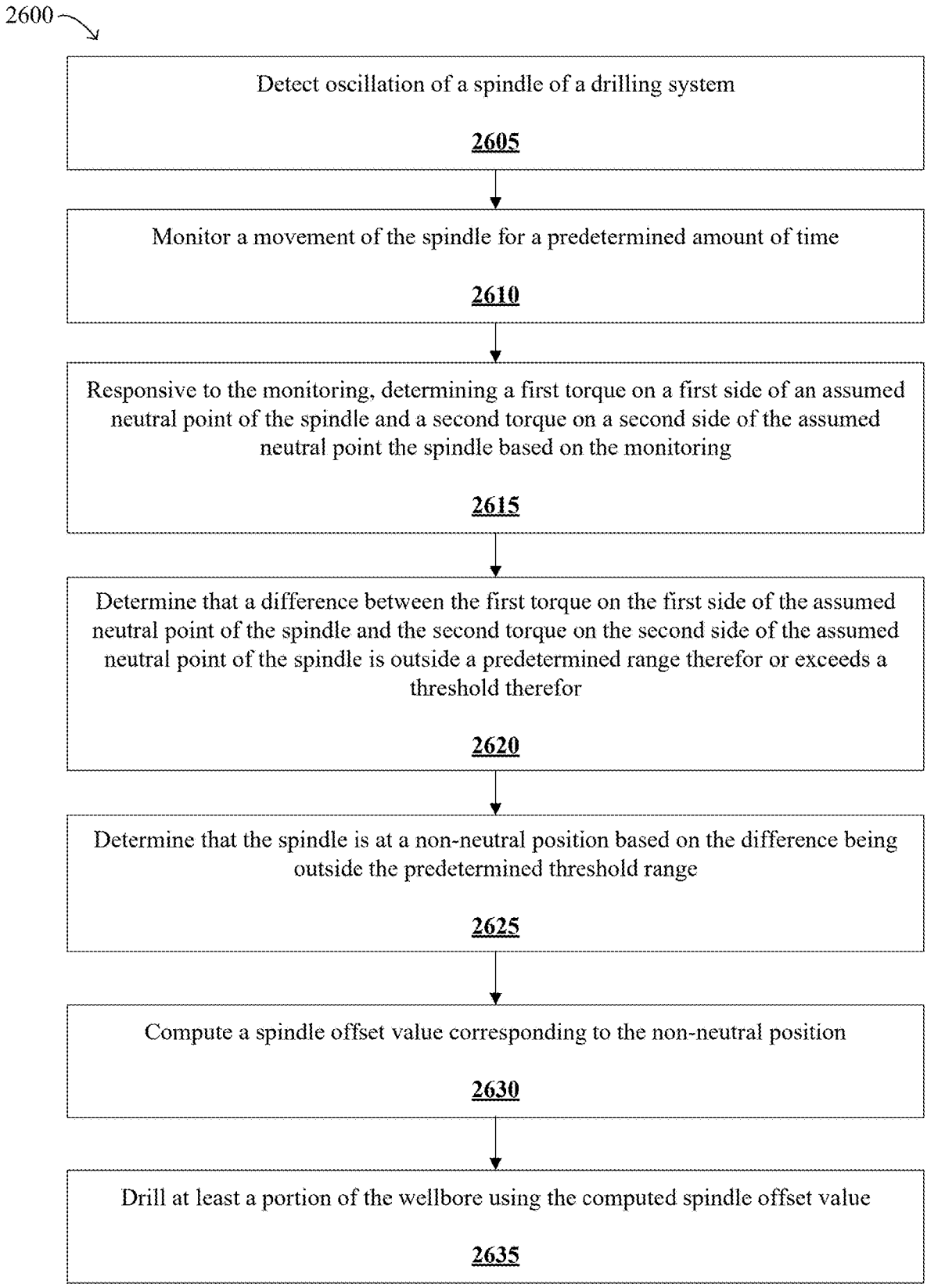
FIG. 26 illustrates an exemplary flowchart for determining a return to neutral according to various embodiments.

FIG. 26 is a flow chart of a process 2600 for drilling with a neutral position for a spindle of a drilling system, according to an example of the present disclosure. According to an example, one or more process blocks of FIG. 26 may be performed by computing device.

At block 2605, process 2600 may include detecting oscillation of a spindle of a drilling system. For example, computing device may detect oscillation of a spindle of a drilling system, as described above.

At block 2610, process 2600 may include monitoring a movement of the spindle for a predetermined amount of time. For example, computing device may monitor a movement of the spindle for a predetermined amount of time, as described above.

At block 2615, process 2600 may include responsive to the monitoring, determining a first torque on a first side of an assumed neutral point of the spindle and a second torque on a second side of the assumed neutral point the spindle based on the monitoring. For example, computing device may be responsive to the monitoring, determine a first torque on a first side of an assumed neutral point of the spindle and a second torque on a second side of the assumed neutral point the spindle based on the monitoring, as described above.

At block 2620, process 2600 may include determining that a difference between the first torque on the first side of the assumed neutral point of the spindle and the second torque on the second side of the assumed neutral point of the spindle is outside a predetermined range therefor or exceeds a threshold therefor. For example, computing device may determine that a difference between the first torque on the first side of the assumed neutral point of the spindle and the second torque on the second side of the assumed neutral point of the spindle is outside a predetermined range therefor or exceeds a threshold therefor, as described above.

At block 2625, process 2600 may include determining that the spindle is at a non-neutral position based on the difference being outside the predetermined threshold range. For example, computing device may determine that the spindle is at a non-neutral position based on the difference being outside the predetermined threshold range, as described above.

At block 2630, process 2600 may include computing a spindle offset value corresponding to the non-neutral position. For example, computing device may compute a spindle offset value corresponding to the non-neutral position, as described above.

At block 2635, process 2600 may include drilling at least a portion of the wellbore using the computed spindle offset value. For example, computing device may drill at least a portion of the wellbore using the computed spindle offset value, as described above.

Process 2600 may include additional implementations, such as any single implementation or any combination of implementations described below and/or in connection with one or more other processes described elsewhere herein.

In various embodiments, process 2600 may include recommending a spindle adjustment to align the spindle at a neutral position to reduce oscillation of a tool face.

In various embodiments, process 2600 may include automatically implementing a spindle adjustment to align the spindle at a neutral position to reduce oscillation of a tool face.

In various embodiments, a full oscillation cycle is defined as an up or down first movement of the spindle while turning in one direction and a second movement in an opposite direction.

In various embodiments, a neutral position is an offset point.

In various embodiments, the first torque on the right side of the assumed neutral point of the spindle and the second torque on the second side of the assumed neutral point of the spindle are within a predetermined threshold of being equal.

In various embodiments, a computing device can include one or more memories; and one or more processors in communication with the one or more memories and configured to execute instructions stored in the one or more memories to performing operations of process 2300 as described above.

In various embodiments, a computer-readable medium storing a plurality of instructions that, when executed by one or more processors of a computing device, cause the one or more processors to perform operations of any of the methods of process 2300 as described above.

It should be noted that while FIG. 26 shows example blocks of process 2600, in some implementations, process 2600 may include additional blocks, fewer blocks, different blocks, or differently arranged blocks than those depicted in FIG. 26. Additionally, or alternatively, two or more of the blocks of process 2600 may be performed in parallel.

Spindle Reaction Time Estimation

Spindle reaction time estimation may be used to determine an integration time constant for autotuning a controller of the control system (e.g., a proportional integral controller). The spindle reaction time estimation aims to estimate the delay time between the movement by the spindle offset to the tool face responding (e.g., how long does it take to see a tool face change when the spindle offset is changed). According to various embodiments, the tool face value may be affected by multiple variables including the control from the spindle.

In some embodiments, a single-input-single-output (SISO) model may be used to determine the correlation between the tool face and the spindle. In such embodiments, the spindle may be considered as the major controller to the tool face during certain periods of time within a slide. For example, the spindle offset may be the input u (t) of the model and the tool face may be the output y (t). A black box transfer function may be identified to define the relationship between u (t) and y (t). In other embodiments, the model may be a MISO model, which may have another control input involved, such as differential pressure for example.

Figure 27:
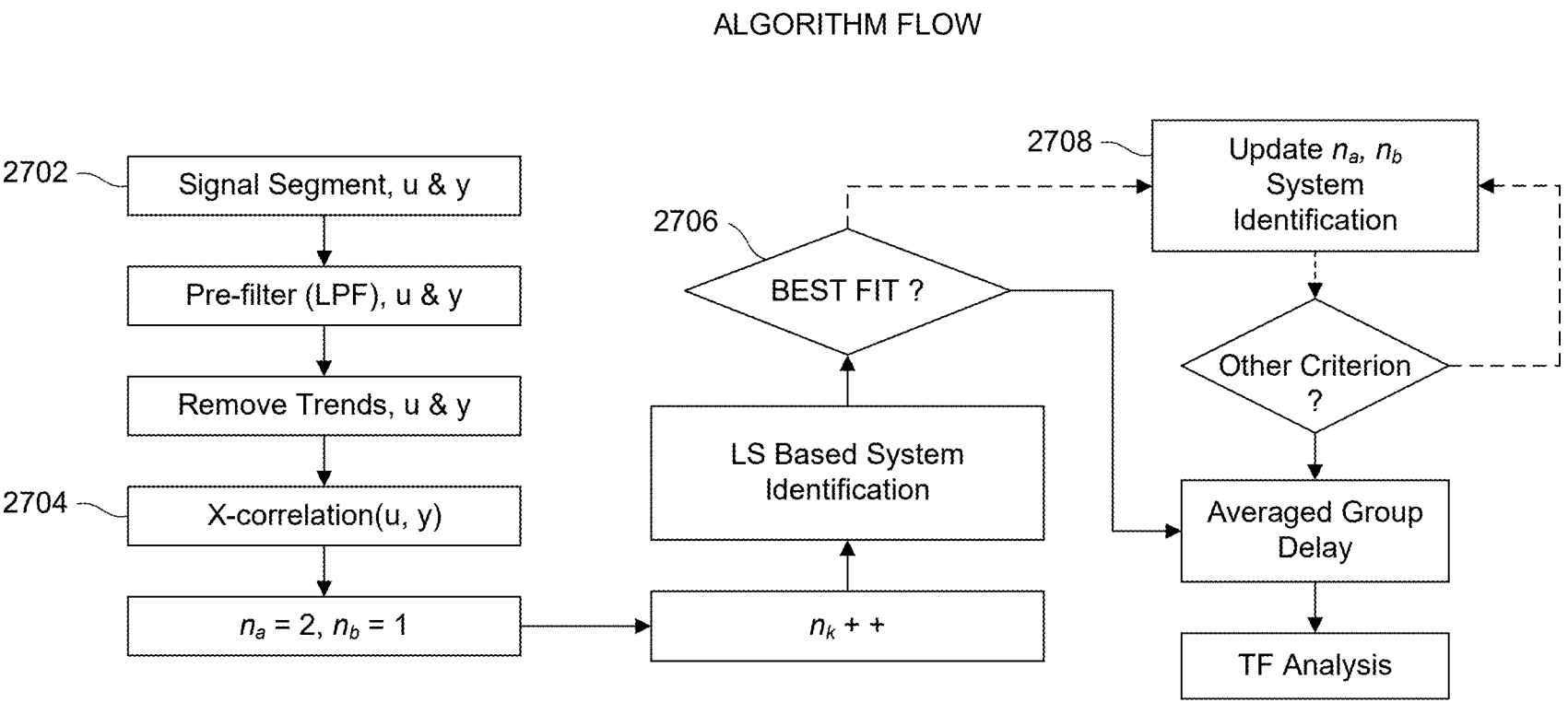
FIG. 27 illustrates an exemplary algorithm for estimating spindle reaction time using a linear model, according to various embodiments.

FIG. 27 illustrates an exemplary algorithm for estimating spindle reaction time using a linear model, according to various embodiments. At step 2702, a number of spindles offset changes u (t) and tool face changes y (t) may be observed during a period of time, for example depending on the drilling depth. At step 2704, segments of the observed signals (e.g., the spindle signal and the tool face signal) separated by a window moving along the time axis may then be correlated using a cross-correlation algorithm. The segment producing the highest cross-correlation amplitude at certain time lags are extracted from the observed signal. Spindle offset and tool face changes have the highest correlation between each other in this segment, i.e., spindle offset is treated as the major controller for the tool face change in this segment. At step 2706, the model giving the best fit is selected to represent the transfer function from spindle offset to tool face change. The group delay time of the selected linear model is determined as the spindle reaction time.

In some embodiments, a recursive least square algorithm may be used to find the best fit among multiple model candidates having different time delay. The recursive least square based approach may track the transfer function dynamically. When a valid signal segment is extracted from each slide using the cross-correlation, the estimation is performed using linear and/or non-linear approaches.

The linear method may be described as:

Measurements $$\varphi = [y(t-1), \ldots, y(t-n), u(t-1), \ldots, u(t-n)]^T$$

Represent the System by
A Linear Difference Equation $$y(t) + a_1 y(t-1) + \ldots + a_n y(t-n_a) = b_1 u(t-n_k) + \ldots + b_m u(t-n_b-n_k) + \mathrm{DC} + v(t)$$

Model Order, and its Representation in z Domain $$n_a Y(z)\cdot\left(1 + a_1 z^{-1} + \ldots + a_{n_a} z^{-n_a}\right)$$

$$n_b Y(z)\cdot\left(b_1 z^{-1} + \ldots + b_{n_b} z^{-n_b}\right)$$

$$n_k z^{-n_k}$$

Objective Vector to be Estimated $$\theta = \left[a_1, \ldots, a_{n_a}, b_1, \ldots, b_{n_b}, DC\right]^T$$

Least Square Criterion $$\hat{\theta} = \arg\min_{\theta} \frac{1}{N}\sum_{t=1}^{N}(y(t) - \hat{y}(t))^2, \text{ where } \hat{y}(t) = \varphi(t)\theta$$

Figure 28:
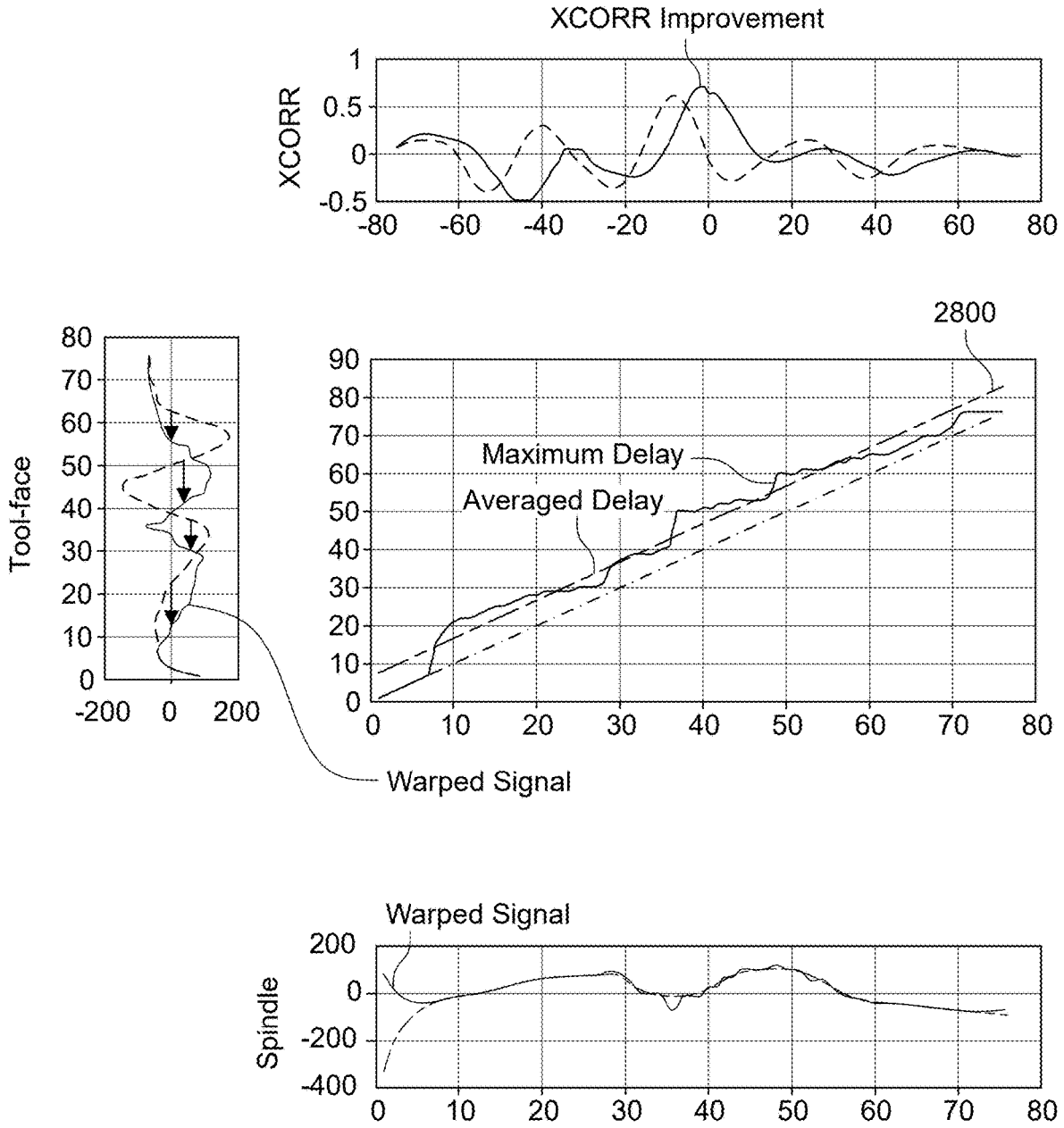
FIG. 28 illustrates estimating spindle reaction time using a dynamic time warping (DTW) model, according to various embodiments.

FIG. 28 illustrates an exemplary algorithm for estimating spindle reaction time using a dynamic time warping (DTW) model, according to various embodiments. The DTW method may increase the similarity between the two time series representing the tool face and the spindle, respectively. The estimation with dynamic time warping method may include non-linear stretching of the tool-face signal to make it aligned with the spindle signal, calculating the delay time between the two signals based on the warping path deviation amount from the diagonal line 2700 in FIG. 27.

According to various embodiments, the final delay may be determined based on a combination of the estimation with linear method and the estimation with dynamic time warping method.

Figure 29:
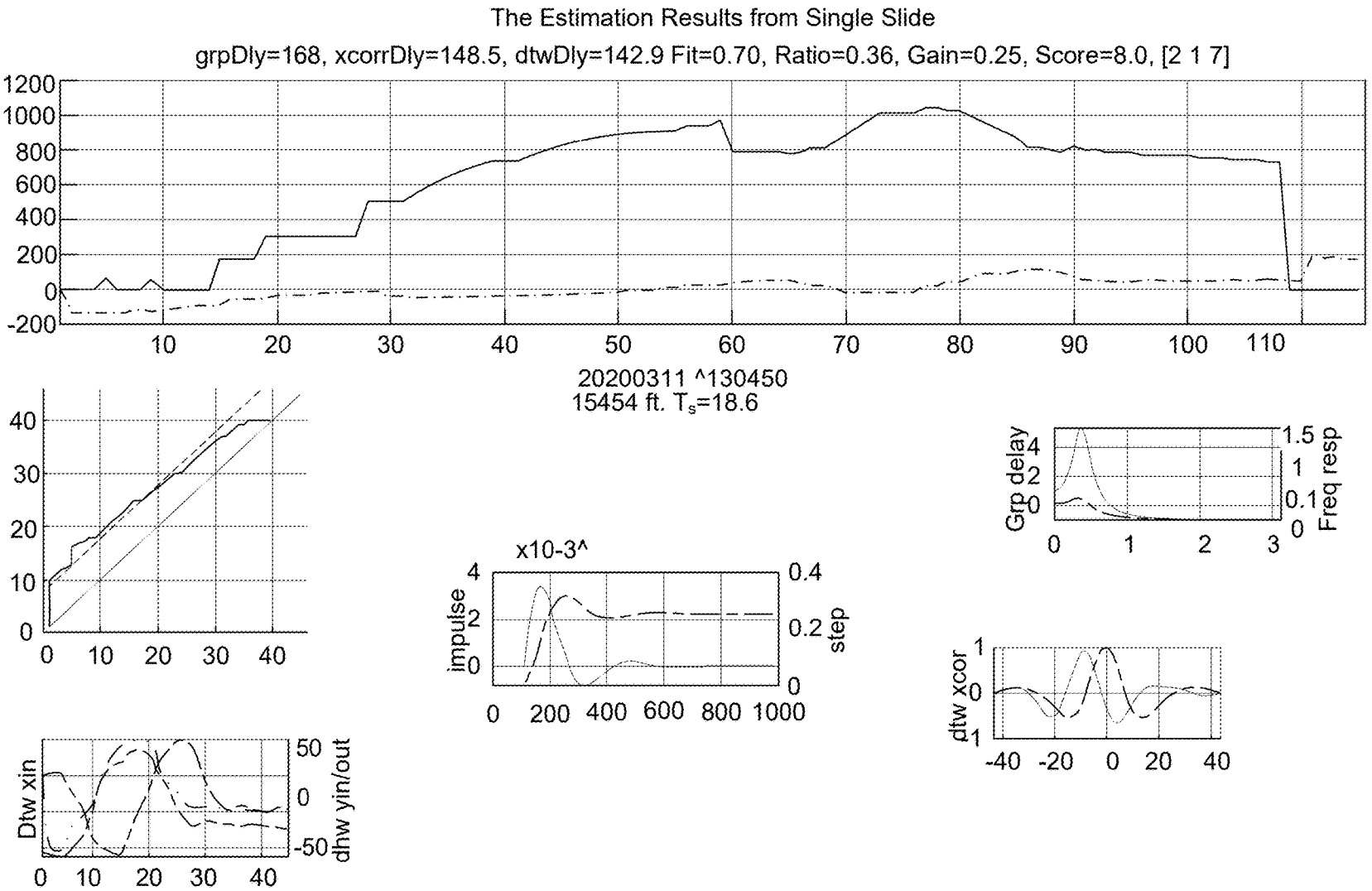
FIG. 29 illustrates spindle reaction time estimation results in a single slide according to various embodiments.

FIG. 29 illustrates spindle reaction time estimation results in a single slide according to various embodiments.

Figure 30:
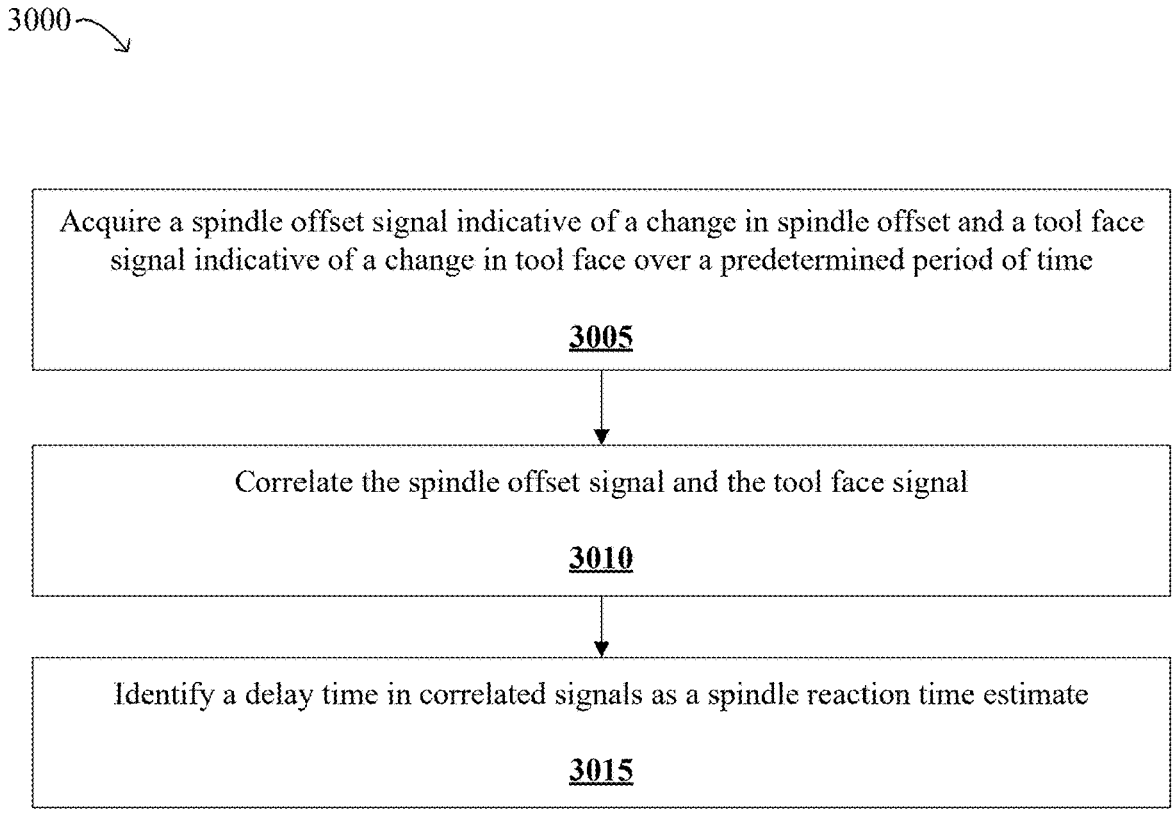
FIG. 30 illustrates an exemplary flowchart for estimating spindle reaction time according to various embodiments.

FIG. 30 is a flow chart of a process 3000 for estimating spindle reaction time to a tool face change, according to an example of the present disclosure. According to an example, one or more process blocks of FIG. 30 may be performed by computing device.

At block 3005, process 3000 may include acquiring a spindle offset signal indicative of a change in spindle offset and a tool face signal indicative of a change in tool face over a predetermined period of time. For example, computing device may acquire a spindle offset signal indicative of a change in spindle offset and a tool face signal indicative of a change in tool face over a predetermined period of time, as described above.

At block 3010, process 3000 may include correlating the spindle offset signal and the tool face signal. For example, computing device may correlate the spindle offset signal and the tool face signal, as described above.

At block 3015, process 3000 may include identifying a delay time in correlated signals as a spindle reaction time estimate. For example, computing device may identify a delay time in correlated signals as a spindle reaction time estimate, as described above.

Process 3000 may include additional implementations, such as any single implementation or any combination of implementations described below and/or in connection with one or more other processes described elsewhere herein. A first implementation, process 3000 may include tuning a spindle controller based on the spindle reaction time estimate.

In various embodiments, process 3000 may include varying a timing or a magnitude of a control input for a drilling rig based at least in part of the estimated spindle reaction time.

In various embodiments, the correlating the spindle offset signal and the tool face signal is performed using a single-input single-output model and the spindle offset signal is an input of the single-input single-output model and a tool face value is an output of the single-input single-output model.

In various embodiments, the correlating the spindle offset signal and the tool face signal is performed using a multiple-input single-output model.

In various embodiments, a computing device can include one or more memories; and one or more processors in communication with the one or more memories and configured to execute instructions stored in the one or more memories to performing operations of process 2300 as described above.

In various embodiments, a computer-readable medium storing a plurality of instructions that, when executed by one or more processors of a computing device, cause one or more processors to perform operations of any of the methods of process 2300 as described above.

Differential Pressure Signal Determination

During drilling of wells, the monitored/measured operational parameters usually include differential pressure measurements. Differential Pressure is the pressure of the drilling fluid across the mud motor and is sometimes referred to as DP or AP. In some cases, mud pulses may affect the differential pressure measurements. In an ideal world, the mud pulses would not affect the differential pressure and the measured signal would be the true signal. However, in practice the mud pulses can and do affect the differential pressure, and so a way of filtering out the mud pulses is needed. The traditional linear filtering techniques are not sufficient to filter out the mud pulses. For example, a filter with a low enough frequency bandwidth may be used to get rid of the 100 PSI mud pulses. However, in that case the differential pressure spikes may also be filtered, and it may not be possible to identify an important problem occurring at the rig that a spike in differential pressure might indicate. In addition, conventional systems and methods typically set the zero differential pressure point manually based on historic data of the well.

Embodiments of the present disclosure enable keeping the rapid differential pressure changes while filtering out the rapid changes due to the mud pulses. An application of this embodiment is used to tare the mud pressure, commonly referred to as zeroing the differential pressure by using the time when the sensor-obtained mud pressure and the filtered mud pressure (without mud pulses) are near zero. This application of zeroing between mud pulses enables accurate zeroing when the conventional linear filtering and smoothing techniques fail.

Embodiments provide a bottom envelope filter that tracks the low spots between the mud pulses (e.g., mud pulses at 20 psi) and drifts up during the mud pulse therefore effectively filtering the differential pressure measurements. The filter is able to capture the differential pressure changes while greatly reducing the pressure caused by the mud pulses.

Due to the unknown conditions in the bore hole, the air pressure outside the standpipe (e.g., pressure at the bottom of the well, pressure around drill bit) cannot be measured with certainty. Since the standpipe pressure can be measured, this pressure can be considered as the reference pressure, also known as the "zero pressure point." The differential pressure may then be defined as the difference between the pressure reading and the reference pressure/the zero pressure point. The differential pressure may indicate the pressure measurement in the mud motor. Using the pressure in the mud motor, one can determine the torque that the mud motor is applying to the rock that is being drilled.

The standpipe pressure and the bottom envelope filter may be used together to determine when to measure the differential pressure such that the mud pulse signal may be eliminated from the differential pressure reading/measurement. According to various embodiments, the timing to measure the differential pressure may be when the data output by the bottom envelope filter is closest to the actual data. This time would indicate that there are minimal mud pulses in the actual data. Therefore, the measured differential pressure at that time will lead to the most accurate differential pressure determination (e.g., the differential pressure without mud pulse component). Accordingly, the differential pressure may be measured when a difference between the acquired standpipe pressure signal and the filtered standpipe pressure signal is less than a predetermined threshold or within an acceptable range therefor.

Embodiments of the present disclosure allow automatically setting the zero pressure point using the standpipe pressure readings and the bottom envelope filter. A comparison between the output of the bottom envelope filter and the raw data indicates the right time to capture the differential pressure so as to minimize the impact of the mud pulses.

Figure 31:
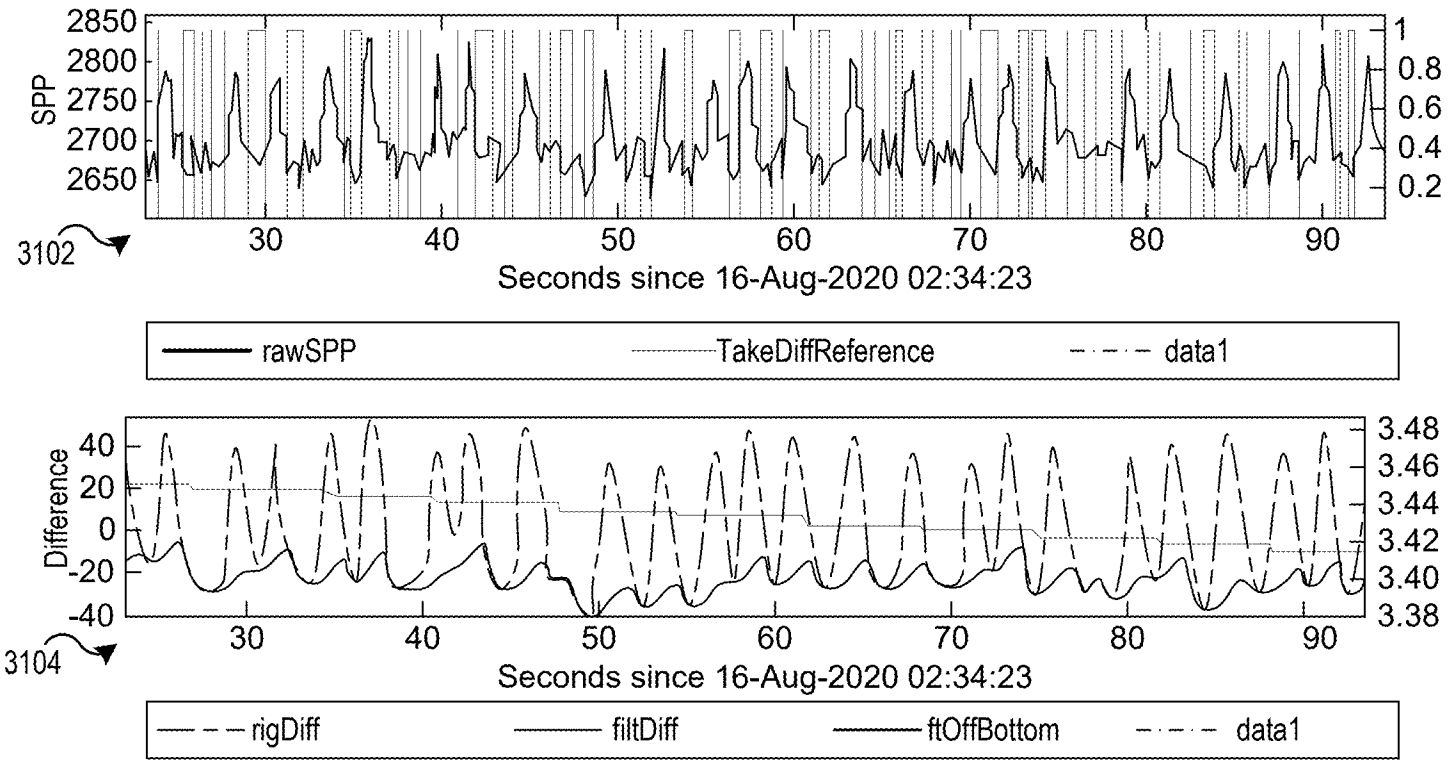
FIG. 31 illustrate a first plot of data using an AutoSlide tool and corresponding filter according to various embodiments.
Figure 32:
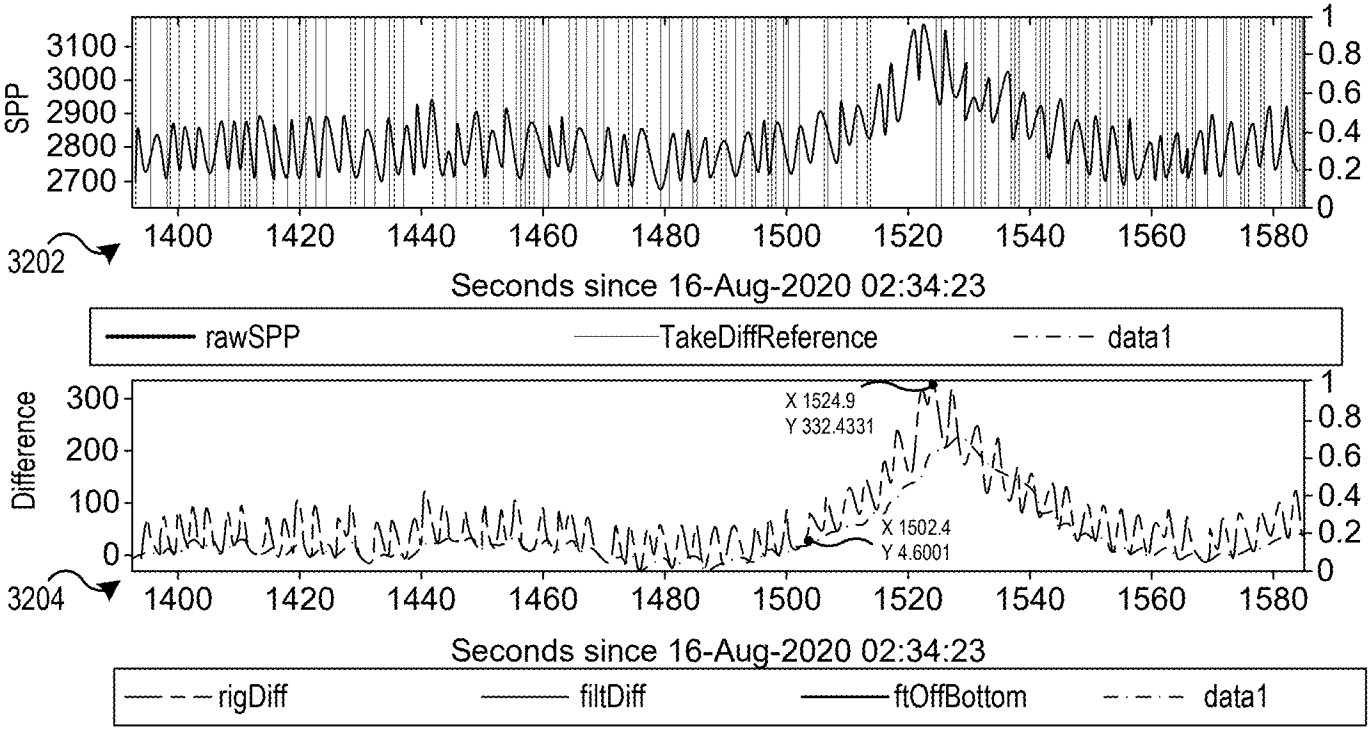
FIG. 32 illustrate a second plot of data using an AutoSlide tool and corresponding filter according to various embodiments.

FIGS. 31-32 illustrate data using AutoSlide and corresponding filter according to various embodiments. FIG. 31 illustrates 60 seconds at the start of a slide at 8,630 ft. The top plot 3102 illustrates standpipe pressure (SPP) signal over time. The bottom plot 3104 illustrates a difference in slide data between rig data and filtered data.

The top plot 3102 shows TakeDiffReference being a logical '1' during the troughs between mud pulses in the standpipe pressure (SPP) signal. The standpipe pressure reference value was chosen to be 2,651 psi. With MudPulseFilter config='auto,' the filterDiff was chosen because the AvgMudPulse Peak is 63.4 psi. The second plot 3104 compares the differences between filterDiff and rigDiff. During the analysis, the bit was 3.4 feet above the bottom. This example shows both the ability to select precise moments to zero the differential pressure as well as the ability of the "auto" mode to determine that the rigDiff has too much mud pulse information passing through the filter and to choose the filtDiff signal instead.

FIG. 32 illustrates data from the same rig and slide and examines a differential pressure spike 25 minutes into the slide. The top plot 3202 illustrates standpipe pressure (SPP) signal over time. The bottom plot 3204 illustrates a difference in slide data between rig data and filtered data. Depending upon the times that the tool face measurement is received by the system, the change in differential pressure could be as high as 328 psi as measured by rigDiff as shown in FIG. 32 where the tool face interval is 22.5 seconds. Depending upon the times that the tool face measurement is received by the system, the change in differential pressure could be as low as 137 psi as measured by rigDiff as shown in FIG. 32 where the tool face interval is 22.5 seconds. Thus, the same differential pressure spike can be reported anywhere between 137 psi and 328 psi. Using the filtDiff signal, the uncertainty is reduced with a reported differential pressure spike ranging between 183 psi and 209 psi with the same exact tool face timing as the rigDiff examples. The differential pressure change uncertainty with the rigDiff signal is 191 psi while the filtDiff uncertainty drops dramatically to 26 psi. In both cases, the change in differential pressure during one or two tool face measurement intervals is large enough to be confident that a differential pressure spike occurred.

The mud pulses pass through the filter and leak into and combine with the rigDiff signal, allowing one to easily see the 80 psi mud pulses. The filtDiff does a good job of tracking the baseline of the rigDiff and reduces the ripple from the mud pulses to only 24 psi.

According to various embodiments, the differential pressure data may be illustrated on a user interface (UI). For example, the UI may illustrate a snapshot of the rigDiff signal to be displayed as the differential pressure on the UI for each tool face. A snapshot of the rigDiff introduces a large, sometimes dramatic uncertainty in the true value of the differential pressure. The sampling of differential pressure only when a tool face arrives can be misleading. Large differential pressure changes from one tool face to the next are highly disruptive events. Embodiments address this and other issues.

An exemplary algorithm for determining the differential pressure without the mud pulses is provided below. The exemplary algorithm has three components:

TakeDiffZero is the Boolean value for AutoSlide to use to gate when automatically zeroing the differential pressure (diff). The Boolean value will be true when the standpipe pressure is in the trough between mud pulses. The Boolean value will be false during the mud pulse. This value can be logically 'ANDed' with the other conditions in the Back to Bottom logic used by the Autoslide system to automatically determine when to issue the ZeroDiff command. The value is computed for every input of the Mud Standpipe Pressure signal (SPP) from the rig every 100 milliseconds (ms).

A BottomFollower method can calculate the TakeDiffZero value. The process can initialize the function at the beginning of each slide and a process loop can be used up calculate each individual instance of TakeDiffZero in real-time. The data being operated on, dataIn, is the SPP signal from the rig. A BottomFollower method essentially is a $1^{st}$ order non-linear filter. At each iteration of the process loop, the filter coefficient can be chosen between exp(−1/1.9) and exp(−1/0.24), depending on the comparison result between the amplitude of filter output from last iteration and the current dataIn amplitude.

The second component uses the same BottomFollower method to compute the alternative to the rigDiff signal called filterDiff. The difference from the first component is that the data being operated on, dataIn, is the rigDiff signal from the rig. This accomplishes an alternative signal (filterDiff) to the AutoDriller Diff Pressure Value signal (rigDiff) which is cleaner and does not fluctuate with the mud pulses.

The third component is the logic that determines when AutoSlide can use the rigDiff signal generated by the rig or the filterDiff signal computed within AutoSlide. One additional configuration parameter can be created-MudPulseFilter with 3 values. If the value is ON, the system can use the filterDiff values computed by AutoSlide. If the value is OFF, the system can use the rigDiff values supplied by the rig. If the value is AUTO, then the system analyzes the first 60 seconds of rigDiff data from the moment that AutoSlide is in control to determine which AutoDriller is being used and selects whether to use the rigDiff or filterDiff by the amount of mud pulse leakage in the rigDiff data.

When MudPulseFilter config is 'AUTO,' the value of avgMudPulse computed with rigDiff (component 2) is tested once 60 seconds after Motive in Control is activated. If the avgMudPulse value is great than >45, then the system can use filterDiff within AutoSlide as the differential pressure value. Otherwise, the system can use rigDiff as supplied by the rig.

Figure 33:
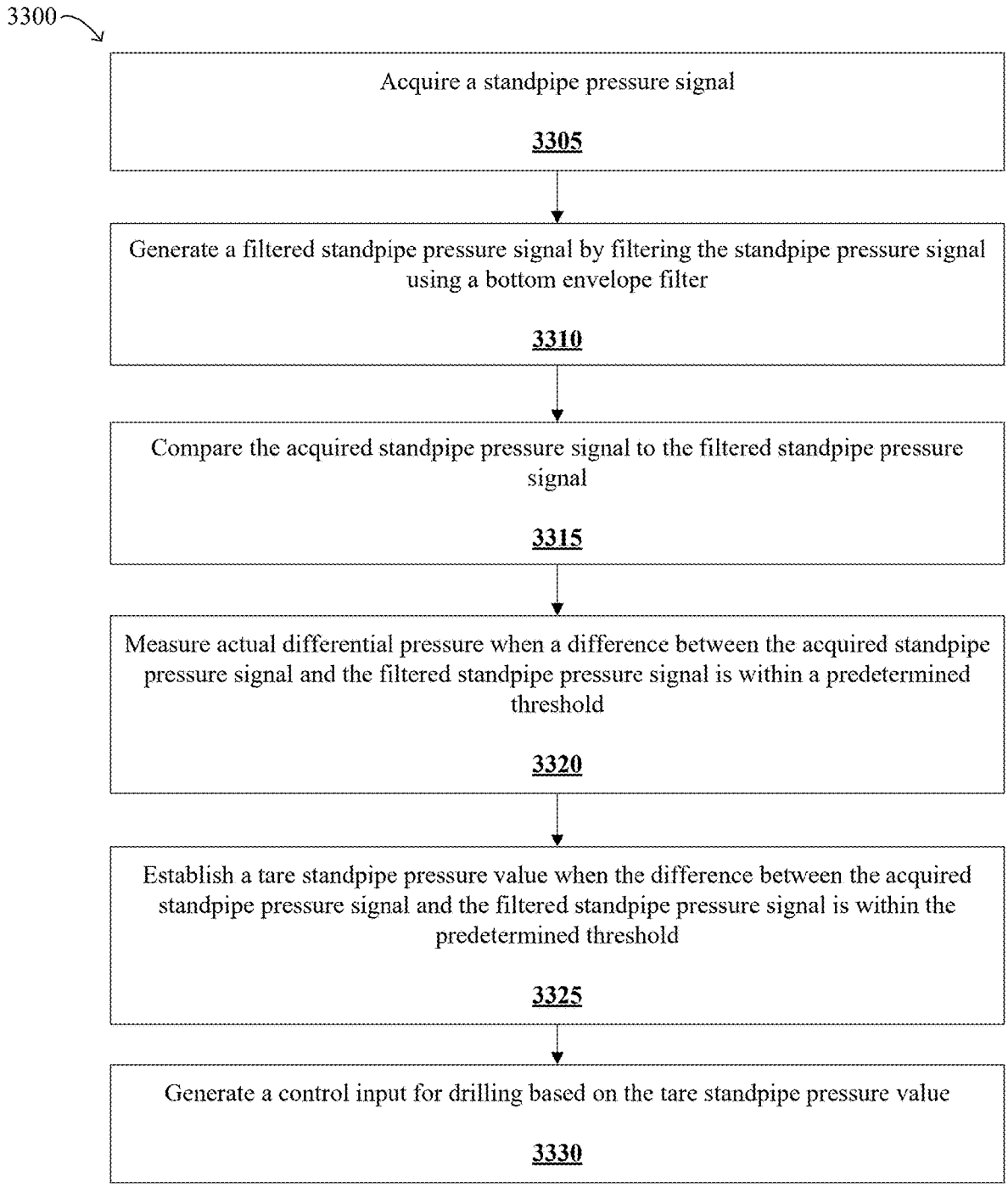
FIG. 33 illustrates an exemplary flowchart for differential pressure signal determination according to various embodiments.

FIG. 33 is a flow chart of a process 3300 for differential pressure signal determination, according to an example of the present disclosure. According to an example, one or more process blocks of FIG. 33 may be performed by computing device.

At block 3305, process 3300 may include acquiring a standpipe pressure signal. For example, computing device may acquire a standpipe pressure signal, as described above.

At block 3310, process 3300 may include generating a filtered standpipe pressure signal by filtering the standpipe pressure signal using a bottom envelope filter. For example, computing device may generate a filtered standpipe pressure signal by filtering the standpipe pressure signal using a bottom envelope filter, as described above.

At block 3315, process 3300 may include comparing the acquired standpipe pressure signal to the filtered standpipe pressure signal. For example, computing device may compare the acquired standpipe pressure signal to the filtered standpipe pressure signal, as described above.

At block 3320, process 3300 may include measuring actual differential pressure when a difference between the acquired standpipe pressure signal and the filtered standpipe pressure signal is within a predetermined threshold. For example, computing device may measure actual differential pressure when a difference between the acquired standpipe pressure signal and the filtered standpipe pressure signal is within a predetermined threshold, as described above.

At block 3325, process 3300 may include establish a tare standpipe pressure value when the difference between the acquired standpipe pressure signal and the filtered standpipe pressure signal is within the predetermined threshold. For example, computing device may establish a tare standpipe pressure value when the difference between the acquired standpipe pressure signal and the filtered standpipe pressure signal is within the predetermined threshold, as described above.

At block 3330, process 3300 may include generating a control input for drilling based on the tare standpipe pressure value. For example, computing device may generate a control input for drilling based on the tare standpipe pressure value, as described above.

Process 3300 may include additional implementations, such as any single implementation or any combination of implementations described below and/or in connection with one or more other processes described elsewhere herein.

In various embodiments, process 3300 further includes determining a pressure measurement in a mud motor using a difference between the actual differential pressure value and a reference pressure value; and determining a torque value applied to a bit using the pressure measurement in the mud motor.

In various embodiments, process 3300 further includes determining a time period to measure the differential pressure value when a mud pulse signal is eliminated from the differential pressure measurement.

In various embodiments, the determining the time period is performed using the standpipe pressure measurement and the bottom envelope filter.

In various embodiments, the time period occurs when data filtered standpipe pressure signal is within a predetermined threshold of an actual standpipe pressure indicating that there are minimal mud pulses in the standpipe pressure signal.

It should be noted that while FIG. 33 shows example blocks of process 3300, in some implementations, process 3300 may include additional blocks, fewer blocks, different blocks, or differently arranged blocks than those depicted in FIG. 33. Additionally, or alternatively, two or more of the blocks of process 3300 may be performed in parallel.

As used below, any reference to a series of examples is to be understood as a reference to each of those examples disjunctively (e.g., "Examples 1-4" is to be understood as "Examples 1, 2, 3, or 4").

Example 1 is a method of controlling spindle offset during drilling operations based on one or more predicted tool face values, comprising: acquiring, by a control system, a plurality of spindle offset values and a plurality of differential pressure values over a period of time; generating, by the control system, one or more predicted tool face values over the period of time using a model therefor; adjusting, by the control system, a spindle offset between two consecutive tool face measured values based on the one or more predicted tool face values; extracting, by the control system, at least one differential pressure value when the at least one differential pressure value is above a threshold value; and controlling the spindle offset by changing one or more control set points and/or the spindle offset values.

Example 2 is the method of example(s) 1, wherein the model uses a multiple-input-single-output transfer function.

Example 3 is the method of example(s) 2, further comprising acquiring a plurality of weight-on-bit values over a period of time; and acquiring a plurality of rate of penetration values over the period of time.

Example 4 is the method of example(s) 3, wherein inputs to the multiple-input-single-output transfer function comprises two or more of: the plurality of spindle offset values; the plurality of differential pressure values; the plurality of weight-on-bit values; and the plurality of rate of penetration values.

Example 5 is the method of example(s) 4, wherein the inputs to the multiple-input-single-output transfer function are measured from a previous slide.

Example 6 is the method of example(s) 4, wherein the inputs to the multiple-input-single-output transfer function are taken during a current slide.

Example 7 is a system for controlling spindle offset during drilling operations based on one or more predicted tool face values comprising: one or more processors coupled to a memory comprising instructions that are configured to be executed by the one or more processors to perform operations comprising: acquire, by a control system, a plurality of spindle offset values and a plurality of differential pressure values over a period of time; generate, by the control system, one or more predicted tool face values over the period of time using a model therefor; adjust, by the control system, a spindle offset between two consecutive tool face measured values based on the one or more predicted tool face values; extract, by the control system, at least one differential pressure value when the at least one differential pressure value is above a threshold value; and control the spindle offset by changing one or more control set points and/or the spindle offset values. The system may include a drill rig controller, wherein the control system sends to the drill rig controller instructions to drill a wellbore using the one or more control set points and/or the spindle offset values.

Example 8 is the system of example(s) 7, wherein the model uses a multiple-input-single-output transfer function.

Example 9 is the system of example(s) 8, the operations further comprising: acquiring a plurality of weight-on-bit values over a period of time; and acquiring a plurality of rate of penetration values over the period of time.

Example 10 is the system of example(s) 9, wherein inputs to the multiple-input-single-output transfer function comprises two or more of: the plurality of spindle offset values the plurality of differential pressure values the plurality of weight-on-bit values; and the plurality of rate of penetration values.

Example 11 is the system of example(s) 10, wherein the inputs to the multiple-input-single-output transfer function are measured from a previous slide.

Example 12 is the system of example(s) 10, wherein the inputs to the multiple-input-single-output transfer function are taken during a current slide.

Example 13 is a non-transitory computer-readable medium storing a set of instructions for controlling spindle offset during drilling operations based on one or more predicted tool face values, the set of instructions comprising: one or more instructions that, when executed by one or more processors of a device, cause the device to: acquire, by a control system, a plurality of spindle offset values and a plurality of differential pressure values over a period of time; generate, by the control system, one or more predicted tool face values over the period of time using a model therefor; adjust, by the control system, a spindle offset between two consecutive tool face measured values based on the one or more predicted tool face values; extract, by the control system, at least one differential pressure value when the at least one differential pressure value is above a threshold value; and control the spindle offset by changing one or more control set points and/or the spindle offset values.

Example 14 is the non-transitory computer-readable medium of example(s) 13, wherein the model uses a multiple-input-single-output transfer function.

Example 15 is the non-transitory computer-readable medium of example(s) 14, the operations further comprising: acquiring a plurality of weight-on-bit values over a period of time; and acquiring a plurality of rate of penetration values over the period of time.

Example 16 is the non-transitory computer-readable medium of example(s) 15, wherein inputs to the multiple-input-single-output transfer function comprises two or more of: the plurality of spindle offset values the plurality of differential pressure values the plurality of weight-on-bit values; and the plurality of rate of penetration values.

Example 17 is the non-transitory computer-readable medium of example(s) 16, wherein the inputs to the multiple-input-single-output transfer function are measured from a previous slide.

Example 18 is the non-transitory computer-readable medium of example(s) 16, wherein the inputs to the multiple-input-single-output transfer function are taken during a current slide.

Example 19 is a method for determining tool face wagging, comprising: acquiring spindle information associated with a spindle position; acquiring tool face information associated with a tool face orientation, wherein the spindle information are acquired withing a predetermined threshold time period; obtaining a first power spectrum of the spindle information and a second power spectrum of the tool face information in a frequency domain; correlating the first power spectrum and the second power spectrum; responsive to the correlation, determining a variation in the tool face in time domain, wherein the variation in the tool face includes a number of times the tool face changes direction; and detecting tool face wagging based on data in the frequency domain and data in time domain such that a direction change of the tool face in the time domain corresponds to a spike or dip of the first power spectrum or the second power spectrum in the frequency domain.

Example 20 is the method according to example 19, further comprising: determining a control input to reduce the tool face wagging; and sending instructions to a controller to apply the control input.

Example 21 is the method according to example 20, wherein the control input comprises modifying one of: weight-on-bit, rate of penetration, rotation speed, spindle position, oscillation, torque, differential pressure, and/or modifying one or more drilling operations.

Example 22 is the method according to example 20, further comprising determining a frequency of tool face wagging based on the variation in the tool face in time domain due to a movement of a spindle excluding spindle offset adjustments.

Example 23 is the method according to example 22, further comprising: comparing the determined frequency with a Nyquist frequency; and when the determined frequency is less than the Nyquist frequency, identifying the determined frequency to be accurate.

Example 24 is the method according to example 22, further comprising: acquiring a number of oscillation wraps forward and reverse for a rig; acquiring an oscillation spindle speed; and calculating a true frequency using an average period of spindle oscillations, the number of oscillation wraps forward and reverse, and the oscillation spindle speed.

Example 25 is the method of example(s) 19, wherein the operation of acquiring the spindle position information indicative of spindle position and the tool face signal indicative of the tool face orientation is performed concurrently with the obtaining the first power spectrum of the spindle position information.

Example 26 is the method of example(s) 19, wherein the correlating the power spectrum of the spindle position signal and the power spectrum of the tool face signal comprising using a short time Fourier transform function.

Example 27 is a system for determining tool face wagging comprising: one or more processors coupled to a memory comprising instructions that are configured to be executed by the one or more processors to perform operations comprising: acquire spindle information associated with a spindle position; acquire tool face information associated with a tool face orientation, wherein the spindle information are acquired withing a predetermined threshold time period; obtain a first power spectrum of the spindle information and a second power spectrum of the tool face information in a frequency domain; correlate the first power spectrum and the second power spectrum; responsive to the correlation, determine a variation in the tool face in time domain, wherein the variation in the tool face includes a number of times the tool face changes direction; and detect tool face wagging responsive to one or more direction changes of the tool face in the time domain corresponds to a spike or dip of the first power spectrum or the second power spectrum in the frequency domain.

Example 28 is the system of example(s) 27, the operations further comprising: determining a control input to eliminate the tool face wagging; and sending instructions to a controller to apply the control input.

Example 29 is the system of example(s) 28, wherein the control input comprises modifying one of weight-on-bit, rate of penetration, rotation speed, spindle position, oscillation, torque, differential pressure, and/or modifying one or more drilling operations.

Example 30 is the system of example(s) 29, the operations further comprising determining a frequency of tool face wagging based on the variation in the tool face in time domain due to a movement of a spindle excluding spindle offset adjustments.

Example 31 is the system of example(s) 30, the operations further comprising: comparing the determined frequency with a Nyquist frequency; and when the determined frequency is less than the Nyquist frequency, identifying the determined frequency to be accurate.

Example 32 is the system of example(s) 30, the operations further comprising: acquiring a number of oscillation wraps forward and reverse for a rig acquiring an oscillation spindle speed; and calculating a true frequency using an average period of spindle oscillations, the number of oscillation wraps forward and reverse, and the oscillation spindle speed.

Example 33 is the system of example(s) 27, wherein the operation of acquiring the spindle position information indicative of spindle position and the tool face signal indicative of the tool face orientation is performed concurrently with the obtaining the first power spectrum of the spindle position information.

Example 34 is the system of example(s) 27, wherein the correlating the power spectrum of the spindle position signal and the power spectrum of the tool face signal comprising using a short time Fourier transform function.

Example 35 is a non-transitory computer-readable medium storing a set of instructions for determining tool face wagging, the set of instructions comprising: one or more instructions that, when executed by one or more processors of a device, cause the device to perform operations comprising: acquire spindle information associated with a spindle position; acquire tool face information associated with a tool face orientation, wherein the spindle information are acquired withing a predetermined threshold time period; obtain a first power spectrum of the spindle information and a second power spectrum of the tool face information in a frequency domain; correlate the first power spectrum and the second power spectrum; responsive to the correlation, determine a variation in the tool face in time domain, wherein the variation in the tool face includes a number of times the tool face changes direction; and detect tool face wagging responsive to one or more direction changes of the tool face in the time domain corresponds to a spike or dip of the first power spectrum or the second power spectrum in the frequency domain.

Example 36 is the non-transitory computer-readable medium of example(s) 35, the operations further comprising: determining a control input to reduce the tool face wagging; and sending instructions to a controller to apply the control input.

Example 37 is the non-transitory computer-readable medium of example(s) 36, wherein the control input comprises modifying one of weight-on-bit, rate of penetration, rotation speed, spindle position, oscillation, torque, differential pressure, and/or modifying one or more drilling operations.

Example 38 is the non-transitory computer-readable medium of example(s) 36, the operations further comprising determining a frequency of tool face wagging based on the variation in the tool face in time domain due to a movement of a spindle excluding spindle offset adjustments.

Example 39 is the non-transitory computer-readable medium of example(s) 38, the operations further comprising: comparing the determined frequency with a Nyquist frequency; and when the determined frequency is less than the Nyquist frequency, identifying the determined frequency to be accurate.

Example 40 is the non-transitory computer-readable medium of example(s) 38, the operations further comprising: acquiring a number of oscillation wraps forward and reverse for a rig acquiring an oscillation spindle speed; and calculating a true frequency using an average period of spindle oscillations, the number of oscillation wraps forward and reverse, and the oscillation spindle speed.

Example 41 is the non-transitory computer-readable medium of example(s) 35, wherein the operation of acquiring the spindle position information indicative of spindle position and the tool face signal indicative of the tool face orientation is performed concurrently with the obtaining the first power spectrum of the spindle position information.

Example 42 is the non-transitory computer-readable medium of example(s) 35, wherein the correlating the power spectrum of the spindle position signal and the power spectrum of the tool face signal comprising using a short time Fourier transform function.

Example 43 is a method for drilling with a neutral position for a spindle of a drilling system, comprising: detecting oscillation of a spindle of a drilling system; monitoring a movement of the spindle for a predetermined amount of time; responsive to the monitoring, determining a first torque on a first side of an assumed neutral point of the spindle and a second torque on a second side of the assumed neutral point the spindle based on the monitoring; determining that a difference between the first torque on the first side of the assumed neutral point of the spindle and the second torque on the second side of the assumed neutral point of the spindle is outside a predetermined range therefor or exceeds a threshold therefor; determining that the spindle is at a non-neutral position based on the difference being outside the predetermined threshold range; and computing a spindle offset value corresponding to the non-neutral position.

Example 44 is the method of example(s) 43, further comprising recommending a spindle adjustment to align the spindle at a neutral position to reduce oscillation of a tool face.

Example 45 is the method of example(s) 43, further comprising automatically implementing a spindle adjustment to align the spindle at a neutral position to reduce oscillation of a tool face.

Example 46 is the method of example(s) 43, wherein a full oscillation cycle is defined as an up or down first movement of the spindle while turning in one direction and a second movement in an opposite direction.

Example 47 is the method of example(s) 43, wherein a neutral position is an offset point.

Example 48 is the method of example(s) 43, wherein the first torque on the right side of the assumed neutral point of the spindle and the second torque on the second side of the assumed neutral point of the spindle are within a predetermined threshold of being equal.

Example 49 is a system for drilling with a neutral position for a spindle of a drilling system comprising: one or more processors coupled to a memory comprising instructions that are configured to be executed by the one or more processors to perform operations comprising: detect oscillation of a spindle of a drilling system; monitor a movement of the spindle for a predetermined amount of time; responsive to the monitoring, determine a first torque on a first side of an assumed neutral point of the spindle and a second torque on a second side of the assumed neutral point the spindle based on the monitoring; determine that a difference between the first torque on the first side of the assumed neutral point of the spindle and the second torque on the second side of the assumed neutral point of the spindle is outside a predetermined range therefor or exceeds a threshold therefor; determine that the spindle is at a non-neutral position based on the difference being outside the predetermined threshold range; and compute a spindle offset value corresponding to the non-neutral position.

Example 50 is the system of example(s) 49, the operations further comprising recommending a spindle adjustment to align the spindle at a neutral position to reduce oscillation of a tool face.

Example 51 is the system of example(s) 49, the operations further comprising automatically implementing a spindle adjustment to align the spindle at a neutral position to reduce oscillation of a tool face.

Example 52 is the system of example(s) 49, wherein a full oscillation cycle is defined as an up or down first movement of the spindle while turning in one direction and a second movement in an opposite direction.

Example 53 is the system of example(s) 49, wherein a neutral position is an offset point.

Example 54 is the system of example(s) 49, wherein the first torque on the right side of the assumed neutral point of the spindle and the second torque on the second side of the assumed neutral point of the spindle are within a predetermined threshold of being equal.

Example 55 is a non-transitory computer-readable medium storing a set of instructions for drilling with a neutral position for a spindle of a drilling system, the set of instructions comprising: one or more instructions that, when executed by one or more processors of a device, cause the device to perform operations comprising: detect oscillation of a spindle of a drilling system; monitor a movement of the spindle for a predetermined amount of time; responsive to the monitoring, determine a first torque on a first side of an assumed neutral point of the spindle and a second torque on a second side of the assumed neutral point the spindle based on the monitoring; determine that a difference between the first torque on the first side of the assumed neutral point of the spindle and the second torque on the second side of the assumed neutral point of the spindle is outside a predetermined range therefor or exceeds a threshold therefor; determine that the spindle is at a non-neutral position based on the difference being outside the predetermined threshold range; and compute a spindle offset value corresponding to the non-neutral position.

Example 56 is the non-transitory computer-readable medium of example(s) 55, the operations further comprising recommending a spindle adjustment to align the spindle at a neutral position to reduce oscillation of a tool face.

Example 57 is the non-transitory computer-readable medium of example(s) 55, the operations further comprising automatically implementing a spindle adjustment to align the spindle at a neutral position to reduce oscillation of a tool face.

Example 58 is the non-transitory computer-readable medium of example(s) 55, wherein a full oscillation cycle is defined as an up or down first movement of the spindle while turning in one direction and a second movement in an opposite direction.

Example 59 is the non-transitory computer-readable medium of example(s) 55, wherein a neutral position is an offset point.

Example 60 is the non-transitory computer-readable medium of example(s) 55, wherein the first torque on the right side of the assumed neutral point of the spindle and the second torque on the second side of the assumed neutral point of the spindle are within a predetermined threshold of being equal.

Example 61 is a method for estimating spindle reaction time to a tool face change, comprising: acquiring a spindle offset signal indicative of a change in spindle offset and a tool face signal indicative of a change in tool face over a predetermined period of time; correlating the spindle offset signal and the tool face signal; and identifying a delay time in correlated signals as a spindle reaction time estimate.

Example 62 is the method according to example 61, further comprising tuning a spindle controller based on the spindle reaction time estimate.

Example 63 is the method of example(s) 61, further comprising varying a timing or a magnitude of a control input for a drilling rig based at least in part of the estimated spindle reaction time.

Example 64 is the method of example(s) 63, wherein the correlating the spindle offset signal and the tool face signal is performed using a single-input single-output model and the spindle offset signal is an input of the single-input single-output model and a tool face value is an output of the single-input single-output model.

Example 65 is the method of example(s) 61, wherein the correlating the spindle offset signal and the tool face signal is performed using a multiple-input single-output model.

Example 66 is the method of example(s) 65, wherein a differential pressure is an input to the single-input single-output model.

Example 67 is the method of example(s) 61, further comprising: determining a period of time during the acquiring the spindle offset signal and the tool face signal that produces a highest cross-correlation between the spindle offset and the tool face signal; and extracting spindle offset signal data and tool face signal data for the period of time.

Example 68 is the method of example(s) 61, wherein the spindle reaction time estimate is determined using a dynamic time warping model.

Example 69 is a system for estimating spindle reaction time to a tool face change comprising: one or more processors coupled to a memory comprising instructions that are configured to be executed by the one or more processors to perform operations comprising: acquire a spindle offset signal indicative of a change in spindle offset and a tool face signal indicative of a change in tool face over a predetermined period of time; correlate the spindle offset signal and the tool face signal; and identify a delay time in correlated signals as a spindle reaction time estimate.

Example 70 is the system of example(s) 69, the operations further comprising tuning a spindle controller based on the spindle reaction time estimate.

Example 71 is the system of example(s) 69, the operations further comprising varying a timing or a magnitude of a control input for a drilling rig based at least in part of the estimated spindle reaction time.

Example 72 is the system of example(s) 71, wherein the correlating the spindle offset signal and the tool face signal is performed using a single-input single-output model and the spindle offset signal is an input of the single-input single-output model and a tool face value is an output of the single-input single-output model.

Example 73 is the system of example(s) 69, wherein the correlating the spindle offset signal and the tool face signal is performed using a multiple-input single-output model.

Example 74 is the system of example(s) 73, wherein a differential pressure is an input to the single-input single-output model.

Example 75 is the system of example(s) 69, the operations further comprising: determining a period of time during the acquiring the spindle offset signal and the tool face signal that produces a highest cross-correlation between the spindle offset and the tool face signal; and extracting spindle offset signal data and tool face signal data for the period of time.

Example 76 is the system of example(s) 69, wherein the spindle reaction time estimate is determined using a dynamic time warping model.

Example 77 is a non-transitory computer-readable medium storing a set of instructions for estimating spindle reaction time to a tool face change, the set of instructions comprising: one or more instructions that, when executed by one or more processors of a device, cause a computing device to perform operations: acquire a spindle offset signal indicative of a change in spindle offset and a tool face signal indicative of a change in tool face over a predetermined period of time; correlate the spindle offset signal and the tool face signal; and identify a delay time in correlated signals as a spindle reaction time estimate.

Example 78 is the non-transitory computer-readable medium of example(s) 77, the operations further comprising tuning a spindle controller based on the spindle reaction time estimate.

Example 79 is the non-transitory computer-readable medium of example(s) 77, the operations further comprising varying a timing or a magnitude of a control input for a drilling rig based at least in part of the estimated spindle reaction time.

Example 80 is the non-transitory computer-readable medium of example(s) 79, wherein the correlating the spindle offset signal and the tool face signal is performed using a single-input single-output model and the spindle offset signal is an input of the single-input single-output model and a tool face value is an output of the single-input single-output model.

Example 81 is the non-transitory computer-readable medium of example(s) 77, wherein the correlating the spindle offset signal and the tool face signal is performed using a multiple-input single-output model.

Example 82 is the non-transitory computer-readable medium of example(s) 81, wherein a differential pressure is an input to the single-input single-output model.

Example 83 is the non-transitory computer-readable medium of example(s) 77, the operations further comprising: determining a period of time during the acquiring the spindle offset signal and the tool face signal that produces a highest cross-correlation between the spindle offset and the tool face signal; and extracting spindle offset signal data and tool face signal data for the period of time.

Example 84 is the non-transitory computer-readable medium of example(s) 77, wherein the spindle reaction time estimate is determined using a dynamic time warping model.

Example 85 is a method for differential pressure signal determination, comprising: acquiring a standpipe pressure signal; generating a filtered standpipe pressure signal by filtering the standpipe pressure signal using a bottom envelope filter; comparing the acquired standpipe pressure signal to the filtered standpipe pressure signal; measuring actual differential pressure when a difference between the acquired standpipe pressure signal and the filtered standpipe pressure signal is within a predetermined threshold; establish a tare standpipe pressure value when the difference between the acquired standpipe pressure signal and the filtered standpipe pressure signal is within the predetermined threshold; and generating a control input for drilling based on the tare standpipe pressure value.

Example 86 is the method of example(s) 85, further comprising: determining a pressure measurement in a mud motor using a difference between the actual differential pressure value and a reference pressure value; and determining a torque value applied to a bit using the pressure measurement in the mud motor.

Example 87 is the method of example(s) 85, further comprising: determining a time period to measure the differential pressure value when a mud pulse signal is eliminated from the differential pressure measurement.

Example 88 is the method of example(s) 87, wherein the determining the time period is performed using the standpipe pressure measurement and the bottom envelope filter.

Example 89 is the method of example(s) 87, wherein the time period occurs when data filtered standpipe pressure signal is within a predetermined threshold of an actual standpipe pressure indicating that there are minimal mud pulses in the standpipe pressure signal.

Example 90 is the method of example(s) 87, further comprising filtering out mud pulses for communication and while receiving other differential pressure changes for control.

Example 91 is the method of example(s) 87, further comprising zeroing the differential pressure value when sensor obtained mud pressure and the filtered standpipe pressure signal are withing a predetermined threshold of zero.

Example 92 is a system for differential pressure signal determination comprising: one or more processors configured to perform operations: acquire a standpipe pressure signal; generate a filtered standpipe pressure signal by filtering the standpipe pressure signal using a bottom envelope filter; compare the acquired standpipe pressure signal to the filtered standpipe pressure signal; measure actual differential pressure when a difference between the acquired standpipe pressure signal and the filtered standpipe pressure signal is within a predetermined threshold; establish a tare standpipe pressure value when the difference between the acquired standpipe pressure signal and the filtered standpipe pressure signal is within the predetermined threshold; and generate a control input for drilling based on the tare standpipe pressure value.

Example 93 is the system of example(s) 92, further comprising: determining a pressure measurement in a mud motor using a difference between the actual differential pressure value and a reference pressure value; and determining a torque value applied to a bit using the pressure measurement in the mud motor.

Example 94 is the system of example(s) 92, further comprising: determining a time period to measure the differential pressure value when a mud pulse signal is eliminated from the differential pressure measurement.

Example 95 is the system of example(s) 94, wherein the determining the time period is performed using the standpipe pressure measurement and the bottom envelope filter.

Example 96 is the system of example(s) 94, wherein the time period occurs when data filtered standpipe pressure signal is within a predetermined threshold of an actual standpipe pressure indicating that there are minimal mud pulses in the standpipe pressure signal.

Example 97 is the system of example(s) 94, further comprising filtering out mud pulses for communication and while receiving other differential pressure changes for control.

Example 98 is the system of example(s) 94, further comprising zeroing the differential pressure value when sensor obtained mud pressure and the filtered standpipe pressure signal are withing a predetermined threshold of zero.

Example 99 is a non-transitory computer-readable medium storing a set of instructions for differential pressure signal determination, the set of instructions comprising: one or more instructions that, when executed by one or more processors of a device, cause the device to: acquire a standpipe pressure signal; generate a filtered standpipe pressure signal by filtering the standpipe pressure signal using a bottom envelope filter; compare the acquired standpipe pressure signal to the filtered standpipe pressure signal; measure actual differential pressure when a difference between the acquired standpipe pressure signal and the filtered standpipe pressure signal is within a predetermined threshold; establish a tare standpipe pressure value when the difference between the acquired standpipe pressure signal and the filtered standpipe pressure signal is within the predetermined threshold; and generate a control input for drilling based on the tare standpipe pressure value.

Example 100 is the non-transitory computer-readable medium of example(s) 99, further comprising: determining a pressure measurement in a mud motor using a difference between the actual differential pressure value and a reference pressure value; and determining a torque value applied to a bit using the pressure measurement in the mud motor.

Example 101 is the non-transitory computer-readable medium of example(s) 99, further comprising: determining a time period to measure the differential pressure value when a mud pulse signal is eliminated from the differential pressure measurement.

Example 102 is the non-transitory computer-readable medium of example(s) 101, wherein the determining the time period is performed using the standpipe pressure measurement and the bottom envelope filter.

Example 103 is the non-transitory computer-readable medium of example(s) 101, wherein the time period occurs when data filtered standpipe pressure signal is within a predetermined threshold of an actual standpipe pressure indicating that there are minimal mud pulses in the standpipe pressure signal.

Example 104 is the non-transitory computer-readable medium of example(s) 101, further comprising filtering out mud pulses for communication and while receiving other differential pressure changes for control.

Example 105 is the non-transitory computer-readable medium of example(s) 101, further comprising zeroing the differential pressure value when sensor obtained mud pressure and the filtered standpipe pressure signal are withing a predetermined threshold of zero.

The above disclosed subject matter is to be considered illustrative, and not restrictive, and the appended claims are intended to cover all such modifications, enhancements, and other embodiments which fall within the true spirit and scope of the present disclosure. The pressures, times, and other data and parameters are provided as examples, and the invention is not intended to be limited to such examples. Thus, to the maximum extent allowed by law, the scope of the present disclosure is to be determined by the broadest permissible interpretation of the following claims and their equivalents and shall not be restricted or limited by the foregoing detailed description.

What is claimed is:

1. A system for controlling spindle offset during drilling operations based on one or more predicted tool face values comprising:

one or more processors coupled to a memory comprising instructions that are configured to be executed by the one or more processors to perform operations comprising:

acquire, by a control system, a plurality of spindle offset values and a plurality of differential pressure values over a period of time;

generate, by the control system, one or more predicted tool face values over the period of time using a multiple-input-single-output transfer function model, wherein inputs to the multiple-input-single-output transfer function comprise the plurality of spindle offset values and the plurality of differential pressure values, wherein each differential pressure value is a pressure of drilling fluid across a mud motor at a given time;

change one or more control set points and/or the plurality of spindle offset values based on the one or more predicted tool face values, wherein each control set point corresponds to a target inclination for the spindle; and a drill rig controller, wherein the control system sends to the drill rig controller instructions to drill a wellbore using the one or more control set points and/or the plurality of spindle offset values.

2. The system of claim 1, the operations further comprising:

acquiring a plurality of weight-on-bit values over a period of time; and acquiring a plurality of rate of penetration values over the period of time.

3. The system of claim 2, wherein inputs to the multiple-input-single-output transfer function further comprises:

the plurality of weight-on-bit values; or the plurality of rate of penetration values.

4. The system of claim 3, wherein the inputs to the multiple-input-single-output transfer function are measured from a previous slide.

5. The system of claim 3, wherein the inputs to the multiple-input-single-output transfer function are taken during a current slide.

6. A system for drilling a wellbore with a neutral position for a spindle of a drilling system comprising:

one or more processors coupled to a memory comprising instructions that are configured to be executed by the one or more processors to perform operations comprising:

detect oscillation of a spindle of a drilling system;

monitor a movement of the spindle for a predetermined amount of time;

responsive to the monitoring, determine a first torque on a first side of an assumed neutral point of the spindle and a second torque on a second side of the assumed neutral point of the spindle based on the monitoring;

determine that a difference between the first torque on the first side of the assumed neutral point of the spindle and the second torque on the second side of the assumed neutral point of the spindle is outside a predetermined range or exceeds a threshold;

determine that the spindle is at a non-neutral position based on the difference being outside the predetermined threshold range;

compute a spindle offset value corresponding to the non-neutral position; and drill at least a portion of the wellbore using the computed spindle offset value.

7. The system of claim 6, the operations further comprising recommending a spindle adjustment to align the spindle at a neutral position to reduce oscillation of a tool face.

8. The system of claim 6, the operations further comprising automatically implementing a spindle adjustment to align the spindle at a neutral position to reduce oscillation of a tool face.

9. The system of claim 6, wherein a full oscillation cycle is defined as an up or down first movement of the spindle while turning in one direction and a second movement in an opposite direction.

10. The system of claim 6, wherein a neutral position is an offset point.

11. The system of claim 6, wherein the first torque on the right side of the assumed neutral point of the spindle and the second torque on the second side of the assumed neutral point of the spindle are within a predetermined threshold of being equal.

12. A computer-implemented method for controlling spindle offset during drilling operations based on one or more predicted tool face values comprising:

acquiring, by a control system, a plurality of spindle offset values and a plurality of differential pressure values over a period of time;

generating, by the control system, one or more predicted tool face values over the period of time using a multiple-input-single-output transfer function model, wherein inputs to the multiple-input-single-output transfer function comprise the plurality of spindle offset values and the plurality of differential pressure values, wherein each differential pressure value is a pressure of drilling fluid across a mud motor at a given time;

changing one or more control set points and/or the plurality of spindle offset values based on the one or more predicted tool face values, wherein each control set point corresponds to a target inclination for the spindle; and sending, to a drill rig controller, instructions to drill a wellbore using the one or more control set points and/or the plurality of spindle offset values.

13. The method of claim 12, further comprising:

acquiring a plurality of weight-on-bit values over a period of time; and acquiring a plurality of rate of penetration values over the period of time.

14. The method of claim 13, wherein inputs to the multiple-input-single-output transfer function further comprises:

the plurality of weight-on-bit values; or the plurality of rate of penetration values.

15. The method of claim 14, wherein the inputs to the multiple-input-single-output transfer function are measured from a previous slide.

16. The method of claim 14, wherein the inputs to the multiple-input-single-output transfer function are taken during a current slide.

* * * * *